US008378767B2

(12) United States Patent
Okubo et al.

(10) Patent No.: US 8,378,767 B2
(45) Date of Patent: Feb. 19, 2013

(54) ELECTROMAGNETIC CONTACT DEVICE

(75) Inventors: Koji Okubo, Kumagaya (JP); Koetsu Takaya, Kounosu (JP); Yasuhiro Naka, Kounosu (JP); Toshikatsu Ohgami, Kumagaya (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/138,731

(22) PCT Filed: Jun. 14, 2010

(86) PCT No.: PCT/JP2010/003933

§ 371 (c)(1),
(2), (4) Date: Nov. 10, 2011

(87) PCT Pub. No.: WO2011/021331

PCT Pub. Date: Feb. 24, 2011

(65) Prior Publication Data

US 2012/0133460 A1 May 31, 2012

(30) Foreign Application Priority Data

Aug. 20, 2009 (JP) ..... 2009-190583

(51) Int. Cl.
*H01H 67/02* (2006.01)

(52) U.S. Cl. ..... 335/132; 335/78; 335/128

(58) Field of Classification Search ..... 335/78, 335/128–132

See application file for complete search history.

(56) References Cited

U.S. PATENT DOCUMENTS

| | | | | |
|---|---|---|---|---|
| 4,912,439 | A * | 3/1990 | Nagy et al. | 335/132 |
| 5,197,594 | A | 3/1993 | Drexler et al. | |
| 5,677,655 | A * | 10/1997 | Hinata et al. | 335/132 |
| 6,137,385 | A * | 10/2000 | Conway et al. | 335/132 |
| 6,184,762 | B1 * | 2/2001 | Reiss et al. | 335/202 |
| 6,512,433 | B1 * | 1/2003 | Bouchard et al. | 335/6 |
| 7,733,203 | B2 * | 6/2010 | Kim | 335/202 |
| 2005/0200439 | A1 | 9/2005 | Kawahara et al. | |
| 2008/0174391 | A1 * | 7/2008 | Bolz et al. | 335/202 |
| 2012/0112858 | A1 * | 5/2012 | Takaya et al. | 335/133 |

FOREIGN PATENT DOCUMENTS

| | | |
|---|---|---|
| JP | S61-181016 | 8/1986 |
| JP | S63-187523 | 8/1988 |
| JP | U H02-074743 | 6/1990 |
| JP | H06-076719 | 3/1994 |
| JP | H08-087940 | 4/1996 |
| JP | 2005-302700 | 10/2005 |
| JP | 2006-100027 | 4/2006 |

* cited by examiner

*Primary Examiner* — Bernard Rojas
(74) *Attorney, Agent, or Firm* — Manabu Kanesaka

(57) ABSTRACT

Two electromagnetic contact devices 1*a*, 1*b* are arranged adjacently, a reversible unit 2 is detachably mounted on these electromagnetic contact devices, and two auxiliary contact point units 4*a*, 4*b* are detachably mounted on the reversible unit. In addition, two surge absorption units 3*a*, 3*b* are detachably mounted on the electromagnetic contact devices.

8 Claims, 73 Drawing Sheets

FIG. 11

● · · · MOUNTED, — · · · NOT MOUNTED, × · · · COMBINATION NOT POSSIBLE

| | ANCILLARY UNITS | | |
|---|---|---|---|
| | SUBSIDIARY CONTACT POINT UNIT | SURGE ABSORPTION UNIT | REVERSIBLE UNIT |
| ELECTROMAGNETIC CONTACT DEVICES × 2 (REVERSIBLE) | ● | — | × |
| | — | ● | × |
| | ● | ● | × |
| ELECTROMAGNETIC CONTACT DEVICES × 2 (REVERSIBLE) | — | — | ● |
| | ● (1 OR 2) | — | ● |
| | — | ● (1 OR 2) | ● |
| | ● (1 OR 2) | ● (1 OR 2) | ● |

(1 OR 2) · · · MOUNTABLE ON ONE AMONG TWO ELECTROMAGNETIC CONTACT DEVICES, OR ON BOTH (a)

(b)

(a)

(b)

(a)

(b)

ELECTROMAGNETIC CONTACT DEVICE

TECHNICAL FIELD

This invention relates to an electromagnetic contact device on which an ancillary unit is mounted in accordance with user demands.

BACKGROUND ART

As an electromagnetic contact device on which is mounted an ancillary unit, for example, the apparatus described in Patent Reference 1 is known. This apparatus is a reversible-type electromagnetic contact apparatus connected to a feed circuit of an induction motor and capable of forward/reverse operation control of the induction motor; two electromagnetic contact devices are connected via a mechanical interlock unit (reversible unit) which prohibits simultaneous input of the electromagnetic contact devices.

Patent Reference 1: Japanese Patent Laid-open No. 2006-100027

DISCLOSURE OF THE INVENTION

Ancillary units mounted on electromagnetic contact devices include, in addition to the above-described reversible unit, surge absorption units which absorb the surge voltage generated by the electromagnet, auxiliary contact point units which provide auxiliary circuit terminals as auxiliary terminals of the main circuit terminals of the electromagnetic contact device, and similar.

However, the above-described electromagnetic contact device of Patent Reference 1 is an apparatus on which is mounted only and specifically a reversible unit, and other ancillary units such as a surge absorption unit, auxiliary contact point unit, and similar cannot be mounted. Further, there has not existed an electromagnetic contact device which enables simultaneous mounting of any two types among a plurality of types of ancillary units, such as for example, a reversible unit and a surge absorption unit, in accordance with user demands.

Hence focusing on this unresolved problem in the above examples of the prior art, this invention has an object to provide an electromagnetic contact device which enables selection of a plurality of types of ancillary units in accordance with various demands of users, and the selection from among these of one or more types of ancillary units and the simple mounting thereof.

In order to achieve the above object, in the electromagnetic contact device of one embodiment, a body case is provided with a case-side mounting portion on which one or more different types of ancillary units can be mounted simultaneously; unit-side mounting portions of the one or more types of ancillary units are detachably mounted on the case-side mounting portion.

By means of the electromagnetic contact device of this embodiment, ancillary units can be mounted on the electromagnetic device in accordance with user demands.

Further, the electromagnetic contact device of one embodiment has arranged within the body case, a movable contact support, an electromagnet that moves the movable contact support by exciting a coil, and an operation indicator piece that is formed integrally with the movable contact support and exposed to the outside from an indicator window provided on a side of the body case on which the ancillary units are mounted; and a unit-side mounting portion of at least one of, as the ancillary unit, a surge absorption unit that absorbs surge voltages generated by the electromagnet, and an auxiliary contact point unit provided with an auxiliary circuit terminal, is detachably mounted on the case-side mounting portion of one electromagnetic contact device. Here, the auxiliary contact point unit is provided in a unit case so as to be linkable with the operation indicator piece of the electromagnetic contact device, and has an auxiliary contact point unit operation indicator piece that is exposed to the outside from the indicator window provided in the unit case.

By means of the electromagnetic contact device of this embodiment, a plurality of types of ancillary units can easily be mounted on one electromagnetic contact device.

Further, the electromagnetic contact device of one embodiment has within the body case, a movable contact support, an electromagnet that moves the movable contact support by exciting a coil, and an operation indicator piece that is formed integrally with the movable contact support and exposed to the outside from an indicator window provided on a side of the body case on which the ancillary units are mounted; two electromagnetic contact devices are arranged adjacently, and the two electromagnetic contact devices are linked by detachably mounting, on case-side mounting portions of these electromagnetic contact devices, unit-side mounting portions of a reversible unit that serves as the ancillary unit and prohibits simultaneous input of the two electromagnetic contact devices.

Further, in the electromagnetic contact device of one embodiment, a unit-side mounting portion for one or two auxiliary contact point units serving as the ancillary unit and provided with auxiliary circuit terminals is detachably mounted on an inter-unit mounting portion provided in the reversible unit, and a unit-side mounting portion for one or two surge absorption units serving as the ancillary unit and absorbing surge voltages generated by the electromagnet is detachably mounted on a case-side mounting portion of the electromagnetic contact device.

Further, in the electromagnetic contact device of one embodiment, the reversible unit is provided with a reversible unit operation indicator piece within the unit case, so as to be linkable with the operation indicator piece of the electromagnetic contact device, and exposed to the outside from the indicator window provided in the unit case.

By means of the electromagnetic contact device of this embodiment, a plurality of types of ancillary units can easily be mounted with two electromagnetic contact devices as reversible types.

Further, in the electromagnetic contact device of one embodiment, the auxiliary contact point unit is provided with an auxiliary contact point unit operation indicator piece within the unit case, so as to be linkable with the reversible unit operation indicator piece of the reversible unit, and exposed to the outside from the indicator window provided in the unit case.

By means of the electromagnetic contact device of this embodiment, operation of the electromagnetic contact device can be accurately confirmed in a state in which the auxiliary contact point unit is mounted.

Further, in the electromagnetic contact device of one embodiment, the surge absorption unit is detachably mounted on the electromagnetic contact device spanning the reversible unit.

By means of the electromagnetic contact device of this embodiment, mounting of a surge absorption unit and a reversible unit can easily be performed.

By means of this invention, whether a single electromagnetic contact device is used, or two electromagnetic contact devices are used and a reversible configuration is adopted, a plurality of types of ancillary units can be selected in accordance with user demands, and one or more types of ancillary units can be selected among these and can easily be mounted.

BRIEF DESCRIPTION OF THE DRAWINGS

FIG. 11 is a table showing a pattern of combinations of electromagnetic contact devices and a plurality of types of ancillary units;

BEST MODE FOR CARRYING OUT THE INVENTION

Figure 1:
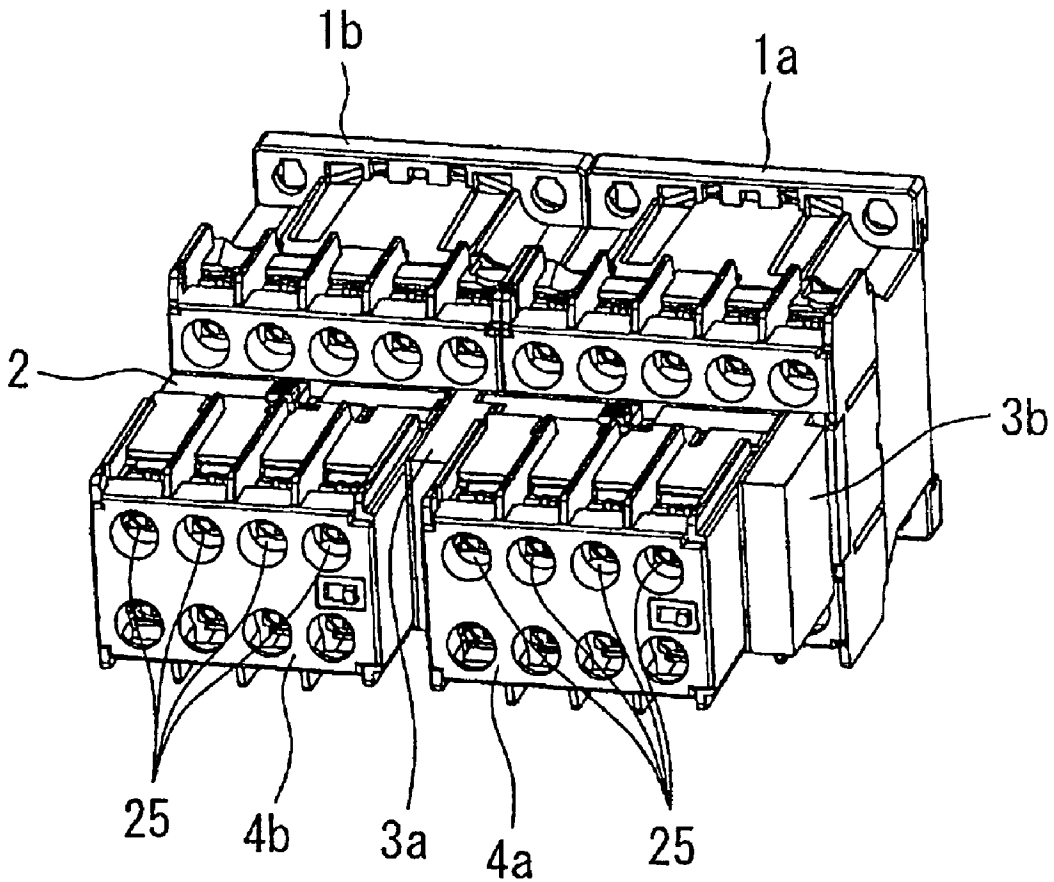
FIG. 1 is a perspective view showing an electromagnetic contact apparatus of the invention.

Below, preferred embodiments of the invention (hereafter called "embodiments") are explained in detail, referring to the drawings.

FIG. 1 is a perspective view showing an electromagnetic contact apparatus connected to the feed circuit of a three-phase induction motor (not shown), which performs forward/reverse operation control of the induction motor; this apparatus has two electromagnetic contact devices 1*a* and 1*b*, one reversible unit 2, two surge absorption units 3*a* and 3*b*, and two auxiliary contact point units 4*a* and 4*b*.

One of the electromagnetic contact devices 1*a* among the two electromagnetic contact devices 1*a*, 1*b* is an electromagnetic contact device which performs forward operation control of the induction motor, and the other electromagnetic contact device 1*b* is an electromagnetic contact device which performs reverse operation control of the induction motor.

Figure 2:
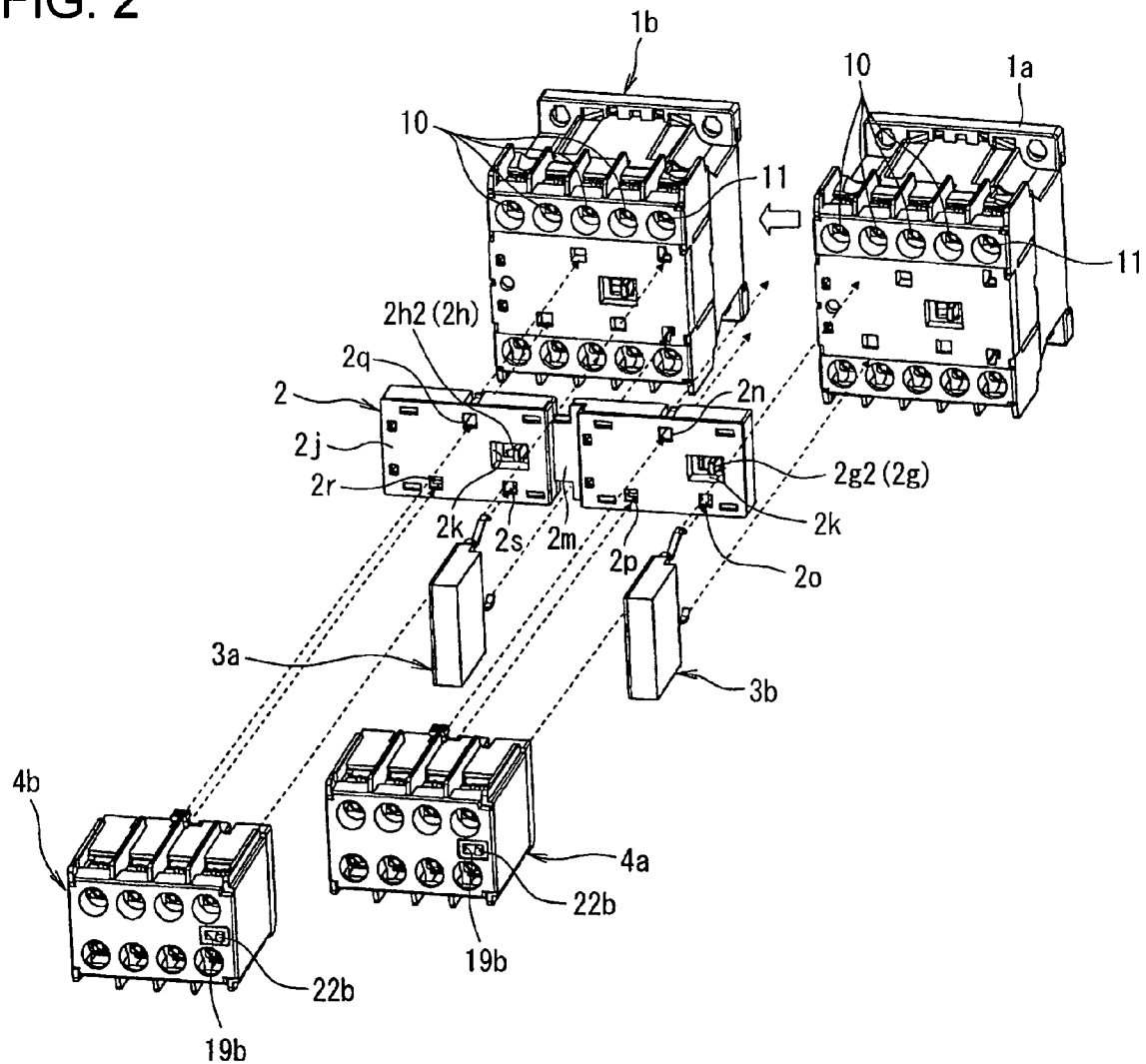
FIG. 2 is an exploded perspective view of the device of FIG. 1.
Figure 3:
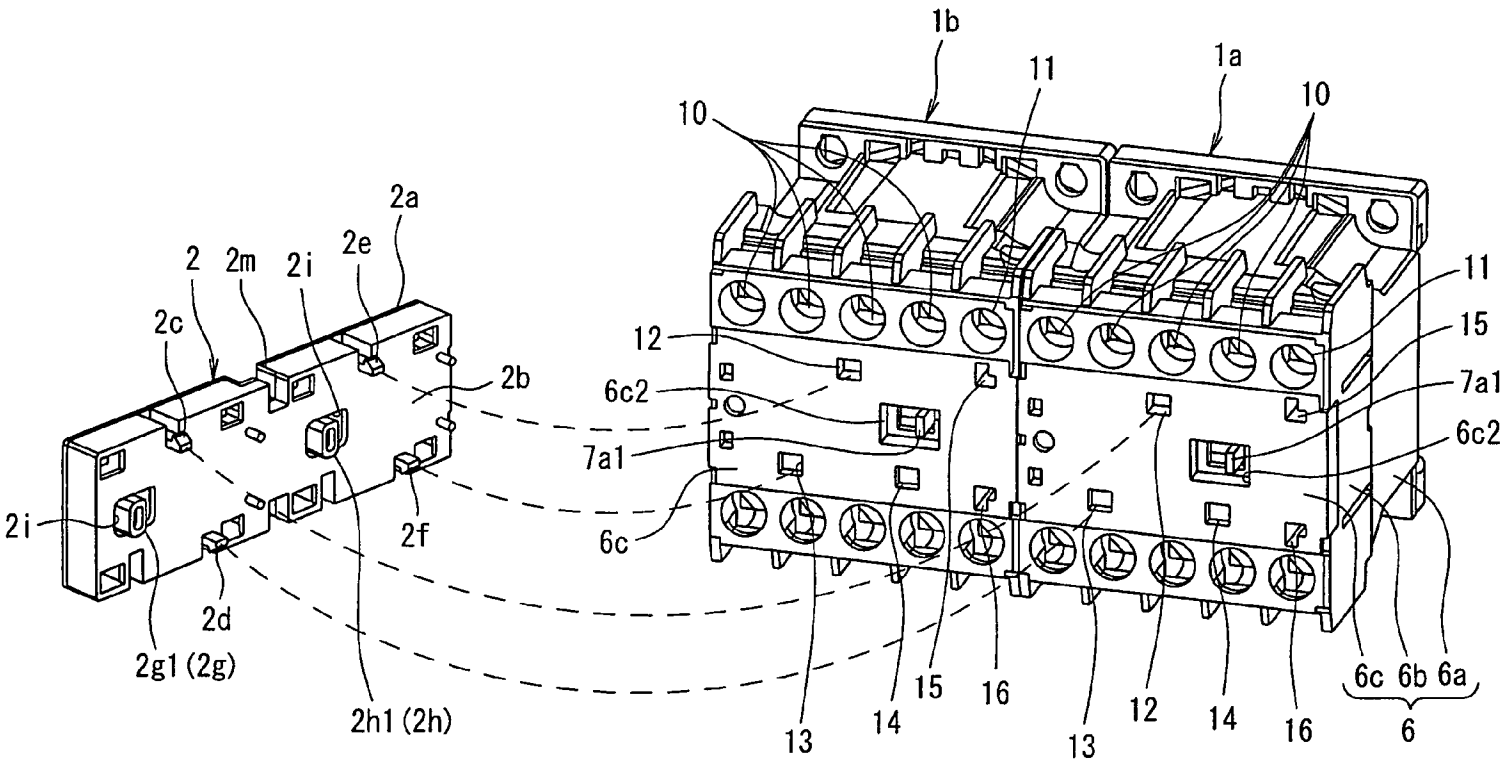
FIG. 3 shows a state in which a reversible unit is mounted on a pair of electromagnetic contact devices.

As shown in FIG. 2, the electromagnetic contact device 1*a* is an apparatus comprising terminal portions 10 each of which have contact points, and coil terminal portions 11; as shown in FIG. 3, a contact point portion 7, electromagnet 8, and driving lever 9, described below, are accommodated in a body case 6. The body case 6 has a lower case 6*a* which accommodates the electromagnet 8, an upper case 6*b* which accommodates the contact point portion 7, and an arc-extinguishing cover 6*c* which covers the upper portion of the upper case 6*b*.

A rectangular indicator window 6*c*2 which communicates with the front and rear is formed in the arc-extinguishing cover 6*c*, and in this indicator window 6*c*2 is placed an operation indicator piece 7*a*1 of the contact point portion 7. Further, in this arc-extinguishing cover 6*c* are formed a first linking hole 12 to a fifth linking hole 16, communicating with the front and rear and enabling linking of one reversible unit 2 and two surge absorption units 3*a*, 3*b*.

The first to third linking holes 12 to 14 are holes opened in a square shape. The fourth and fifth linking holes 15, 16 are formed by opening in an L shape in the arc-extinguishing cover 6*c* near the coil terminal portion 11.

Figure 5:
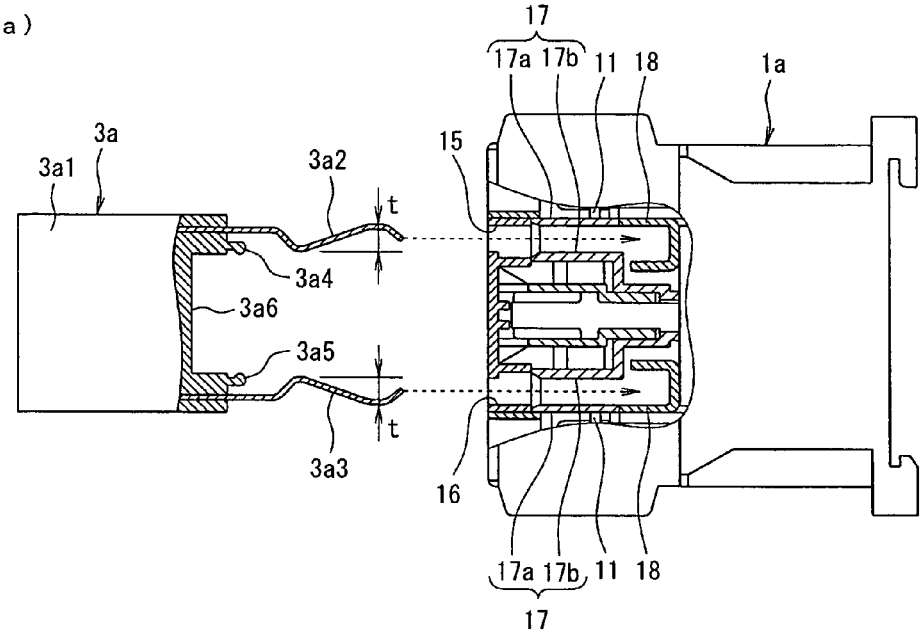
FIG. 5 shows a mounted state of an electromagnetic contact device and a surge absorption unit.
Figure 5:
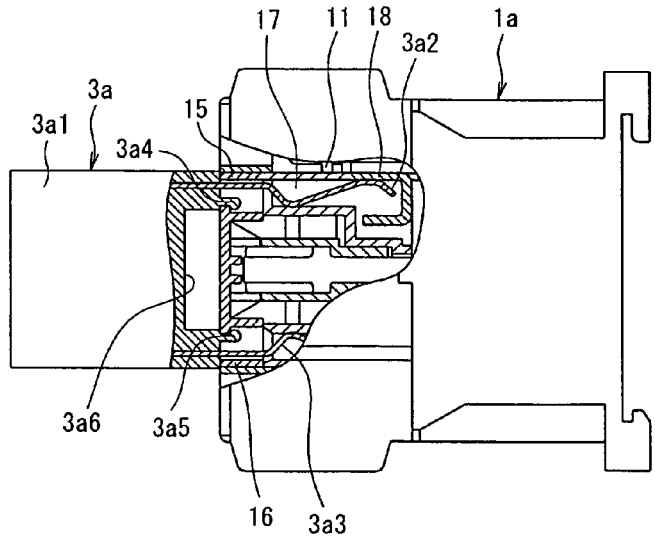

As shown in FIG. 5, within the electromagnetic contact device 1*a*, surge terminal insertion paths 17 provided with two mutually opposing side walls 17*a*, 17*b* are provided at positions facing the fourth and fifth linking holes 15, 16. Further, at one end of the surge terminal insertion paths 17 are provided surge terminals 18, forming a portion of the surface terminal insertion paths 17 and electrically connected to the coil terminal portions 11 and surge absorption units 3*a*, 3*b*, in a shape which is bent so as to block the surface terminal insertion paths 17.

The other electromagnetic contact device 1*b* also has the same structure as the one electromagnetic contact device 1*a*, and so an explanation is omitted.

(Reversible Unit)

The reversible unit 2 is an apparatus which arranges and fixes the two electromagnetic contact devices 1*a*, 1*b* adjacently, and mechanically forbids a state in which the two electromagnetic contact devices 1*a*, 1*b* are simultaneously in the closed (ON) state, even when operation signals are input to the two electromagnetic contact devices 1*a*, 1*b* due to some manipulation (even when the electromagnets 8 of the two electromagnetic contact devices 1*a*, 1*b* attempt to operate simultaneously).

As shown in FIG. 3, the reversible unit 2 has a rectangular-shaped unit body 2*a*, a first abutting face 2*b* of the unit body 2*a* which abuts against the arc-extinguishing covers 6*c*, 6*c* of the two electromagnetic contact devices 1*a*, 1*b* arranged adjacently, first to fourth hook portions 2*c* to 2*f* protruding from this first abutting face 2*b*, and a pair of reversible posts 2*g*, 2*h*. The pair of reversible posts 2*g*, 2*h* engages with the operation indicator pieces 7*a*1 of the two electromagnetic contact devices 1*a*, 1*b* respectively, and through linkage with a lock mechanism (not shown) incorporated in the unit body 2*a*, only one among these operation indicator pieces 7*a*1 can move. Further, a neck portion 2*m*, the width dimension and thickness direction of which are made smaller than other places in the length direction, is formed substantially in the center in the length direction of the unit body 2*a*.

The pair of reversible posts 2*g*, 2*h* has cylindrical display piece engaging portions 2*g*1, 2*h*1 protruding from a rectangular unit window 2*i* formed in the first abutting face 2*b*, as shown in FIG. 3, and reversible unit operation indicator pieces 2*g*2, 2*h*2 protruding from a rectangular unit window 2*k* formed in a second abutting face 2*j* in the rear face with respect to the first abutting face 2*b*, as shown in FIG. 2. Here, as shown in FIG. 2, sixth to eleventh linking holes 2*n*, 2*o*, 2*p*, 2*q*, 2*r*, 2*s*, which respectively engage with the hook portions 20*a*, 20*b*, 20*c* of the auxiliary contact point units 4*a*, 4*b* described below, are formed in the second abutting face 2*j*.

And as shown in FIG. 3, the tip of the first hook portion 2*c* of the reversible unit 2 is inserted into the first linking hole 12 of the electromagnetic contact device 1*a* and engaged with the opening periphery, the tip of the second hook portion 2*d* is inserted into the second linking hole 13 of the electromagnetic contact device 1*a* and engaged with the opening periphery, the tip of the third hook portion 2*e* is inserted into the first linking hole 12 of the electromagnetic contact device 1*b* and engaged with the opening periphery, and the tip of the fourth hook portion 2*f* is inserted into the second linking hole 13 of the electromagnetic contact device 1*b* and engaged with the opening periphery; in addition, the indicator piece engaging portions 2*g*1, 2*h*1 of the pair of reversible posts 2*g*, 2*h* are mated with the operation indicator pieces 7*a*1 of the two electromagnetic contact devices 1*a*, 1*b* respectively. And, in the reversible unit 2 connected between the two electromagnetic contact devices 1*a*, 1*b*, the pair of reversible posts 2*g*, 2*h* mechanically forbid simultaneous movement of the movable contact point support 7*a* of one electromagnetic contact device 1*a* and the other movable contact point support 7*b*, via the operation indicator pieces 7*a*1 of the two electromagnetic contact devices 1*a*, 1*b*, so that a simultaneous closed (ON) state of the two electromagnetic contact devices 1*a*, 1*b* is restricted.

(Surge Absorption Units)

The pair of surge absorption units 3*a*, 3*b* is apparatuses incorporating elements which absorb the surge voltages generated when excitation of the coils 8*a* of the electromagnets 8 is stopped.

As shown in FIG. 5(*a*), one of the surge absorption units 3*a* has a unit body 3*a*1 incorporating the element; a pair of long surge elements 3*a*2, 3*a*3 protruding in the same direction from one side of this unit body 3*a*1; a pair of hook portions 3*a*4, 3*a*5 on the inside of this pair of surge elements 3*a*2, 3*a*3 and protruding from one side of the unit body 3*a*1; and a recess portion 3*a*6 provided on one side of the unit body 3*a*1 between the pair of hook portions 3*a*4, 3*a*5.

The pair of surge elements 3*a*2, 3*a*3 is formed by bending in directions to mutually approach and recede; the maximum bending width thereof t is set to a dimension greater than the distance between the two side walls 17*a*, 17*b* forming the surge terminal insertion path 17 of the electromagnetic contact device 1*a*.

As shown in FIG. 5(*b*), one surge terminal 3*a*2 and hook portion 3*a*4 of one surge absorption unit 3*a* in the above configuration are inserted into the fourth linking hole 15 of one electromagnetic contact device 1*a*, and the other surge terminal 3*a*3 and hook portion 3*a*5 are inserted into the fifth linking hole 16 of the electromagnetic contact device 1*a*. And, the pair of surge terminals 3*a*2, 3*a*3 is passed through the surge terminal insertion path 17 while undergoing elastic deformation and come into close contact with the surge terminals 18, the hook portion 3*a*4 engages with the opening periphery of the fourth linking hole 15, and the hook portion 3*a*5 engages with the opening periphery of the fifth linking hole 16, and by this means electrical connection with the electromagnet 8 of one electromagnetic contact device 1*a* is made.

The other surge absorption unit 3*b* has the same structure as the one surge absorption unit 3*a*, and has a unit body 3*b*1, a pair of surge terminals 3*b*2, 3*b*3, a pair of hook portions 3*b*4, 3*b*5, and a recess portion 3*b*6.

Figure 6:
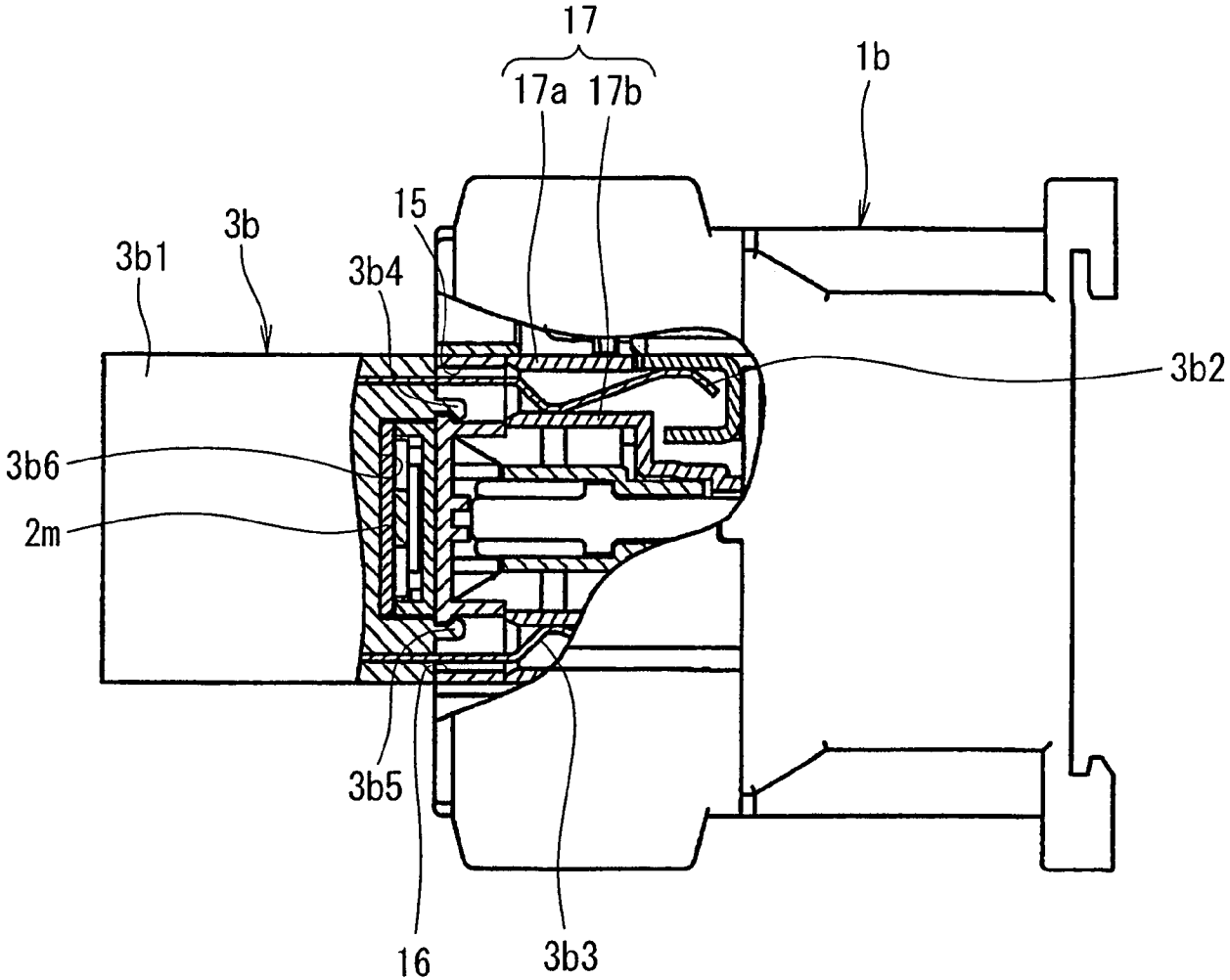
FIG. 6 shows a state in which a surge absorption unit is mounted on an electromagnetic contact device spanning a reversible unit.

As shown in FIG. 6, one surge terminal 3*b*2 and hook portion 3*b*4 of the other surge absorption unit 3*a* are inserted into the fourth linking hole 15 of the other electromagnetic contact device 1*b*, and the other surge terminal 3*b*3 and hook portion 3*b*5 are inserted into the fifth linking hole 16 of the electromagnetic contact device 1*b*. And, the pair of surge terminals 3*b*2, 3*b*3 is passed through the surge terminal insertion path 17 while undergoing elastic deformation and come into close contact with the surge terminals 18, and the hook portion 3*a*4 engages with the opening periphery of the fourth linking hole 15 and the recess portion 3*b*6 surrounds the neck portion 2*m* of the reversible unit 2, and by this means electrical connection with the electromagnet 8 of the other electromagnetic contact device 1*b* is made, while spanning the reversible unit 2.

By this means, the pair of surge absorption units 3*a*, 3*b* absorbs surge voltages generated by the electromagnets 8 of the pair of electromagnetic contact devices 1*a*, 1*b*.

(Auxiliary Contact Point Units)

As shown in FIG. 1, the auxiliary contact point units 4*a*, 4*b* are apparatuses having auxiliary circuit terminals 25.

Figure 7:
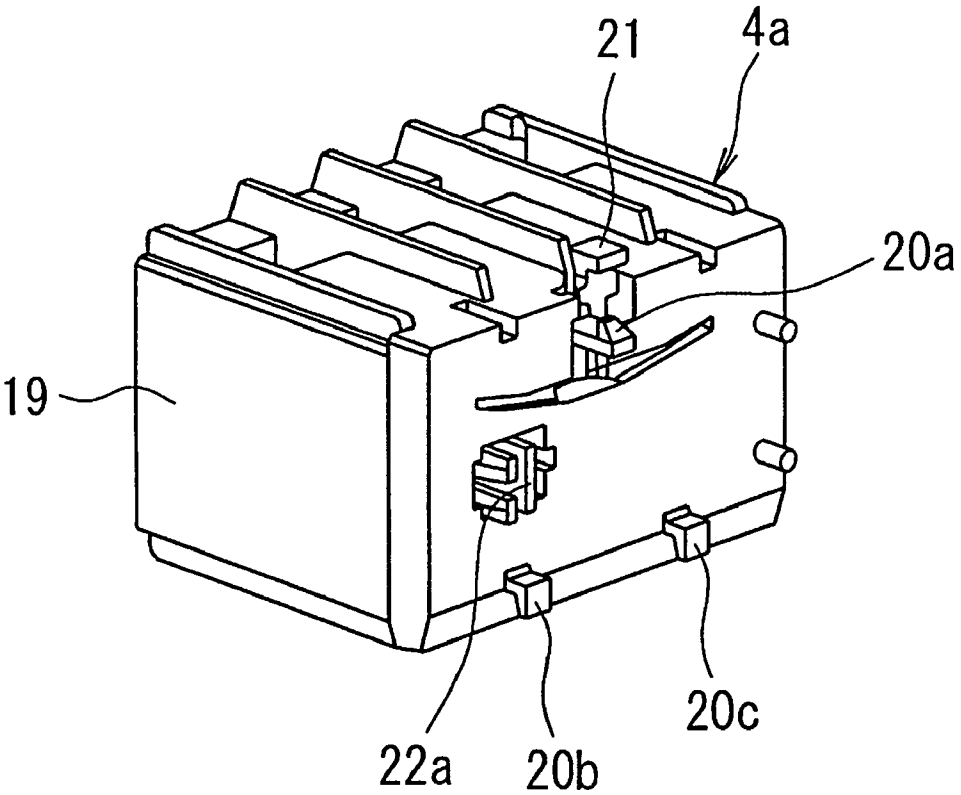
FIG. 7 is a perspective view showing a unit-side mounting portion of an auxiliary contact point unit.

As shown in FIG. 7, one of the auxiliary contact point units 4*a* has a contact point portion (not shown) within the body case 19, and in addition is provided with three hook portions 20*a*, 20*b*, 20*c* protruding in the same direction from one side of the body case 19.

Two of the hook portions 20*b*, 20*c* are formed integrally with the body case 19, and a structure is employed such that one hook portion 20*a*, at a distance from the hook portions 20*b* and 20*c*, can move in a direction to approach the two hook portions 20*b*, 20*c* by means of pressing manipulation of a hook-moving lever 21. When pressing manipulation of the hook-moving lever 21 is released, this hook portion 20*a* returns to the original position at a distance from the two hook portions 20*b*, 20*c* by means of the spring urging force of a spring member, not shown.

The contact point portion provided within the body case 19 has a movable contact point support 22 (see FIG. 4); a return spring (not shown) which acts with a spring urging force directed to one side of the movable contact point support 22; a plurality of movable contact points (not shown), each supported by contact point springs (acting with a spring urging force in the direction opposite the direction of action of the spring urging force of the return spring) so as to enable movement in the same direction as the movable contact point support 22; and a plurality of fixed contact points (not shown), supported by the body case 19 so as to oppose the plurality of movable contact points in the movement direction.

Figure 4:
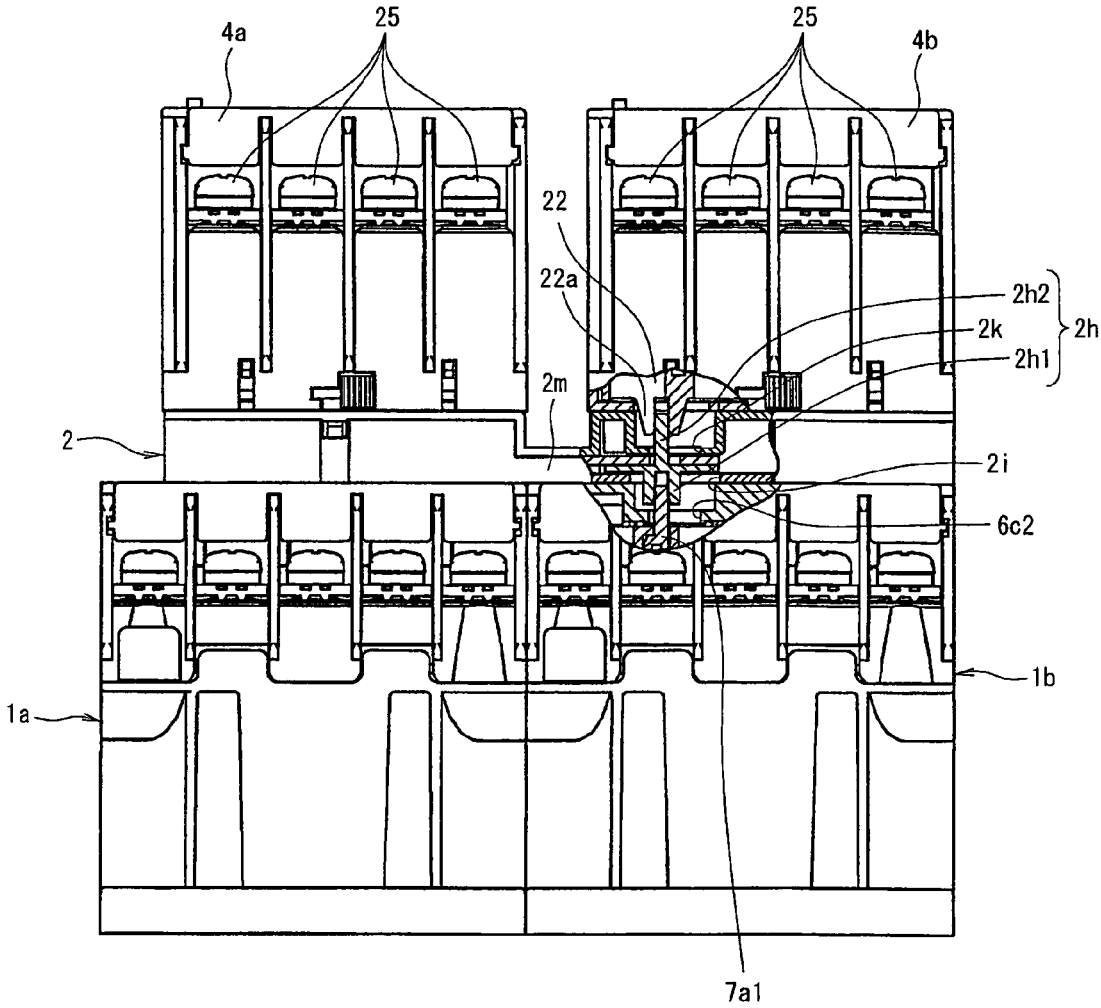
FIG. 4 shows a mounted state of an electromagnetic contact device, a reversible unit, and an auxiliary contact point unit.
Figure 9:
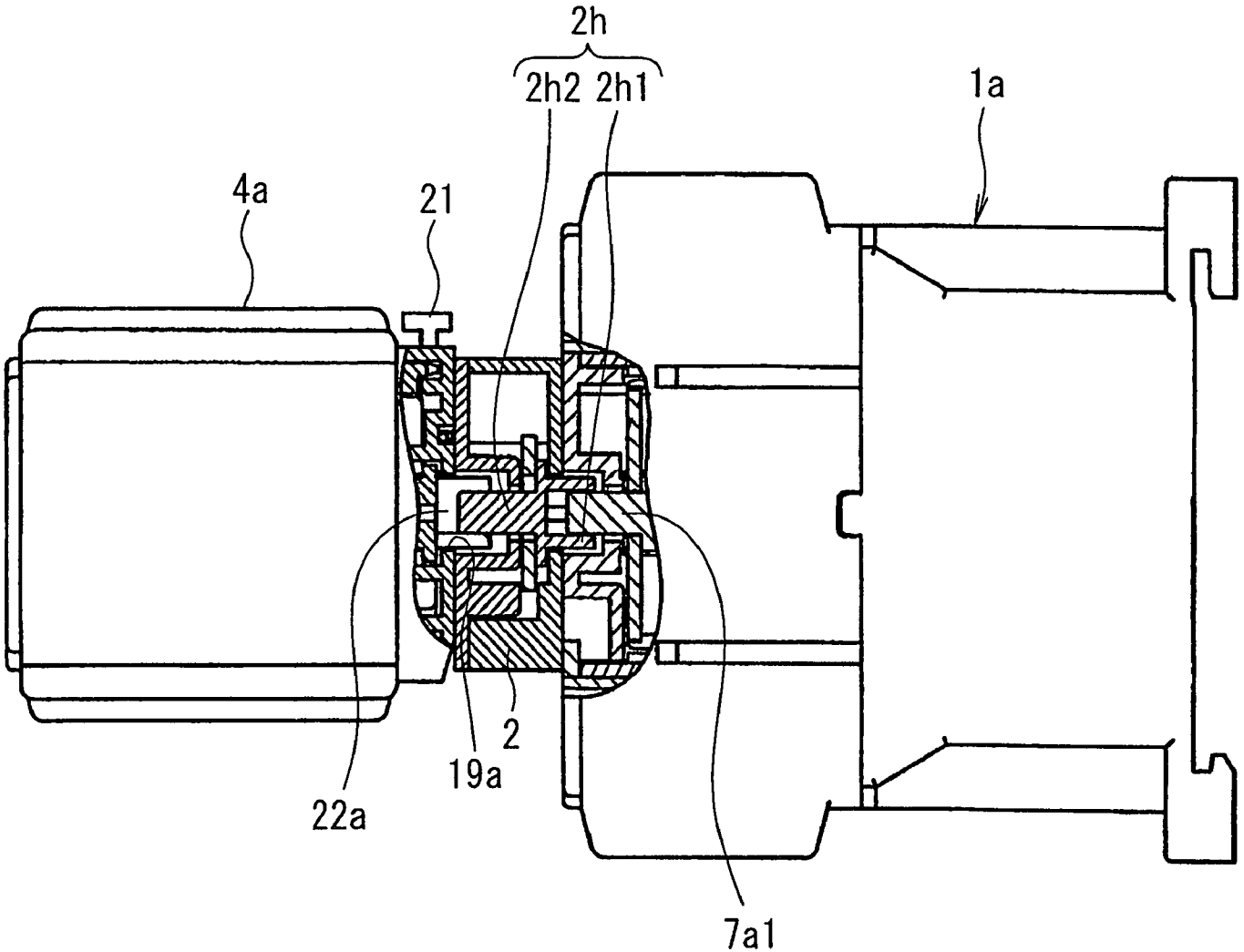
FIG. 9 shows a linked state of an operation indicator piece of an electromagnetic contact device, reversible unit operation indicator piece of a reversible unit, and auxiliary contact point unit operation indicator piece of an auxiliary contact point unit.

Here, as shown in FIG. 4 and FIG. 9, integrally formed with the movable contact point support 22 are an indicator piece engaging portion 22*a* protruding from the rectangular unit window 19*a* formed in one side of the body case 19, which encloses the reversible unit operation indicator pieces 2*g*2, 2*h*2 of the reversible unit 2, and, as shown in FIG. 2, an auxiliary contact point unit operation indicator piece 22*b* which protrudes from a rectangular unit window 19*b* formed in the side opposite the one side of the body case 19.

Figure 8:
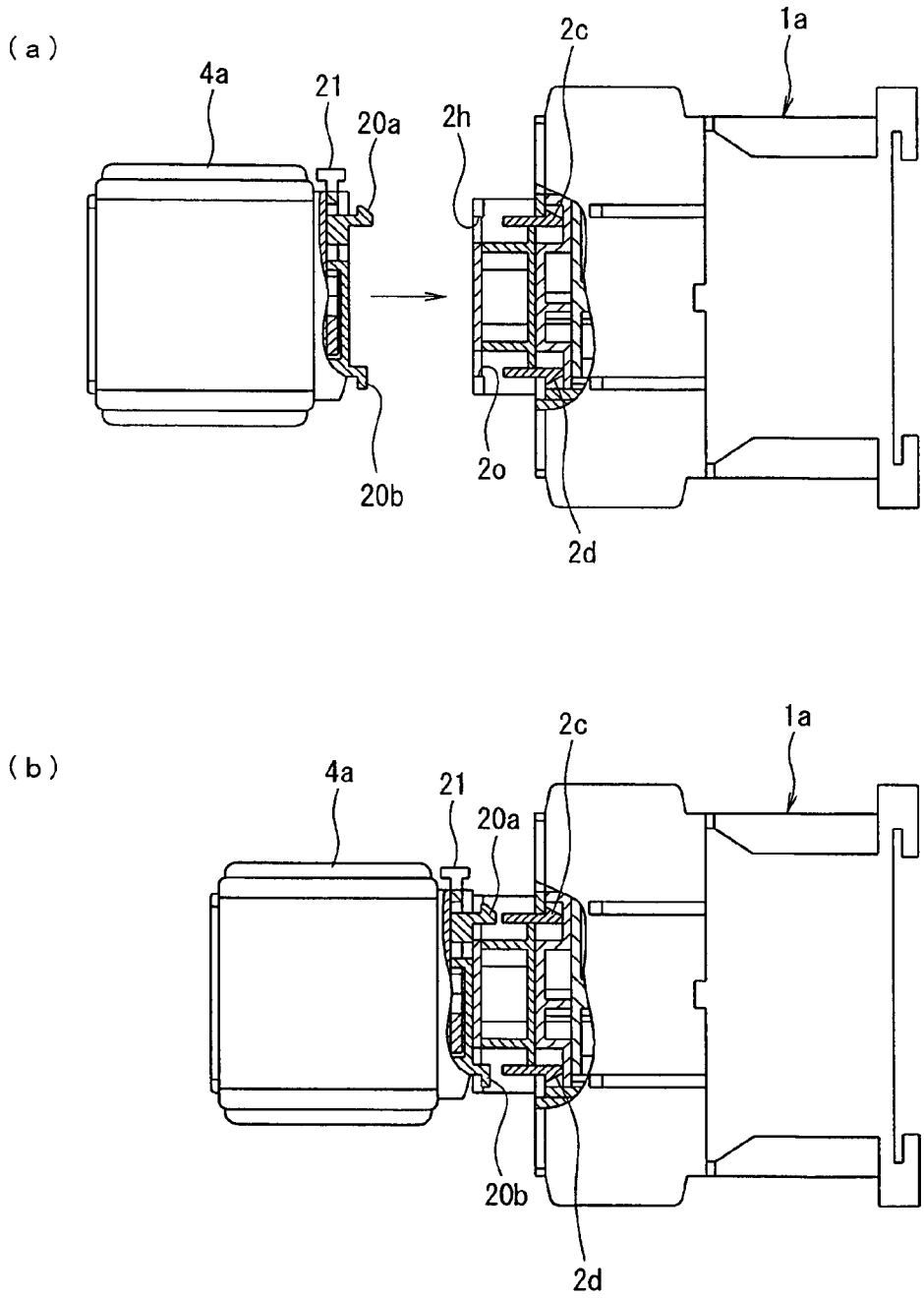
FIG. 8 shows a state in which an auxiliary contact point unit is mounted on a reversible unit.

And as shown in FIG. 8, the hook-moving lever 21 is pressed and manipulated to cause the hook portion 20*a* to approach the side of the hook portions 20*b* and 20*c*, these hook portions 20*a*, 20*b* and 20*c* are inserted into the sixth to eighth linking holes 2*n*, 2*o*, 2*p* of the reversible unit 2, and the indicator piece engaging portion 22*a* is mated into the reversible unit operation indicator piece 2*h*2 of the reversible post 2*h*; in addition, the pressing manipulation of the hook-moving lever 21 is released to engage the opening periphery of the sixth to eighth linking holes 2*n*, 2*o*, 2*p*, and by this means the auxiliary contact point unit 4*a* is mounted on the reversible unit 2.

Further, the other auxiliary contact point unit 4*a* has the same structure as the one auxiliary contact point unit 4*b*; the hook-moving lever 21 is pressed and manipulated to cause the hook portion 20*a* to approach the side of the hook portions 20*b* and 20*c*, these hook portions 20*a*, 20*b* and 20*c* are inserted into the ninth to eleventh linking holes 2*q*, 2*r*, 2*s* of the reversible unit 2, and the indicator piece engaging portion 22*a* is mated into the reversible unit operation indicator piece 2*g*2 of the reversible post 2*h*; in addition, the pressing manipulation of the hook-moving lever 21 is released to engage the opening periphery of the ninth to eleventh linking holes 2*q*, 2*r*, 2*s*, and by this means, the auxiliary contact point unit 4*b* is mounted on the reversible unit 2.

The case-side mounting portion of this invention corresponds to the first to fifth linking holes 12 to 16, and the unit-side mounting portion of this invention corresponds to the first to fourth hook portions 2*c* to 2*f* of the reversible unit 2, the hook portions 3*a*4, 3*a*5, 3*b*4, 3*b*5 of the surge absorption units 3*a* and 3*b*, and the hook portions 20*a*, 20*b*, 20*c* of the auxiliary contact point units 4*a* and 4*b*.

By means of an electromagnetic contact device with the above configuration, one reversible unit 2, two surge absorption units 3*a* and 3*b*, and two auxiliary contact point units 4*a* and 4*b* can be mounted on two electromagnetic contact devices 1*a*, 1*b* using a simple configuration, so that an electromagnetic contact apparatus which performs forward/reverse operation control of an induction motor can be provided in accordance with user demands.

Figure 10:
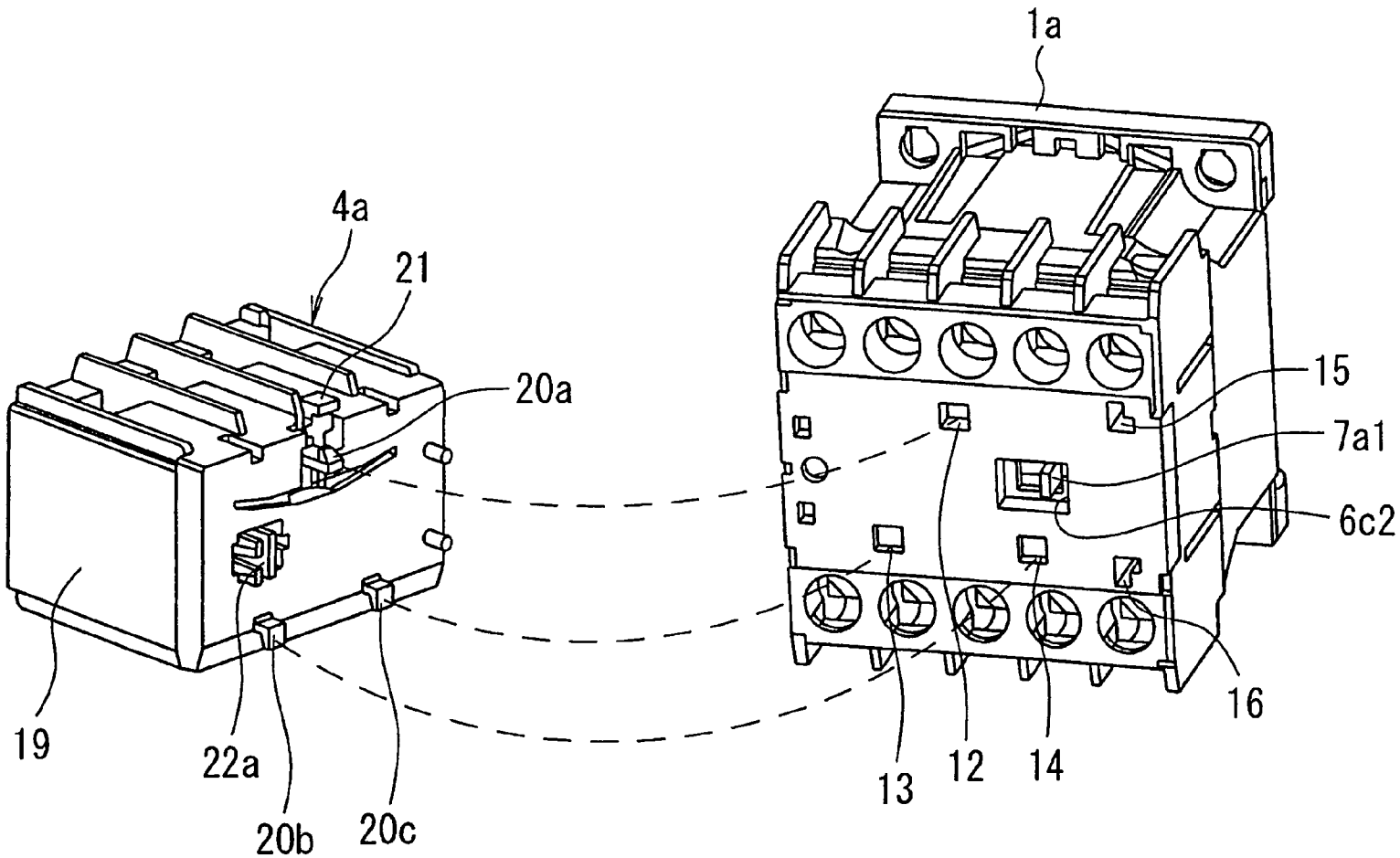
FIG. 10 shows the mounted state of an electromagnetic contact device and auxiliary contact point unit.

Here, as shown in FIG. 10, in this invention one auxiliary contact point unit 4*a* can be mounted on one electromagnetic contact device 1*a*.

In this case, the hook-moving lever 21 is pressed and manipulated to cause the hook portion 20*a* to approach the side of the hook portions 20*b* and 20*c*, these hook portions 20*a*, 20*b* and 20*c* are inserted into the first to third linking holes 12, 13, 14 of the electromagnetic contact device 1*a*, and the indicator piece engaging portion 22*a* is mated into the operation indicator piece 7*a*1 of the electromagnetic contact device 1*a*. And, pressing manipulation of the hook-moving lever 21 is released to cause engaging with the opening peripheries of the first to third linking holes 12, 13, 14, and by this means the subsidiary contact point unit 4*a* can be mounted on the electromagnetic contact device 1*a*.

Further, although not shown explicitly, the combinations shown in FIG. 11 of the electromagnetic contact devices 1*a* and 1*b*, reversible unit 2, surge absorption units 3*a* and 3*b*, and subsidiary contact point units 4*a* and 4*b* are conceivable.

Hence this invention can provide electromagnetic contact devices 1*a* and 1*b* in which are combined ancillary units in accordance with various user demands.

(Overall Structure of an Electromagnetic Contact Device)

Next, the overall configuration of the electromagnetic contact device 1*a* is explained, referring to FIG. 12 to FIG. 19. The other electromagnetic contact device 1*b* has the same configuration, so an explanation is omitted.

Figure 12:
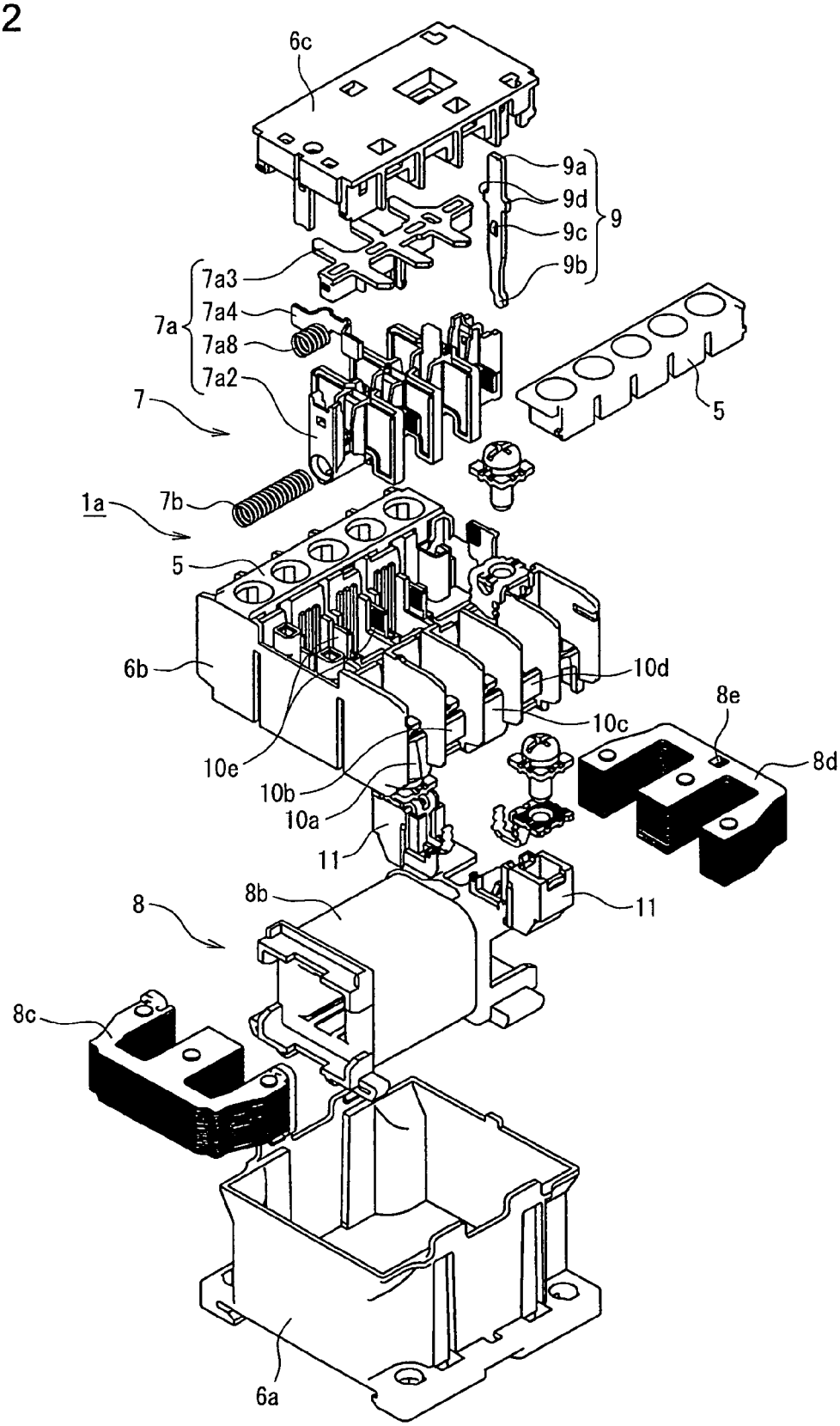
FIG. 12 is an exploded perspective view showing constituent members of an electromagnetic contact device of the invention.

As shown in FIG. 12, terminal portions 10*a* to 10*d*, each having contact points, are arranged in the upper case 6*b* formed of a synthetic resin material having insulating properties and forming the body case 6 of the electromagnetic contact device 1*a*; in addition, a coil terminal portion accommodating chamber 10*e*, which accommodates the coil terminal portion 11 of the electromagnet 8, is provided. Further, on the upper case 6*b* are mounted an arc-extinguishing cover 6*c* which accommodates a movable contact point support 7*a*, described below, in a sealed state, and a terminal cover 5 which covers the terminal portions 10*a* to 10*d* each having contact points and the coil terminal portion 11 of the electromagnet.

And, a movable contact point support 7*a* and return spring 7*b* constructing the contact point portion 7, are accommodated in the upper case 6*b*.

The movable contact point support 7*a* has a movable contact point support base 7*a*2, and a movable contact point support cover 7*a*3 adhered and joined to this movable contact point support base 7*a*2; on the movable contact point support base 7*a*2 are arranged a plurality of sets of movable contact points 7*a*4 combined with contact springs 7*a*8. And, contact point pieces 10*e* are provided on the terminal portions 10*a* to 10*d*, mounted on the upper case 6*b* and each having contact points; fixed contact points (not shown) provided on these contact point pieces 10*e* oppose each of the movable contact points 7*a*4.

Further, as shown in FIG. 12, an AC-operation type electromagnet 8 is accommodated within the lower case 6*a*. This electromagnet 8 has a coil frame 8*b* about which an excitation coil 8*a* (see FIG. 13) is wound; a fixed core 8*c* inserted into a hollow portion of this coil frame 8*b* and fixed to a side wall of the lower case 6*a*; a movable core 8*d* inserted into a hollow portion of the coil frame 8*b* and opposing this fixed core 8*c* so as to enable contact and separation; and, a pair of coil terminal portions 11, mutually separated and integrated, on one end of the coil frame 8*b* on which is arranged the movable core 8*d*. The pair of coil terminal portions 11 is arranged along the terminal portions 10*a* to 10*d* each having contact points mounted within the upper case 4.

Figure 13:
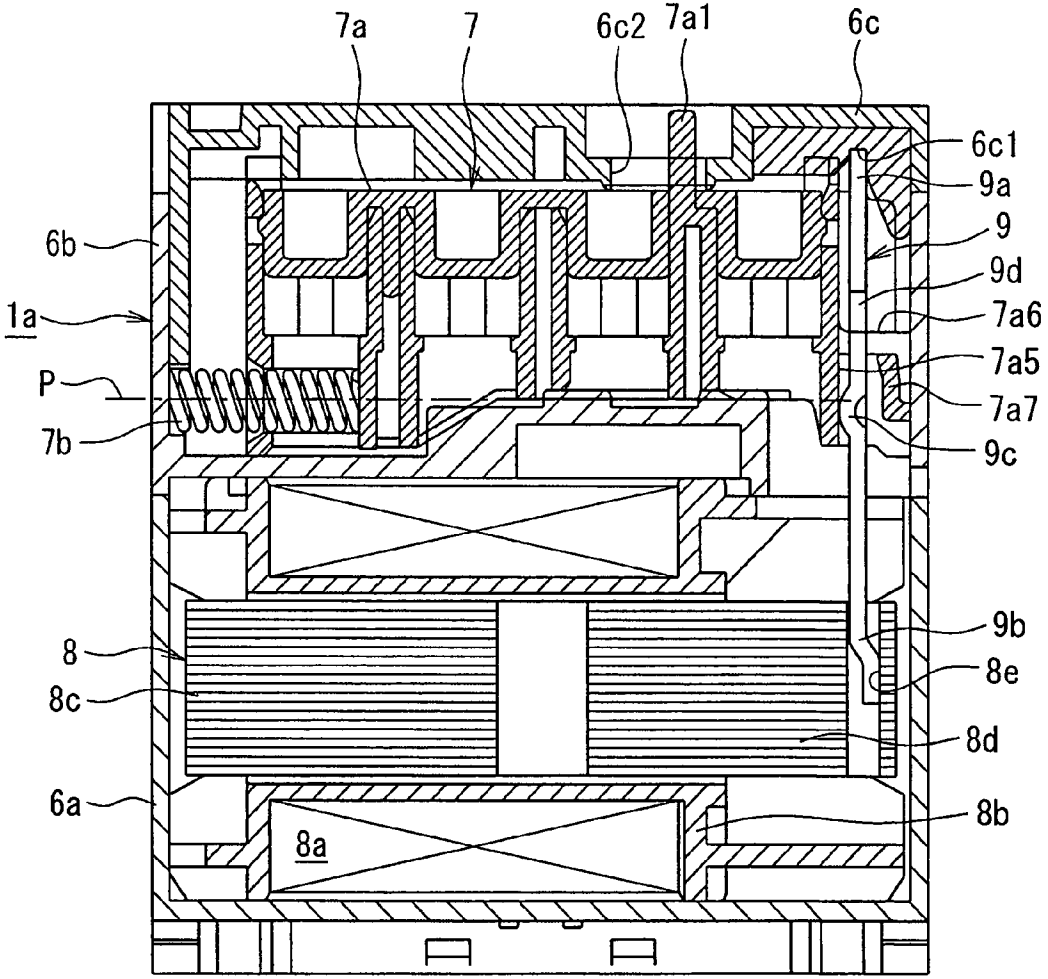
FIG. 13 is a cross-sectional view showing the initial state of an electromagnetic contact device.

As shown in FIG. 13, the movable contact point portion 7 accommodated within the upper case 6*b* and electromagnet 8 accommodated within the lower case 6*a* are arranged such that the direction of movement of open/close operation of the movable contact point support 7*a* and the direction of movement of the movable core 8*d* (attractive movement direction and release movement direction) are parallel, and in addition the return spring 7*b* is arranged so as to act with an urging force in the direction causing the movable contact point support 7*a* to return to the initial position.

Further, in order to transmit the attractive movement and release movement of the movable core 8*d* to the movable contact point support 7*a*, a driving lever 9, linked to one end of the movable contact point 7*a* separated from the return spring 7*b* and with the movable core 8*d*, is extended and accommodated between the lower case 6*a* and the upper case 6*b*, as shown in FIG. 13.

The driving lever 9 is a plate-shape member, and as shown in FIG. 12, one end in the length direction is a rotation support point portion, and a movable core linking portion 9*b* is formed on the other end in the length direction; in the center of the length direction is provided a movable contact point support linking portion 9*c*, and a pair of supported portions 9*d* is formed at a position closer to the side of the rotation support point portion 9*a* than the movable contact point support linking portion 9*c*.

Figure 17:
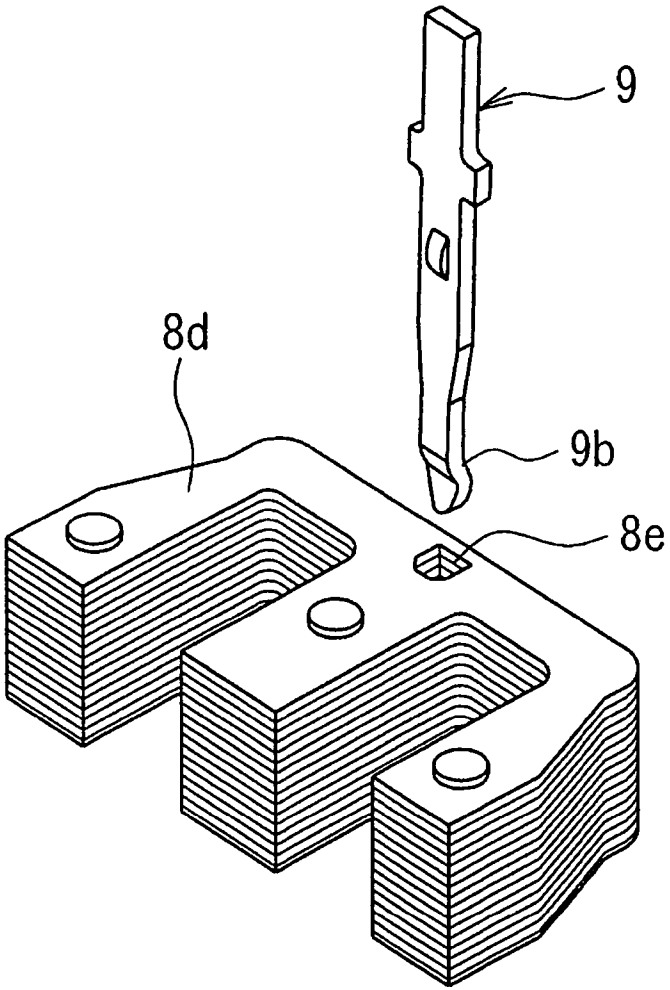
FIG. 17 is a perspective view showing the linking structure between a movable core configuring an electromagnetic contact device and a driving lever.

As shown in FIG. 17, the movable core linking portion 9*b* of the driving lever 9 is inserted from above into and linked to a linking hole 8*e* formed in the movable core 8*d*.

Figure 18:
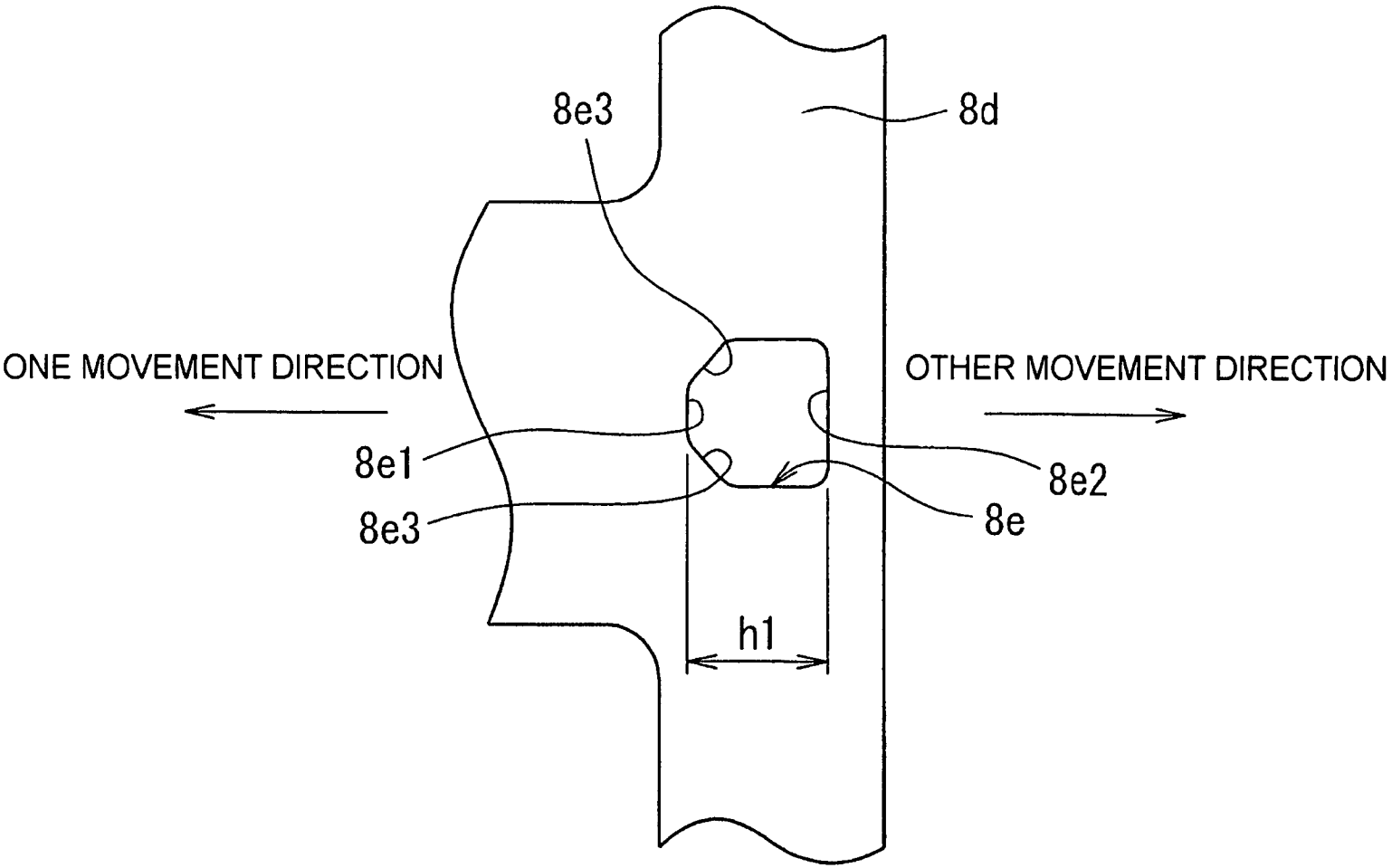
FIG. 18 shows the structure of a movable core engaging hole provided in a movable core configuring an electromagnetic contact device.

Viewing the movable core 8*d* from above as shown in FIG. 18, the linking hole 8*e* is formed as a hexagonal hole in which a first inner face 8*e*1 provided in one movement direction of the movable core 8*d* has an inside width (width perpendicular to the movement direction) smaller than a second inner face 8*e*2 provided in the other movement direction of the movable core 8*d*, and with an inclined face 8*e*3 continuous from the first inner face 8*e*1 and inclined on the side of the second inner face 8*e*2 provided.

Figure 19:
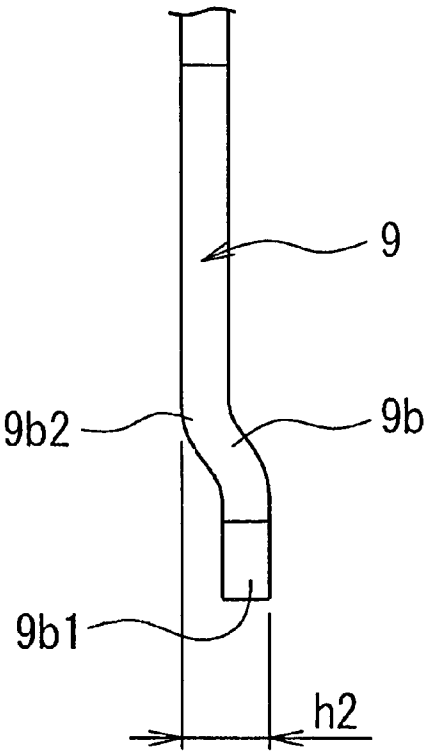
FIG. 19 shows the shape of the other end of a driving lever configuring an electromagnetic contact device.
Figure 19:
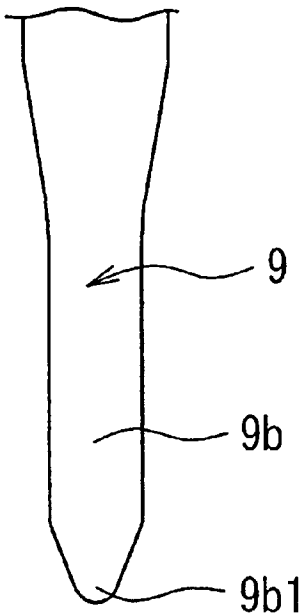

As shown in FIG. 19, the movable core linking portion 9*b* has a narrow tip portion 9*b*1 formed by gradually narrowing the plate width, and by providing a bent portion 9*b*2, the width h2 to the tip portion 9*b*1 is set to a slightly smaller value than the hole width h1 (see FIG. 18) between the first inner face 8*e*1 and the second inner face 8*e*2 of the linking hole 8*e*.

A bulging portion is provided in the movable contact point support linking portion 9*c* of the driving lever 9, and as shown in FIG. 13, the driving lever 9 passes through a lever linking hole 7*a*5 which vertically penetrates one side of the movable contact point support 7*a*. Here, a lever engaging wall 7*a*7 which can abut the movable contact point support linking portion 9*c* is provided on the right side of the lever linking hole 7*a*5 in FIG. 13.

The pair of supported portions 9*d* of the driving lever 9 protrudes outward from the plate width direction, and as shown in FIG. 13, when the movable contact point support linking portion 9*c* passes through the lever linking hole 7*a*5 of the movable contact point support 7*a*, rotatably abut the upper-end face 7*a*6 of the movable contact point support 7*a*.

The rotation support point portion 9*a* of the driving lever 9 is placed in a support point recess 6*c*1 provided in the bottom face of the arc-extinguishing cover 6*c* and rotatably linked. And, when the arc-extinguishing cover 6*c* is mounted on the upper case 6*b*, the support point recess 6*c*1 holds the rotation support point portion 9*a* of the driving lever 9, and in addition presses the pair of supported portions 9*d* against the upper-end face 7*a*6 of the movable contact point support 7*a*.

In this way, with the rotation support point portion 9*a* rotatably linked to the support point recess 6*c*1 of the arc-extinguishing cover 6*c*, and with the movable core linking portion 9*b* linked to the linking hole 8*e* of the movable core 8*d*, movement of the movable core 8*d* is accompanied by rotation of the driving lever 9 with the rotation support point portion 9*a* as a rotation support point, and rotation of this driving lever 9 is transmitted to the movable contact point support 7*a* via the movable contact point support linking portion 9*c* and the lever linking hole 7*a*5.

Here, the movable contact point support linking portion 9*c* of the driving lever 9 which is linked to the lever linking hole 7*a*5 of the movable contact point support 7*a* is positioned on the line of action of the return spring 7*b* (the line extending the axial line P), as shown in FIG. 13.

Next, operation of the electromagnetic contact device 1*a* is explained, referring to FIG. 13 to FIG. 16.

When in an electromagnetic contact device 1 of this embodiment the excitation coil 8*a* of the electromagnet 8 is in the non-excited state, then as shown in FIG. 13 an attractive force does not act between the fixed core 8*c* and the movable core 8*d*, and the movable contact point support 7*a* is moved to the right in FIG. 13 (hereafter called the initial position of the movable contact point support 7*a*) by the urging force of the return spring 7*b*. At this time, the movable contact points 7*a*4 of the a contact points of the movable contact point support 7*a* are separated from the fixed contact points, and the movable contact points 7*a*4 of the "b" contact points are in contact with the fixed contact points.

Figure 14:
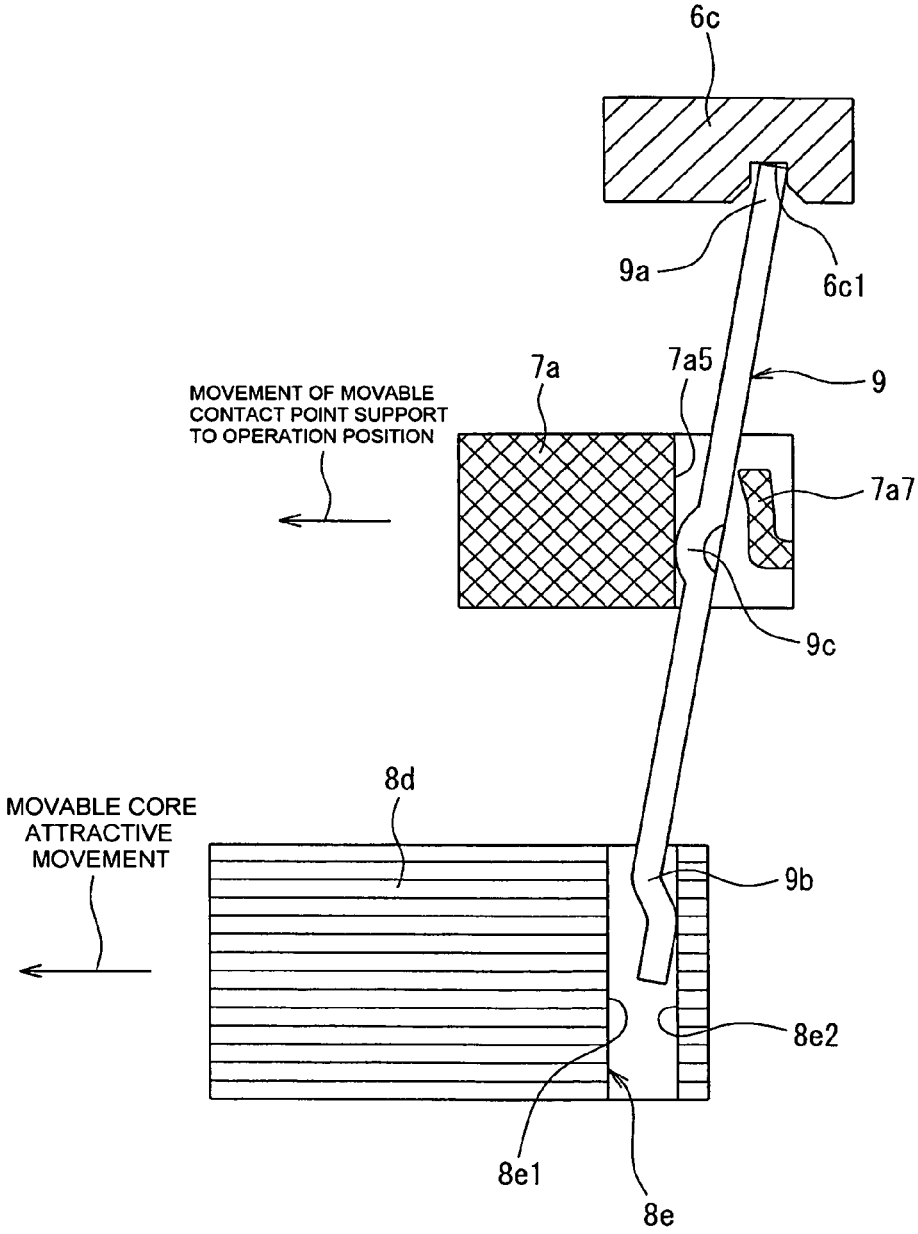
FIG. 14 is a simplified diagram showing a state of driving lever rotation and the movement of a movable contact point support to an operation position when the movable core of an electromagnetic contact device performs attractive movement.

Next, when the excitation coil 8*a* of the electromagnet 8 enters the excited state, an attractive force acts between the fixed core 8*c* and the movable core 8*d*, and the movable core 8*d* undergoes attractive movement toward the fixed core 8*c*. As shown in FIG. 14, when the movable core 8*d* undergoes attractive movement on the left side in the figure, the movable core linking portion 9*b* abuts the second inner face 8*e*2 of the linking hole 8*e*, and by this means the driving lever 9 undergoes rotation in the clockwise direction with the rotation support point portion 9*a*, engaged with the right-side wall portion of the support point recess 6*c*1, as a rotation support point; the movable contact point support 7*a*, pressed by the movable contact point support linking portion 9*c*, moves in the operation direction against the return spring 7*b*. When the movable contact point support 7*a* moves to the operation position, the movable contact points 7*a*4 of the a contact points of the movable contact point support 7*a* contact with the fixed contact points, and the movable contact points 7*a*4 of the b contact points are separated from the fixed contact points.

Figure 15:
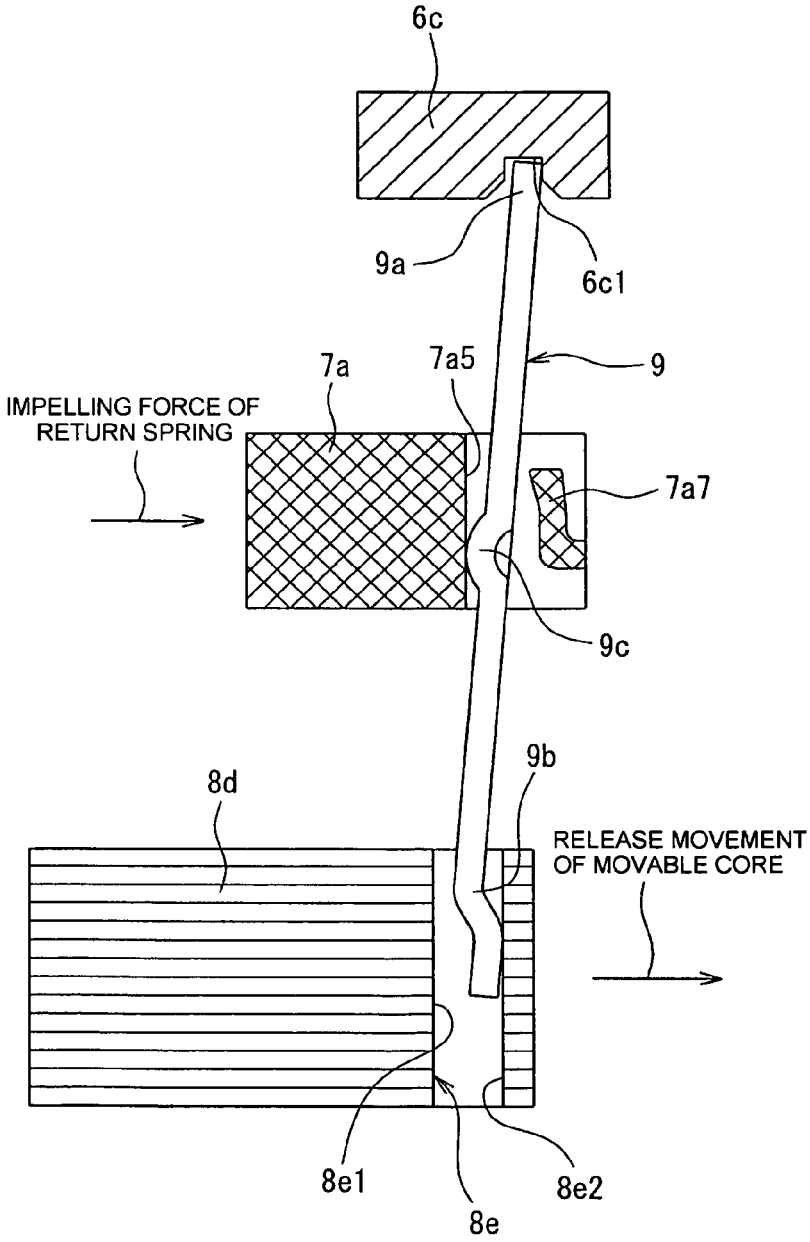
FIG. 15 is a simplified diagram showing driving lever rotation and movable core release movement when the movable contact point support of an electromagnetic contact device moves to an initial position due to the urging force of a return spring.

Next, when from the operation position of the movable contact point support 7*a* the excitation coil 8*a* of the electromagnet 8 is put into the non-excited state, the movable contact point support 7*a*, acted on by the urging force of the return spring 7*b*, moves to the initial position as shown in FIG. 15. Further, an external force is transmitted to the movable core 8*d* of the electromagnet 8 via the driving lever 9 from the movable contact point support 7*a* which moves under the urging force of the return spring 7*b*, and due to rotation in the counterclockwise direction of the driving lever 9, the movable core 8*d* undergoes release movement in the direction of separation from the fixed core 8*c*.

If, due to the flow of excessive current, slight adhesion occurs between the movable contact points 7*a*4 of the a contact points of the movable contact point support 7*a* positioned in the operation position and the fixed contact points, then the movable contact point support 7*a*, which has moved to the initial position due to action of the urging force of the return spring 7*b*, stops during release.

Figure 16:
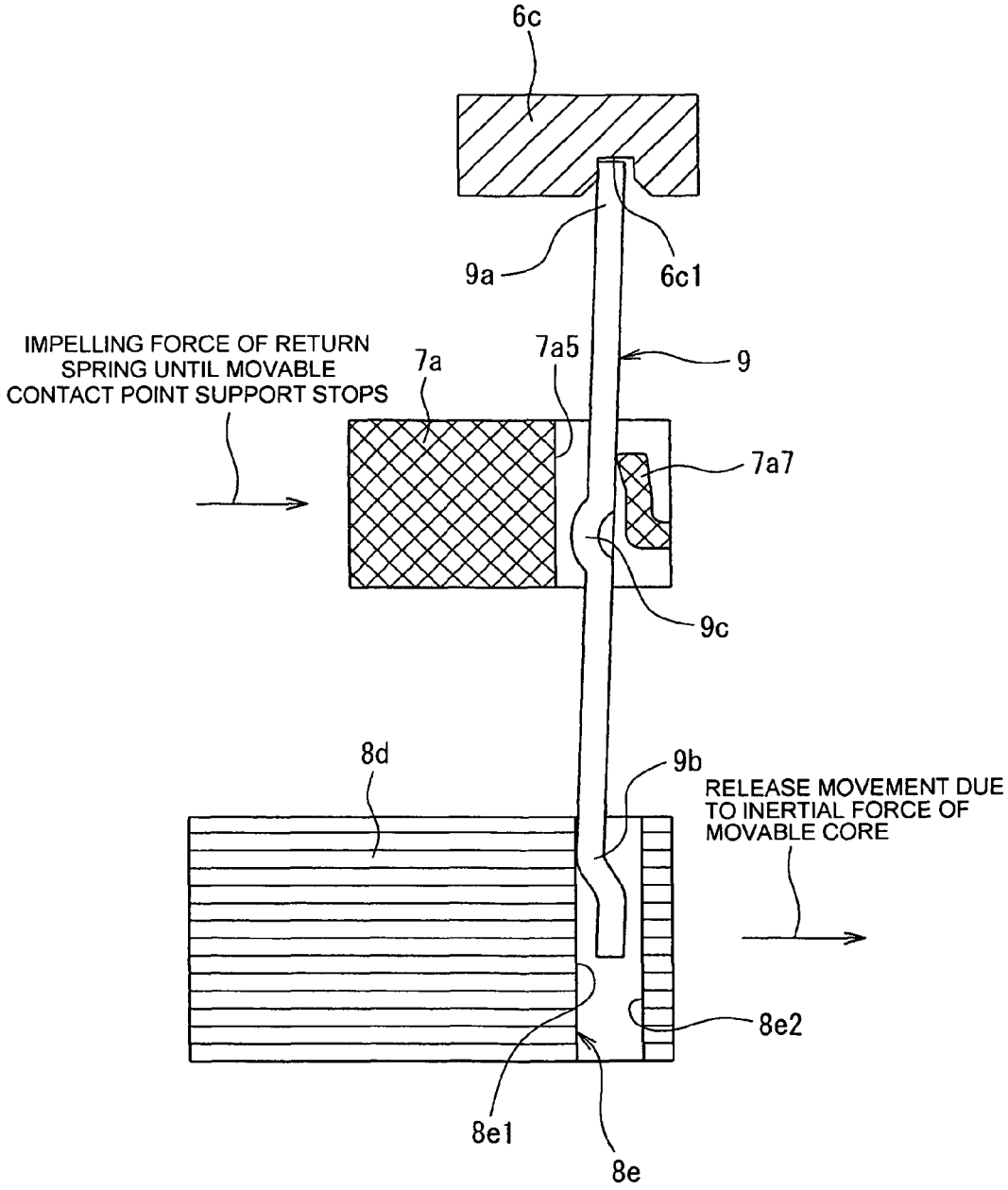
FIG. 16 is a simplified diagram showing a state of driving lever rotation and movement of a movable contact point support to an initial position when the movable core of an electromagnetic contact device performs release movement due to an inertial force.

The urging force of the return spring 7*b* up to where the movable contact point support 7*a* stops is transmitted to the movable core 8*d* via the driving lever 9, so that the movable core 8*d* moves due to inertia in the direction of separation from the fixed core 8*c*, and release movement occurs due to the movement force of this inertia (inertial force). In this way, when the movable core 8*d* undergoes release movement due to inertial force, as shown in FIG. 16, the movable core linking portion 9*b* of the driving lever 9 abuts the first inner face 8*e*1 of the linking hole 8*e* of the movable core 8*d*, and the driving lever 9 rotates in the counterclockwise direction with the rotation support point portion 9*a*, engaged with the wall on the left side of the support point recess 6*c*1, as a rotation support point. And, due to the abutting of the lever engaging wall 7*a*7 of the movable contact point support 7*a* on a portion of the driving lever 9 rotating in the counterclockwise direction, an external force toward the initial position is transmitted to the movable contact point support 7*a*. In this way, when an external force is transmitted causing the movable contact point support 7*a* to move toward the initial position, the movable contact points 7*a*4 of the a contact points and the fixed contact points, between which slight adhesion occurs, are pulled apart, and through the action of the urging force of the return spring 7*b*, the movable contact point support 7*a* moves to the initial position.

As shown in FIG. 13, in this electromagnetic contact device 1*a*, the rotation support point portion 9*a* provided on one end of the driving lever 9 linked to the movable core 8*d* and movable contact point support 7*a* is rotatably linked to the support point recess 6*c*1 provided in the lower face of the arc-extinguishing cover 6*c*, in a rotatable structure with the rotation support point 9*a* as a rotation support point, and a pin or other rotation support member fixed to the case as in a structure of the prior art is made unnecessary, so that the number of components necessary for assembly of the driving lever 9 can be reduced.

Further, when an excessive current flows and there is slight adhesion between the movable contact points 7*a*4 of the "a" contact points of the movable contact point support 7*a* positioned at the operation position and the fixed contact points, the urging force of the return spring 7*b* up until stopping of the movable contact point support 7*a* midway during release is transmitted via the driving lever 9, and the movable core 8*d* thereby moves inertially in the direction of separation from the fixed core 8*c* as shown in FIG. 16, and release movement occurs due to this inertial force of inertia, so that the driving lever 9 rotates in the counterclockwise direction with the rotation support point portion 9*a* as a rotation support point, and an external force toward the initial position is transmitted to the movable contact point support 7*a*. In this way, through release movement by inertial force of the movable core 8*d*, an external force toward the initial position is transmitted to the movable contact point support 7*a*, and movable contact points 7*a*4 of a contact points and fixed contact points, which are in slight adhesion, are immediately pulled apart, so that slight contact point adhesion can be eliminated in normal operation of the electromagnetic contact device.

Further, as shown in FIG. 13, the movable contact point support linking portion 9*c* of the driving lever 9 linked to the lever linking hole 7*a*5 of the movable contact point support 7*a* is positioned on the line of action (line extending the axial line P) of the return spring 7*b*, so that no moment acts on the movable contact point support 7*a* to which force is transmitted from the action points of the return spring 7*b* and driving lever 9, sliding friction of the movable contact point support 7*a* with the inside of the upper case 6*b* can be reduced, and the durability of the movable contact point support 7*a* can be improved.

Further, as shown in FIG. 18, an inclined face 8*e*3 is provided in the linking hole 8*e* of the movable core 8*d* on the side in one movement direction, and as shown in FIG. 16, when the movable core 8*d* undergoes release movement due to inertial force, the movable core linking portion 9*b* comes into contact with the inclined face 8*e*3 before the first inner face 8*e*1, so that movement responsiveness of the movable contact point support 7*a* when the movable ore 8*d* undergoes release movement due to inertial force can be improved.

Further, as shown in FIG. 19(*b*), the movable core linking portion 9*b* of the driving lever 9 has a narrow tip portion 9*b*1, so that operation to insert the movable core linking portion 9*b* toward the linking hole 8*e* of the movable core 8*d* can easily be performed.

Further, as shown in FIG. 18 and FIG. 19(*a*), in the movable core linking portion 9*b* of the driving lever 9, the width h2 from the bent portion 9*b*2 to the tip portion 9*b*1 is set to a value slightly smaller than the hole width h1 between the first inner face 8*e*1 and the second inner face 8*e*2 of the linking hole 8*e* of the movable core 8*d*, and when the movable core 8*d* moves in the attraction direction and the release direction, rotation operation of the driving lever 9 is immediately transmitted from the first inner face 8*e*1 or the second inner face 8*e*2 via the movable core linking portion 9*b*, so that movement responsiveness of the movable contact point support 7*a* can be improved.

Further, as shown in FIG. 13, the support point recess 6*c*1 formed in the arc-extinguishing cover 6*c* envelops and supports the rotation support point portion 9*a* which is one end of the driving lever 9, so that the rotation support point portion 9*a* can be axially supported by a simple structure.

(Structure to Prevent Erroneous Mounting of a Reversible Unit on the Electromagnetic Contact Device)

Next, another embodiment which prevents erroneous mounting of a reversible unit 2 on two adjacently arranged electromagnetic contact devices 1*a*, 1*b* is explained, referring to FIG. 20 to FIG. 29.

Figure 20:
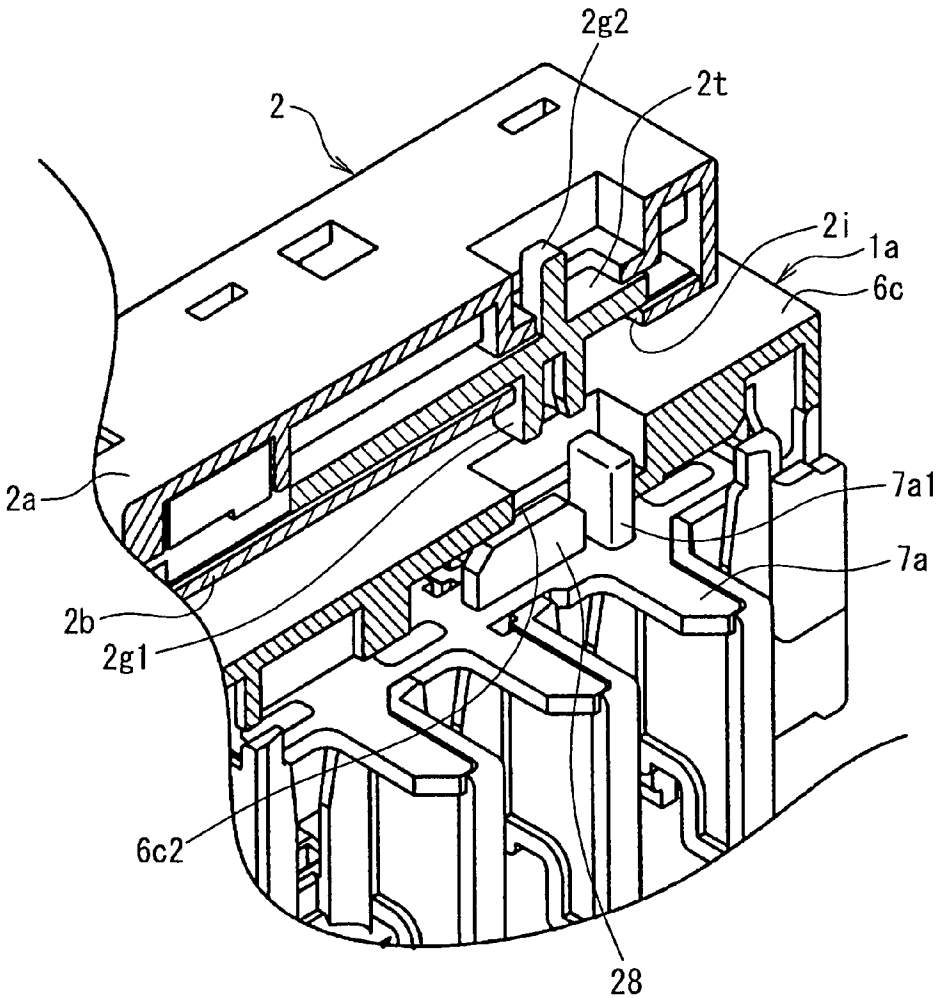
FIG. 20 is a perspective view showing the principal portions of an electromagnetic contact apparatus of the invention.
Figure 21:
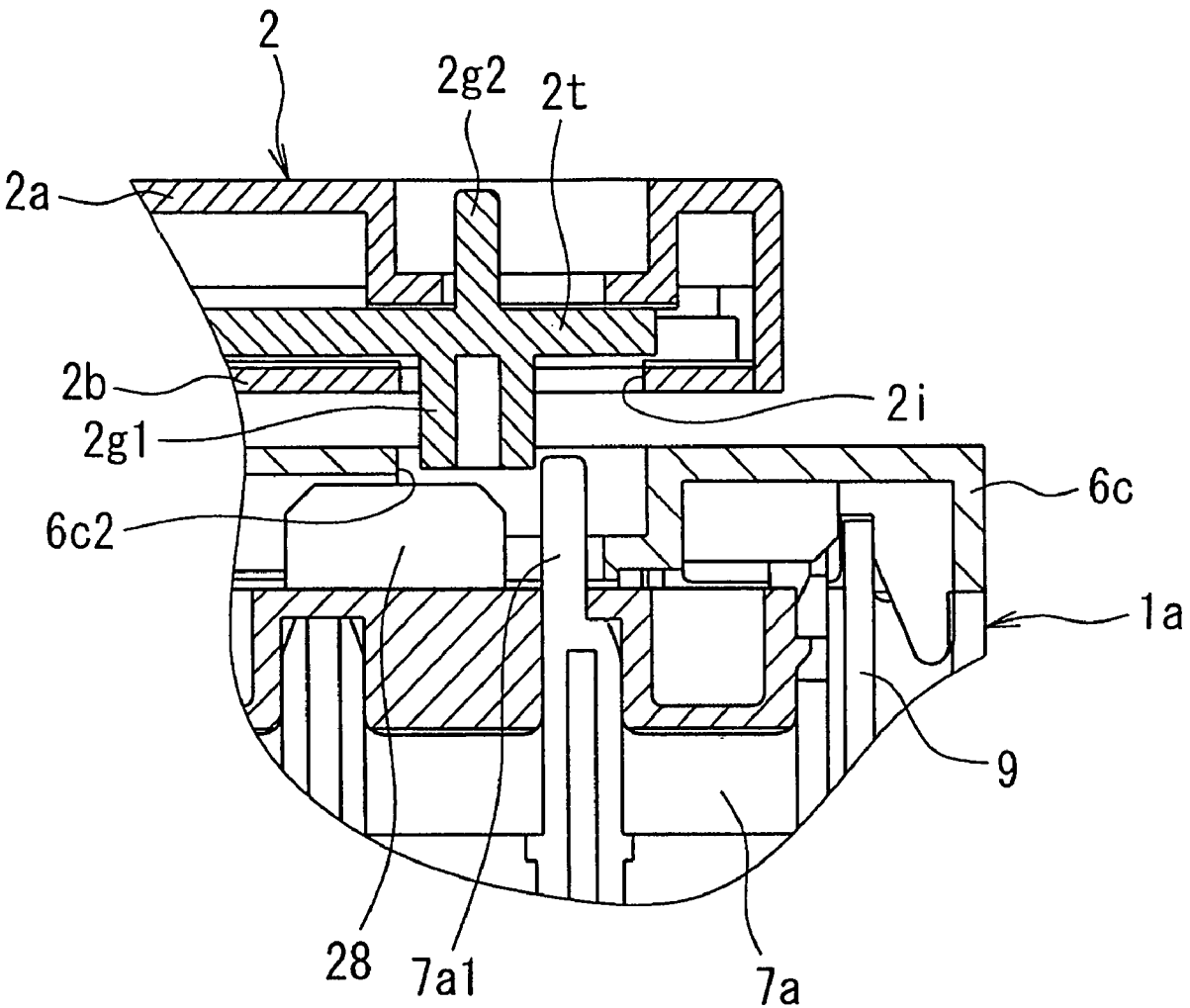
FIG. 21 shows a state in which a linking post of the reversible unit in a first embodiment of an electromagnetic contact apparatus is not held in a normal position.
Figure 22:
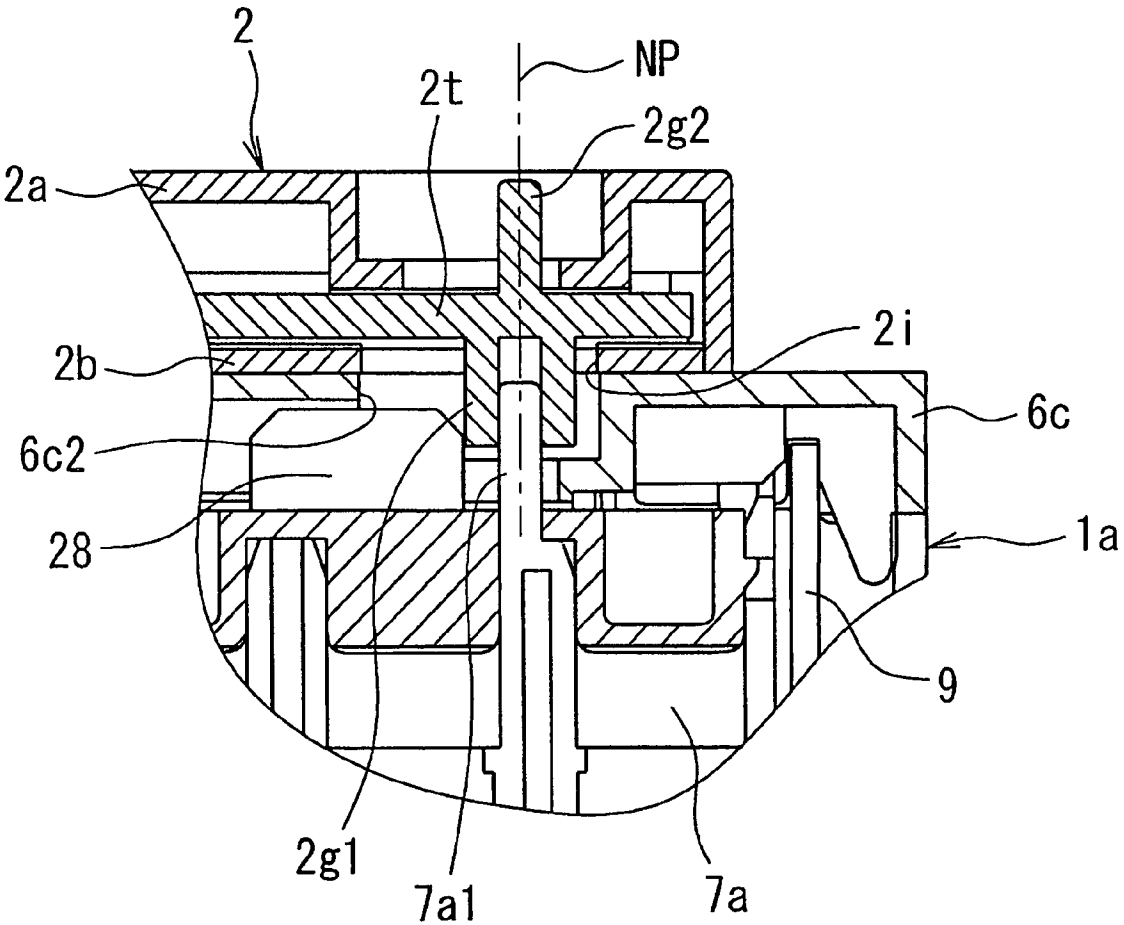
FIG. 22 shows a state in which a linking post of the reversible unit in the first embodiment is held in a normal position, and is linked to an operation indicator piece.

FIG. 20 to FIG. 22 show the structure of a first embodiment to prevent erroneous mounting of a reversible unit 2.

As shown in FIG. 20, in the unit body 2*a* of the reversible unit 2 is accommodated a pair of lock plates 2*t* which form a lock mechanism, and on one of the lock plates 2*t* and protruding therefrom are formed an indicator piece engaging portion 2*g*1 and a reversible unit operation indicator piece 2*g*2.

Further, an advance restriction portion 28 is formed on a movable contact point support 7*a* of this embodiment, at a position in proximity to the operation indicator piece 7*a*1 and protruding toward an indicator window 6*c*2.

This advance restriction portion 28 is a member, which when the cylindrical indicator piece engaging portion 2*g*1 of the reversible unit 2 is positioned at the normal position NP enabling mating with the operation indicator piece 7*a*1, allows the advance of the indicator piece engaging portion 2*g*1 into the indicator window 6*c*2, as shown in FIG. 22, and, which when an attempt is made by the indicator piece engaging portion 2*g*1 to advance into the indicator window 6*c*2 from a position deviating from the normal position NP, abuts the tip of the indicator piece engaging portion 2*g*1 and inhibits advance into the indicator window 6*c*2, as shown in FIG. 21.

Further, although not shown, an advance restriction portion 28 protruding toward the indicator window 6*c*2 is also formed on the movable contact point support 7*a* of the other electromagnetic contact device 1*b*, at a position in proximity to the operation indicator piece 7*a*1. This advance restriction portion 28, when the indicator piece engaging portion 2*h*1 of the reversible unit 2 is positioned at the normal position NP enabling mating with the operation indicator piece 7*a*1, allows the advance of the indicator piece engaging portion 2*h*1 into the indicator window 6*c*2, as shown in FIG. 22, and, when an attempt is made by the indicator piece engaging portion 2*h*1 to advance into the indicator window 6*c*2 from a position deviating from the normal position NP, abuts the tip of the indicator piece engaging portion 2*h*1 and inhibits advance into the indicator window 6*c*2.

By means of the above configuration, when the indicator piece engaging portion 2*g*1 protruding from the unit window 2*i* of the reversible unit 2 is not positioned at the normal position NP enabling linking with the operation indicator piece 7*a*1 of the movable contact point support 7*a*, as shown in FIG. 21, the advance restriction portion 28 provided at a position in proximity to the operation indicator piece 7*a*1 inhibits the advance of the indicator piece engaging portion 2*g*1 to the indicator window 6*c*2, so that the reversible unit 2 cannot be mounted on the electromagnetic contact device 1*a*. On the other hand, as shown in FIG. 22, when the indicator piece engaging portion 2*g*1 of the reversible unit 2 is positioned at the normal position NP, the indicator piece engaging portion 2*g*1 is not inhibited by the advance restriction portion 28, and so advances to the indicator window 6*c*2 and is linked in a mating state with the operation indicator piece 7*a*1, and the first abutting face 2*b* abuts the arc-extinguishing cover 6*c* so that mounting on the electromagnetic contact device 1*a* is possible.

Further, by a similar operation in the other electromagnetic contact device 1*b*, a state enabling linking of the indicator piece engaging portion 2*h*1 protruding from the unit window 2*i* of the reversible unit 2 with the operation indicator piece 7*a*1, or a state preventing linking, results.

By this means, when in this embodiment the indicator piece engaging portions 2*h*1, 2*g*1 of the reversible unit 2 are not held at the initial positions, the advance restriction portion 28 formed on the movable contact point support 7*a* inhibits the indicator piece engaging portions 2*h*1, 2*g*1 from advancing to the indicator window 6*c*2 from positions other than the normal position NP, so that a state in which the indicator piece engaging portions 2*h*1, 2*g*1 are not correctly linked to the operation indicator piece 7*a*1 can be reliably prevented, and erroneous mounting of the reversible unit 2 is prevented, so that forward/reverse operation control of an induction motor can be performed with enhanced safety.

Figure 23:
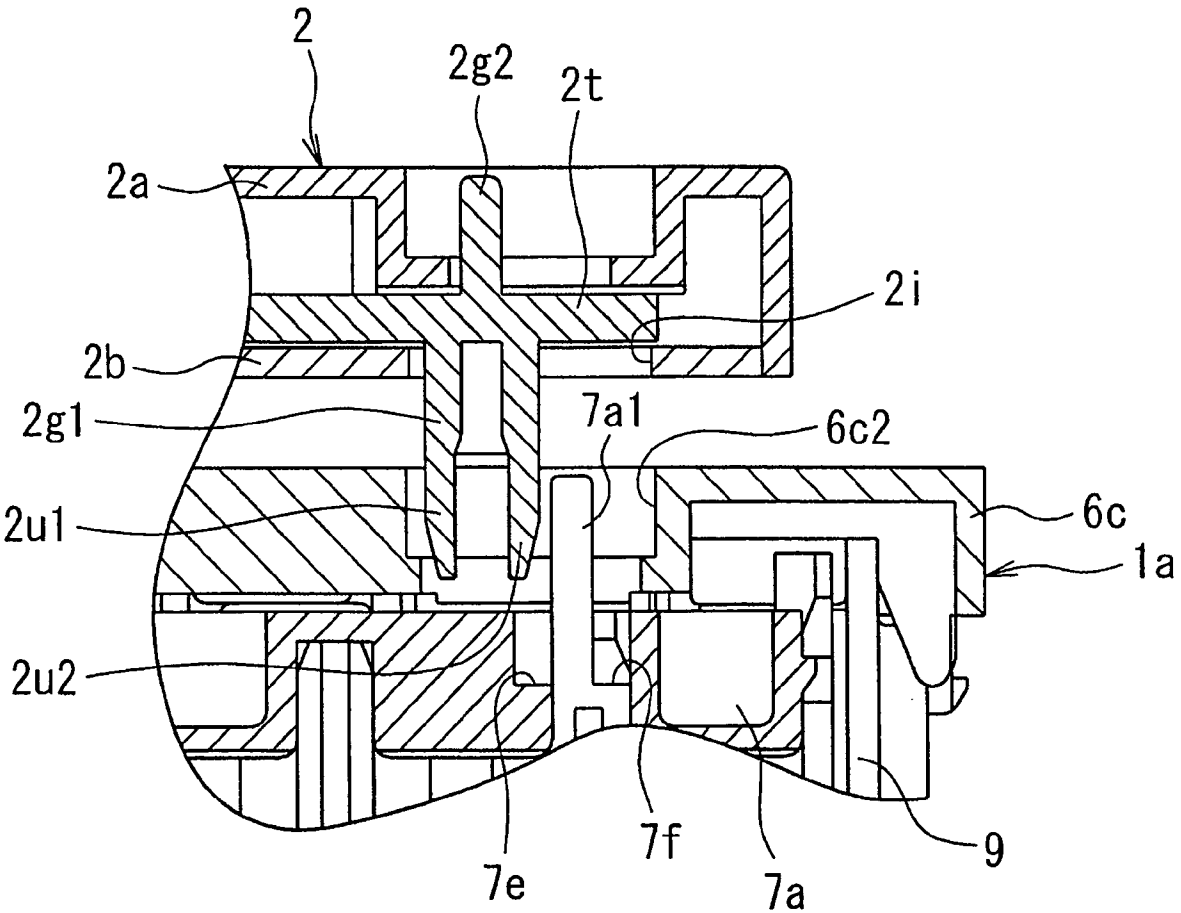
FIG. 23 shows a state in which a linking post of a reversible unit in a second embodiment is not held in a normal position.
Figure 24:
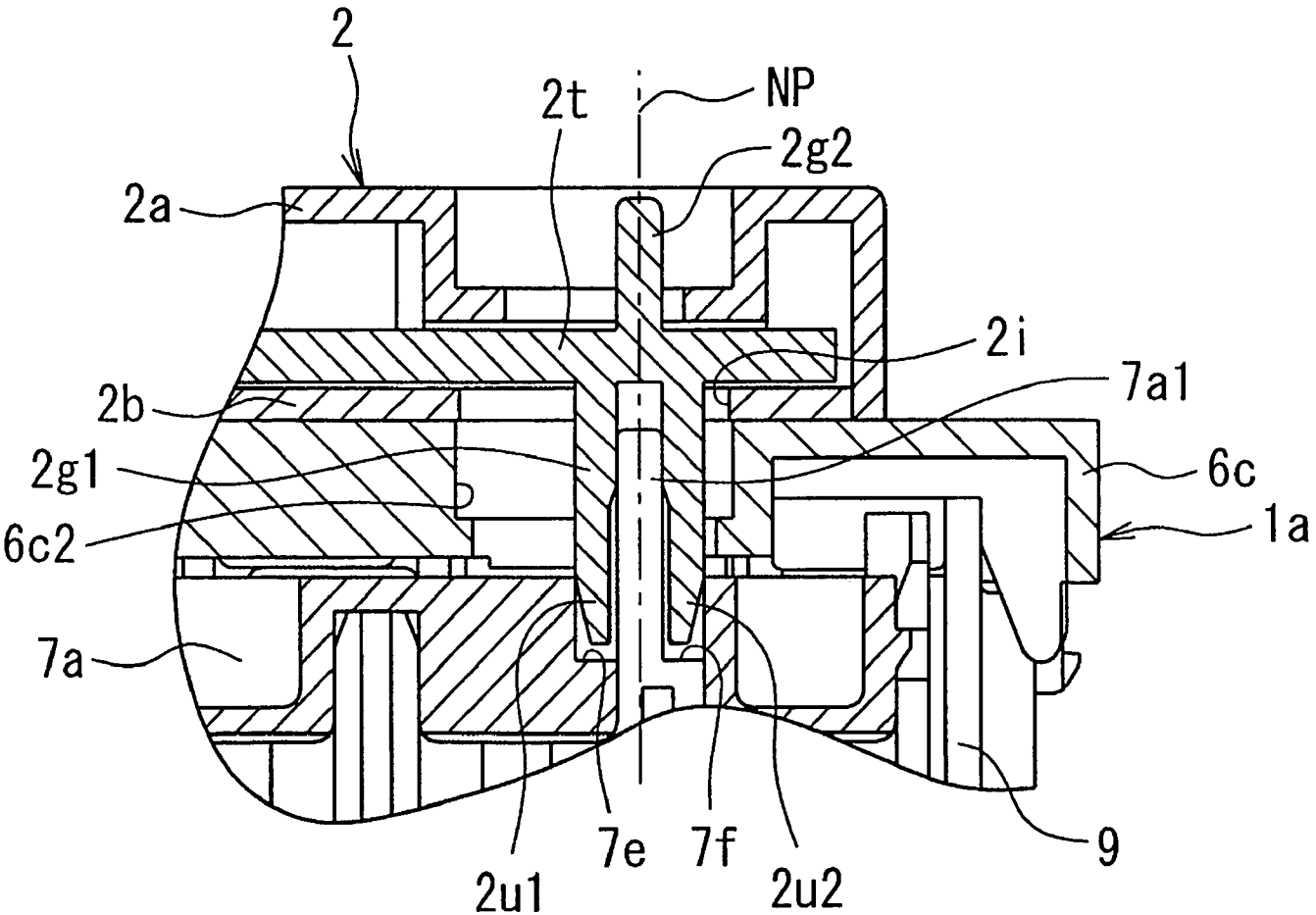
FIG. 24 shows a state in which the linking post of the reversible unit in the second embodiment is held in a normal position and is linked to an operation indicator piece.
Figure 25:
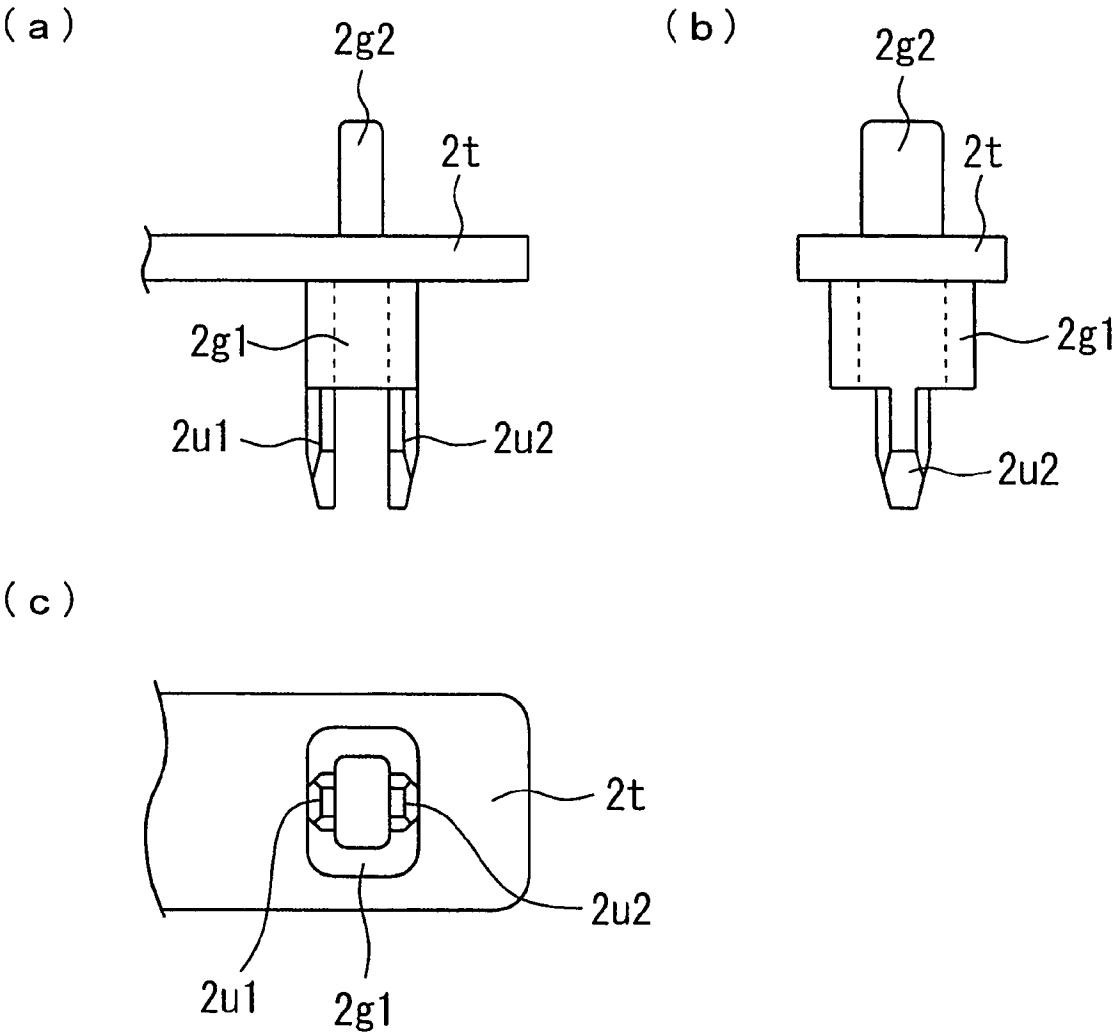
FIG. 25 shows the shape of the linking post of the second embodiment.

Next, the structure of a second embodiment which prevents erroneous mounting of a reversible unit 2 is shown in FIG. 23 to FIG. 25.

In this embodiment, as shown in FIG. 23, two recesses 7*e*, 7*f* are formed in the face opposing the indicator window 6*c*2 of the movable contact point support 7*a*. These recesses 7*e*, 7*f* are formed on the perimeter of the operation indicator piece 7*a*1.

Further, at the lower end of the indicator piece engaging portion 2*g*1 of the reversible unit 2 are formed a pair of protrusions 2*u*1, 2*u*2; this pair of protrusions 2*u*1, 2*u*2 is formed in parallel extension, as shown in FIG. 25.

As shown in FIG. 24, in this embodiment when the indicator piece engaging portion 2*g*1 of the reversible unit 2 is positioned at the normal position NP enabling mating with the operation indicator piece 7*a*1, in the state in which the tips of the pair of protrusions 2*u*1, 2*u*2 formed at the lower end of the indicator piece engaging portion 2*g*1 are placed into the recesses 7*e*, 7*f* formed on the perimeter of the operation indicator piece 7*a*1, the first abutting face 2*b* abuts the arc-extinguishing cover 6*c*, and mounting on the electromagnetic contact device 1*a* is possible.

On the other hand, as shown in FIG. 23, if the indicator piece engaging portion 2*g*1 attempts to advance to the indicator window 6*c*2 from a position deviating from the normal position NP, the protrusions 2*u*1, 2*u*2 of the indicator piece engaging portion 2*g*1 abut a face in which the recesses 7*e*, 7*f* of the movable contact point support 7*a* are not formed, and the first abutting face 2*b* is in a state separated from the arc-extinguishing cover 6*c*, so that the reversible unit 2 cannot be mounted on the electromagnetic contact device 1*a*.

Further, by a similar operation in the other electromagnetic contact device 1*b*, a state enabling linking of the indicator piece engaging portion 2*h*1 protruding from the unit window 2*i* of the reversible unit 2 with the operation indicator piece 7*a*1, or a state preventing linking, results.

By this means, in this embodiment also, for the reversible unit 2 comprising indicator piece engaging portions 2*h*1, 2*g*1 not held in the original positions, the two recesses 7*e*, 7*f* formed in the movable contact point supports 7*a* of the electromagnetic contact devices 1*a*, 1*b* and the pair of protrusions 2*u*1, 2*u*2 formed in the lower end of the indicator piece engaging portions 2*h*1, 2*g*1 of the reversible unit 2 inhibits the advance to the indicator window 6*c*2 of the indicator piece engaging portions 2*h*1, 2*g*1 from positions deviating from the normal position NP, a state in which the indicator piece engaging portions 2*h*1, 2*g*1 are not correctly linked to the operation indicator piece 7*a*1 can be reliably prevented, and erroneous mounting of the reversible unit 2 is prevented, so that forward/reverse operation control of an induction motor can be performed with enhanced safety.

FIG. 26 to FIG. 29 show the structure of a third embodiment which prevents erroneous mounting of a reversible unit 2.

Figure 26:
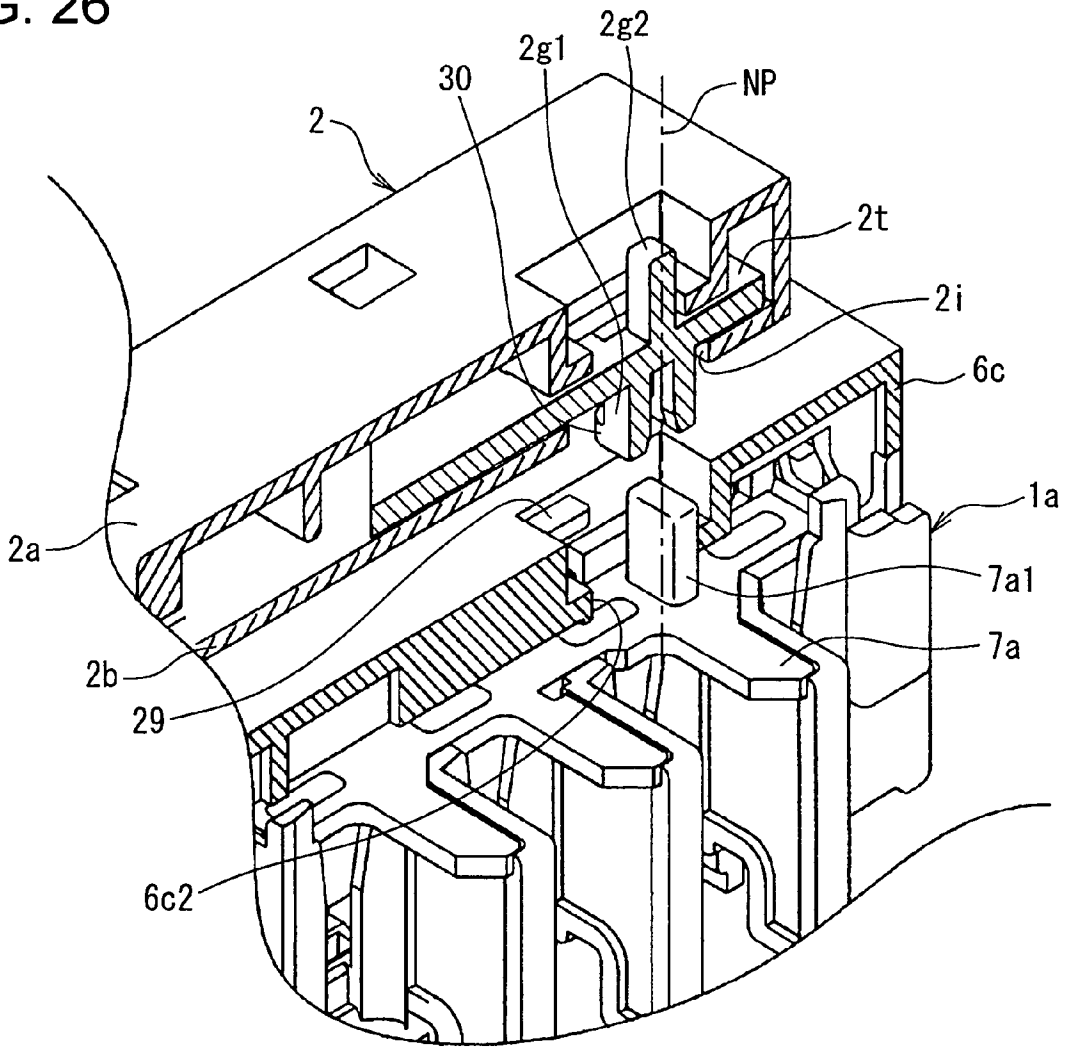
FIG. 26 is a perspective view showing principal portions of the electromagnetic contact apparatus of a third embodiment.

As shown in FIG. 26, in this embodiment a first engagement/advance restriction portion 29 is formed protruding from an inner wall formed in the indicator window 6*c*2 of a first electromagnetic contact device 1*a*. This first engagement/advance restriction portion 29 is formed only on an inner wall of the indicator window 6*c*2 at a position deviating from the normal position NP at which the indicator piece engaging portion 2*g*1 of the reversible unit 2 can mate with the operation indicator piece 7*a*1.

Figure 29:
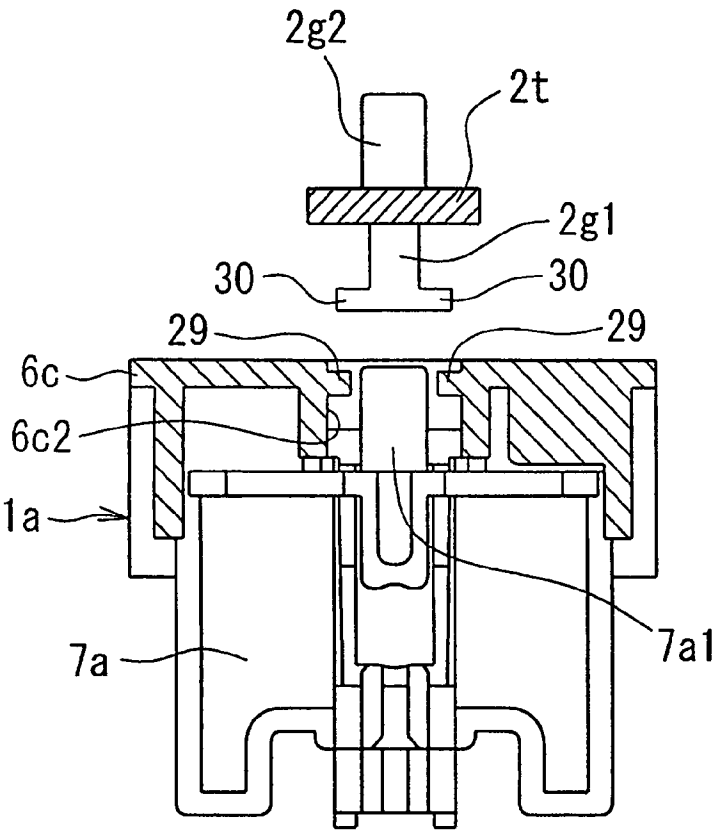
FIG. 29 shows the internal structure of the electromagnetic contact apparatus of the third embodiment from the direction of driving of the movable contact point support.
Figure 29:
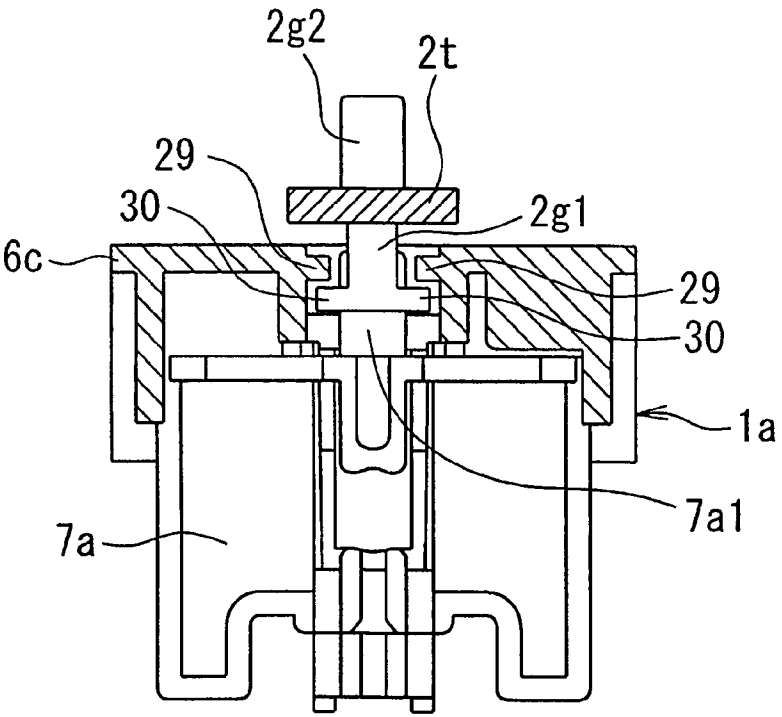

In the lower portion of the indicator piece engaging portion 2*g*1 of the reversible unit 2 is formed a second engagement/advance restriction portion 30 protruding to the outside, as shown in FIG. 29(*a*); if the indicator piece engaging portion 2*g*1 attempts to advance from a position deviating from the normal position NP of the indicator window 6*c*2, this second engagement/advance restriction portion 30 engages with the abovementioned first engagement/advance restriction portion 29, and inhibits the advance of the indicator piece engaging portion 2*g*1.

Further, although not shown, a first engagement/advance restriction portion 29 is also formed in the indicator window 6*c*2 of the other electromagnetic contact device 1*b*, and a second engagement/advance restriction portion 30 is also formed in the indicator piece engaging portion 2*h*1 of the reversible unit 2.

Figure 27:
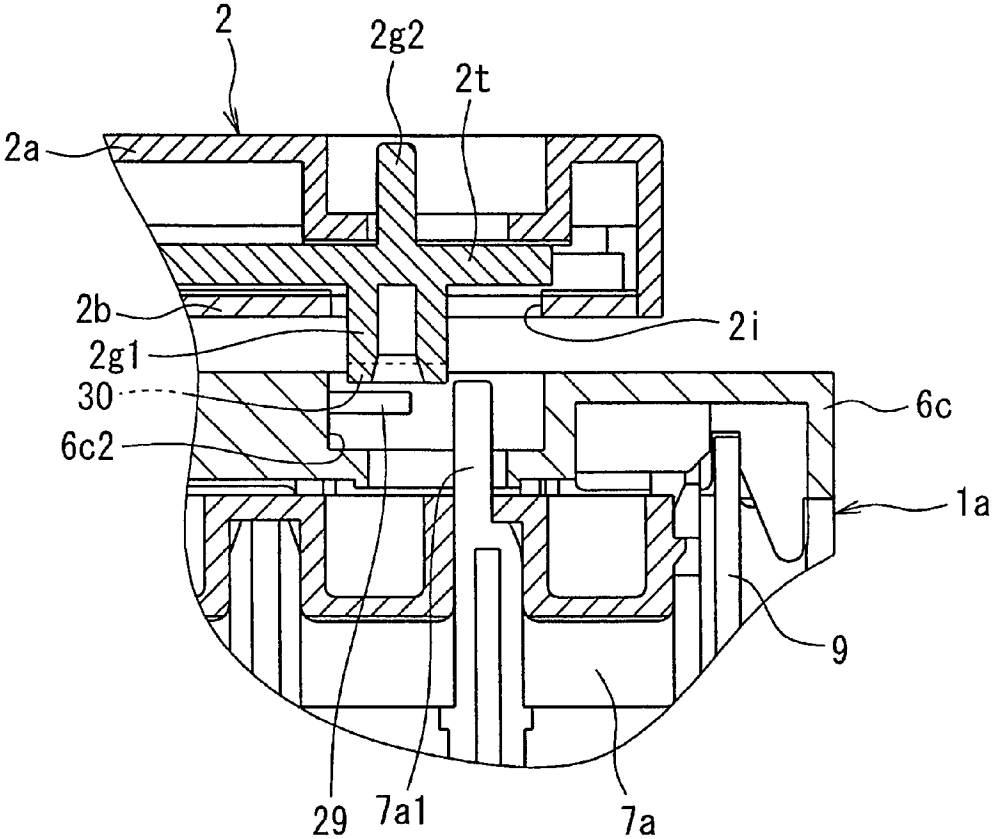
FIG. 27 shows a state in which a linking post of a reversible unit in the third embodiment is not held in a normal position.
Figure 28:
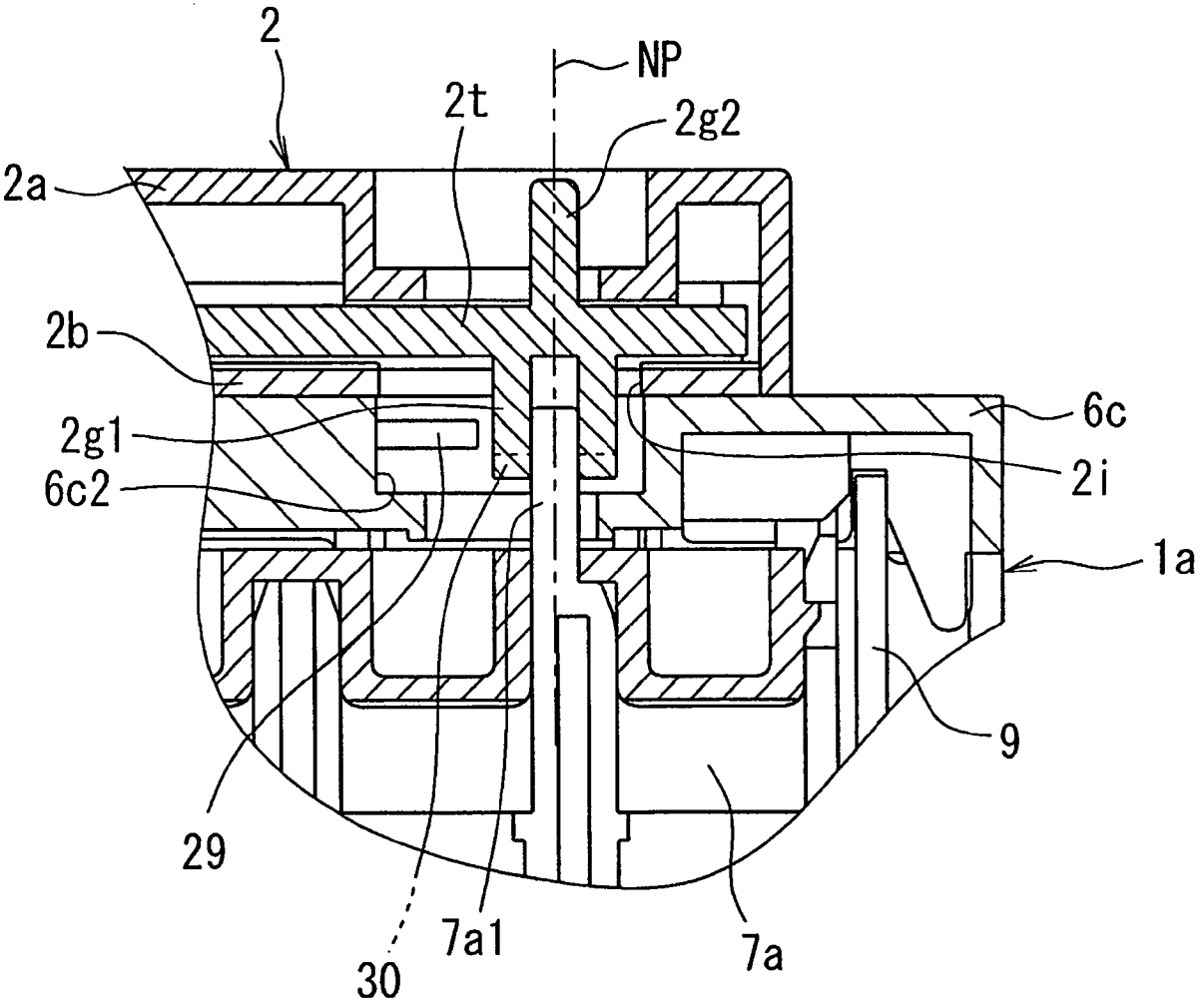
FIG. 28 shows a state in which the linking post of the reversible unit in the third embodiment is held in a normal position and is linked to the operation indicator piece.

By means of the above configuration, as shown in FIG. 27, when the indicator piece engaging portion 2*g*1 protruding from the unit window 2*i* of the reversible unit 6 is in a position deviating from the normal position NP at which linking with the operation indicator piece 7*a*1 of the movable contact point support 7*a* is possible, the first engagement/advance restriction portion 29 protruding from an inner wall of the indicator window 6*c*2 and the second engagement/advance restriction portion 30 protruding from the lower portion of the indicator piece engaging portion 2*g*1 engage and inhibit the advance of the indicator piece engaging portion 2*g*1, so that the reversible unit 2 cannot be mounted on the electromagnetic contact device 1*a*. On the other hand, as shown in FIG. 28, in the case of a reversible unit 2 in which the indicator piece engaging portion 2*g*1 is positioned at the normal position NP, the second engagement/advance restriction portion 30 of the indicator piece engaging portion 2*g*1 does not contact with the first engagement/advance restriction portion 28 of the indicator window 6*c*2, and the indicator piece engaging portion 2*g*1 advances to the indicator window 6*c*2 and is linked in a state of mating with the operation indicator piece 7*a*1, the first abutting face 2*b* abuts the arc-extinguishing cover 6*c*, and mounting on the electromagnetic contact device 1*a* is possible. And, when the indicator piece engaging portion 2*g*1 is linked to the operation indicator piece 7*a*1, the second engagement/advance restriction portion 30 positioned below the first engagement/advance restriction portion 29 does not affect the direction of driving of the movable contact point support 7*a* as shown in FIG. 29(*b*).

Further, by a similar operation in the other electromagnetic contact device 1*b*, a state enabling linking of the indicator piece engaging portion 2*h*1 protruding from the unit window 2*i* of the reversible unit 2 with the operation indicator piece 7*a*1, or a state preventing linking, results.

By this means, in this embodiment also the first engagement/advance restriction portion 29 formed on an inside wall forming the indicator window 6*c*2 and the second engagement/advance restriction portion 30 protruding from the lower portion of the indicator piece engaging portions 2*h*1, 2*g*1 inhibit advance to the indicator window 6*c*2 of indicator piece engaging portions 2*h*1, 2*g*1 from a position other than the normal position NP in a reversible unit comprising indicator piece engaging portions 2*h*1, 2*g*1 not held at the initial positions, and can reliably prevent a state in which the indicator piece engaging portions 2*h*1, 2*g*1 are not correctly linked to the operation indicator piece 7*a*1; so that by preventing erroneous mounting of the reversible unit 2, forward/reverse operation control of an induction motor can be performed with enhanced safety.

(Structure of Coil Terminal Portions of the Electromagnetic Contact Device)

Next, the specific structure of coil terminal portions 11 of the electromagnet 8 shown in FIG. 12 is explained, referring to FIG. 30 to FIG. 33.

Figure 30:
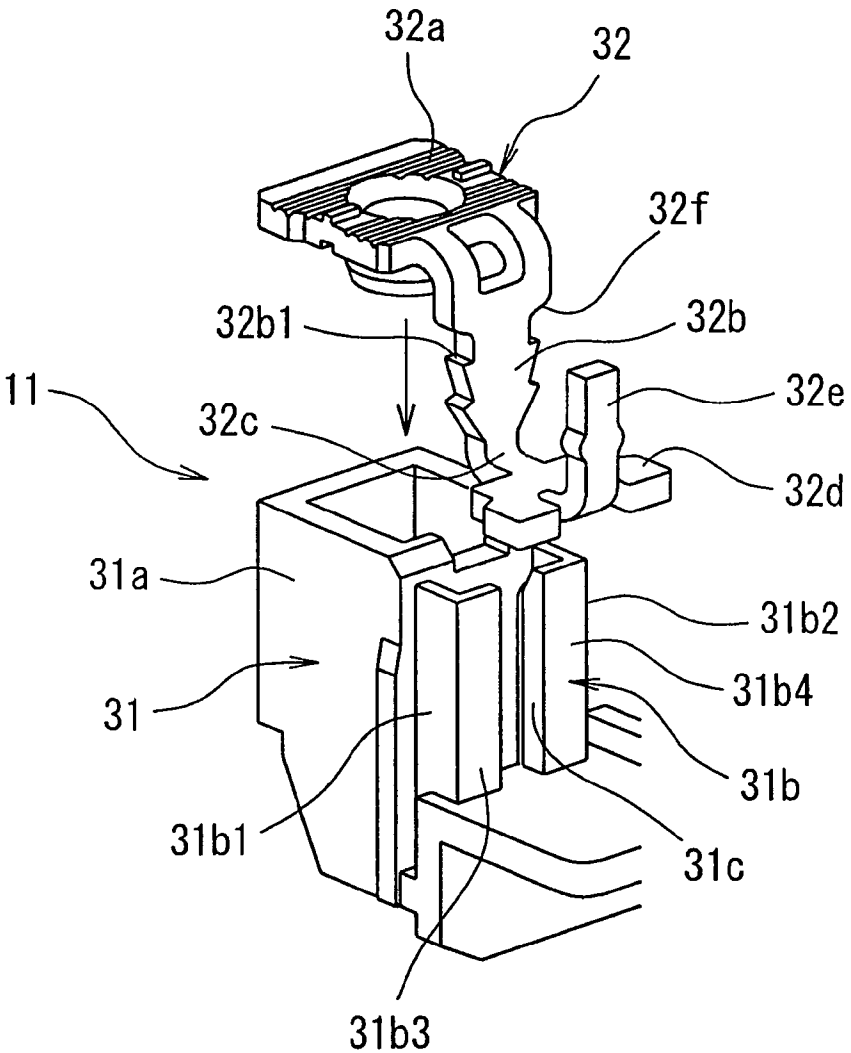
FIG. 30 is a perspective view showing the structure of the coil terminal portion of an electromagnetic contact device of this invention.

As shown in FIG. 30, the coil terminal portions 11 of the electromagnet 8 has a pair of coil terminal bases 31, mutually separated and formed integrally with one side of the coil frame 8*b* (on the side on which the movable core 8*d* is arranged), and terminals 32 press-fitted into these coil terminal bases 31.

One coil terminal base 31 has a rectangular tube-shape portion 31*a* extending from the uppermost face of the coil frame 8*b* to a higher position and a terminal press-fit portion 31*b* formed on the outside wall of this rectangular tube-shape portion 31*a* opposing the other coil terminal base 31. In the terminal press-fit portion 31*b*, a substantial L shape is formed by a pair of plate-shape engaging portions 31*b*1, 31*b*2, protruding from the outer wall of the square tube-shape portion 31*a* and mutually separated, and extending in the vertical direction, and a pair of plate-shape holding portions 31*b*3, 31*b*4, extending in the direction of approach to each other from the open ends of the pair of plate-shape engaging portions 31*b*1, 31*b*2; and a neck portion passthrough slit 31*c* is formed between the plate-shape holding portion 31*b*3 and the plate-shape holding portion 31*b*4. Further, the other coil terminal base 31 also has the same structure as the one coil terminal base 31.

A terminal 32 has a terminal portion 32*a*; a press-fitted piece 32*b* bent at substantially a right angle to and extending from the terminal portion 32*a*; a neck portion 32*c* formed on an end portion of the press-fitted piece 32*b*, with maximum separation from the terminal portion 32*a*; a wire binding foundation portion 32*d* bent at substantially a right angle to the neck portion 32*c* so as to be substantially parallel to the terminal portion 32*a*; and a rising windings wire binding portion 32*e* bent from the wire binding foundation portion 32*d* to be substantially parallel to the press-fitted piece 32*b*. And, on the press-fitted piece 32*b* are formed sawtooth-shape engaging teeth 32*b*1, which engage while being press-fit with the inner faces of the pair of plate-shape engaging portions 31*b*1, 31*b*2 of the coil terminal press-fit portion 31*b*.

Figure 31:
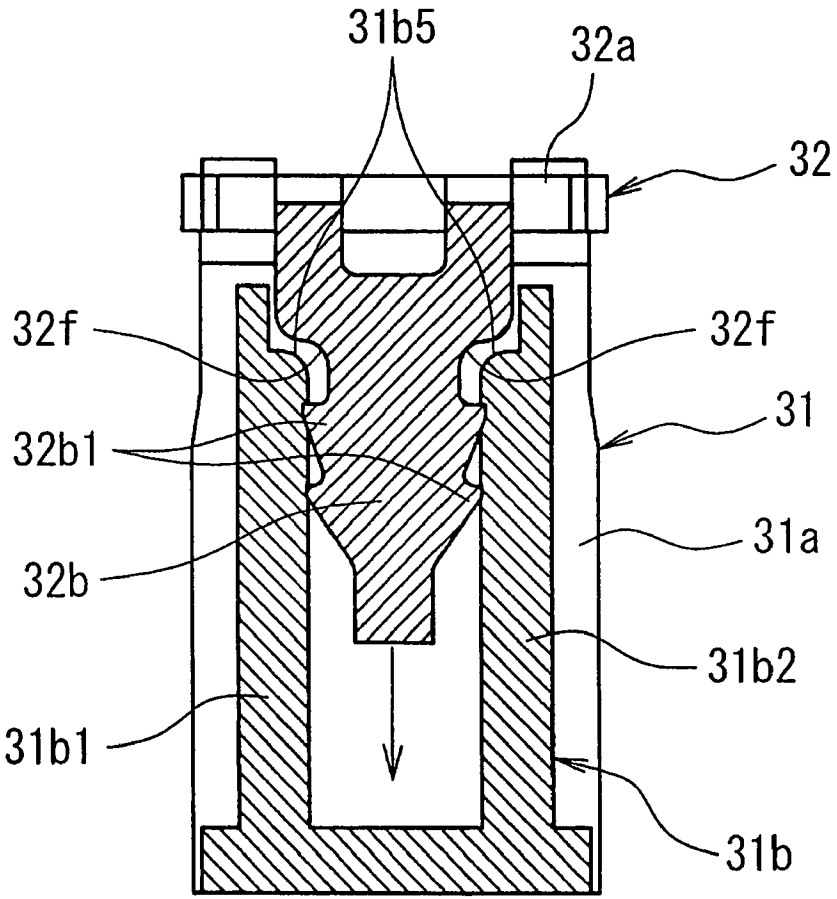
FIG. 31 shows a state in which an engaged portion of a terminal is press-fit into a press-fit engaging portion of the terminal base of a coil terminal portion.

Here, as shown in FIG. 31, a narrow portion 32*f* the width dimension of which is suddenly reduced is provided in the press-fitted piece 32*b* on the side of the terminal portion 32*a*, and engaging teeth 32*b*1 are formed from this narrow portion 32*f* toward the side of the neck portion 32*c*. Further, step portions 31*b*5 are formed on the upper portion of the inner faces of the pair of plate-shape engaging portions 31*b*1, 31*b*2 of the terminal press-fit portion 31*b*, opposing the narrow portion 32*f* of the press-fitted piece 32*b*.

In the terminal 32 of the above configuration, the neck portion 32*c* is passed through the neck portion passthrough slit 31*c* of the terminal press-fit portion 31*b* while press-fitting until the terminal portion 32*a* abuts the upper edge of the rectangular tube-shape portion 31*a*, to perform mounting.

At this time, as shown in FIG. 31, the sawtooth-shape engaging teeth 32*b*1 of the press-fitted piece 32*b* are engaged while being press-fitted into the inner faces of the pair of plate-shape engaging portions 31*b*1, 31*b*2 of the terminal press-fit portion 31*b*. And, when the terminal portion 32*a* abuts the upper edge of the rectangular tube-shape portion 31*a*, the narrow portion 32*f* of the press-fitted piece 32*b* opposes the step portions 31*b*5 of the coil terminal press-fit portion 31*b*.

One line ending of the excitation coil 8*a* wound around the coil frame 8*b* is wound around the winding wire binding 32*e* of one terminal 32, while the other line ending of the excitation coil 8*a* is wound around the winding wire binding 32*e* of the other terminal 32.

Figure 32:
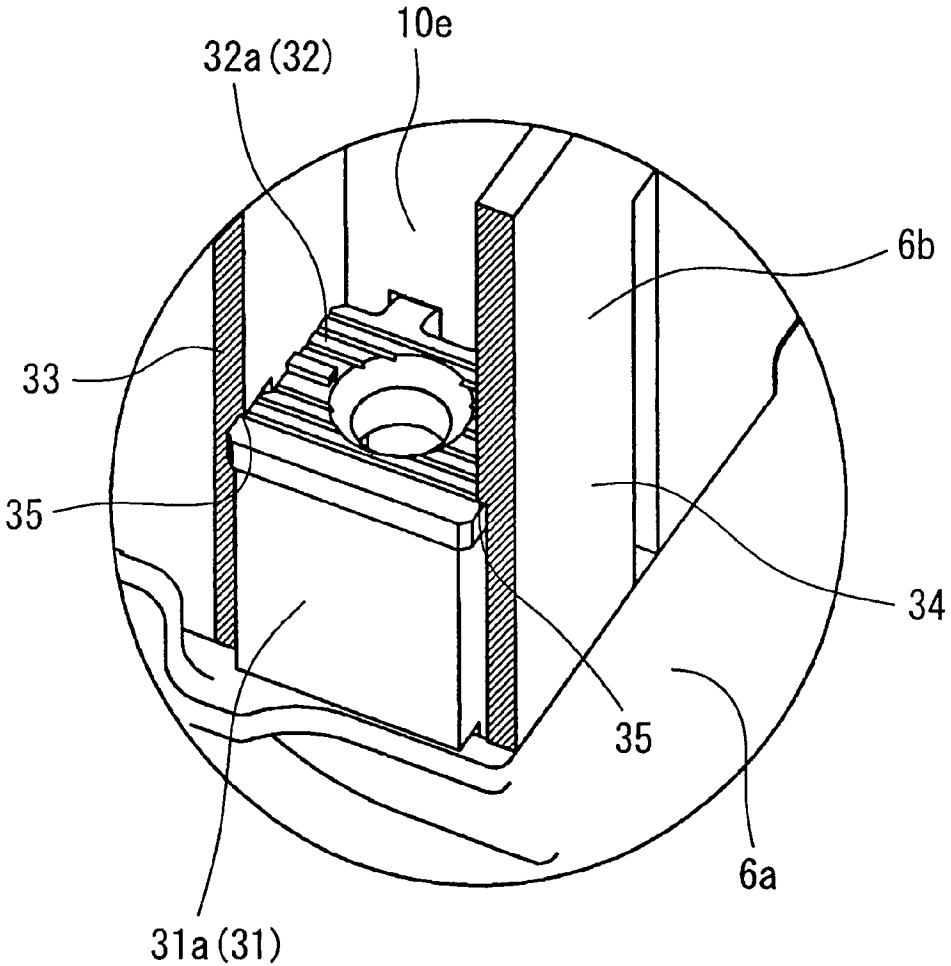
FIG. 32 is a perspective view showing a state in which a terminal base is accommodated in a coil terminal accommodation chamber of an upper case.
Figure 33:
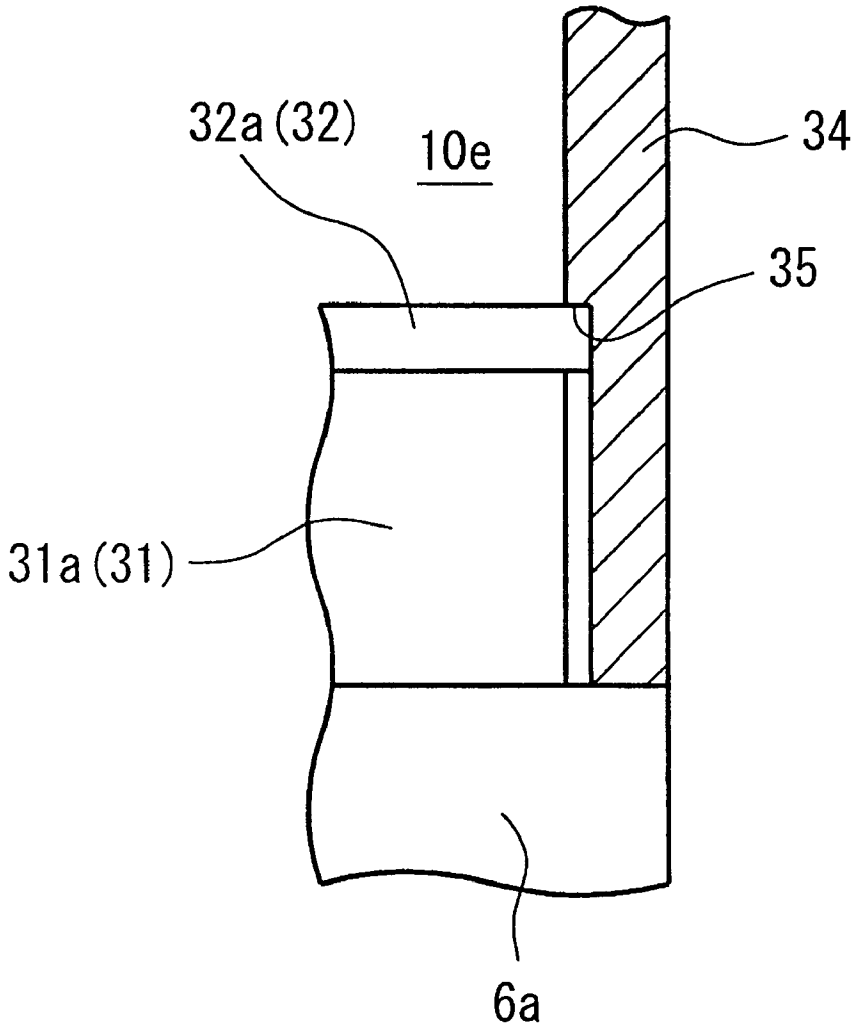
FIG. 33 shows in detail a terminal escape prevention structure.

The coil terminal portions 11 of the electromagnet 8 in the above configuration are accommodated in a coil terminal portion accommodation chamber 10*e* between a pair of partition walls 33, 34 provided in the upper case 6*b*, as shown in FIG. 32 and FIG. 33.

In a coil terminal portion 11 accommodated in the coil terminal portion accommodation chamber 10*e*, an escape-stopping portion 35 formed on the inner walls of the pair of partition walls 33, 34 abuts the upper face of the terminal portion 32*a* of the terminal 32.

By this means, the terminal 32 has a structure in which are integrated with the terminal portion 32*a*, winding wire binding portion 32*e*, and press-fitted pieces 32*b*, 21*b*, so that an increase in the number of components can be prevented.

Further, merely by press-fitting the terminal press-fit portion 31*b* formed on the coil terminal base 31 and the press-fitted piece 32*b*, the terminal 32 is mounted, so that the number of assembly processes is reduced.

Further, the terminal 32 is mounted while press-fitting the press-fitted piece 32*b* into the terminal press-fit portion 31*b*, but the engaging teeth 20*b*1 of the press-fitted piece 20*b* are engaged while press-fitting into the inner faces of the pair of plate-shape engaging portions 31*b*1, 31*b*2 of the terminal press-fit portion 31*b*, so that the terminal 32 can be firmly press-fit into the terminal press-fit portion 31*b*.

Here, when press-fitting the terminal 32 into the terminal press-fit portion 31*b*, shavings occur due to press-fitting and engagement of the engaging teeth 32*b*1 with the pair of plate-shape engaging portions 31*b*1, 31*b*2 of the terminal press-fit portion 31*b*; but when the terminal portion 32*a* abuts the upper end of the rectangular tube-shape portion 31*a*, the narrow portion 32*f* formed in the press-fitted piece 32*b* opposes the step portions 31*b*5 formed in the terminal press-fit portion 31*b*, and the shavings which occur are sealed within the terminal press-fit portion 31*b*. Hence shavings do not intrude into the contact point portion 7 and similar, and removal by air cleaning and similar is unnecessary, so that assembly is made still easier.

Further, when the coil terminal portion 11 of the electromagnet 8 is accommodated in the coil terminal portion accommodation chamber 10*e* of the upper case 6*b*, the escape-stopping step portion 35 formed in the inner walls of the pair of partition walls 33, 34 abuts the upper face of the terminal portion 32*a* of the terminals 32, so that escape of the coil terminal 32 can be reliably prevented, and a highly reliable electromagnetic contact device 1 can be provided.

(Structure of the Main Circuit Terminal Portion of the Electromagnet Constructing the Electromagnetic Contact Device)

Next, the specific structure of the terminal portions 10*a* to 10*d* shown in FIG. 12, each having contact points, is explained referring to FIG. 34 to FIG. 39.

Figure 34:
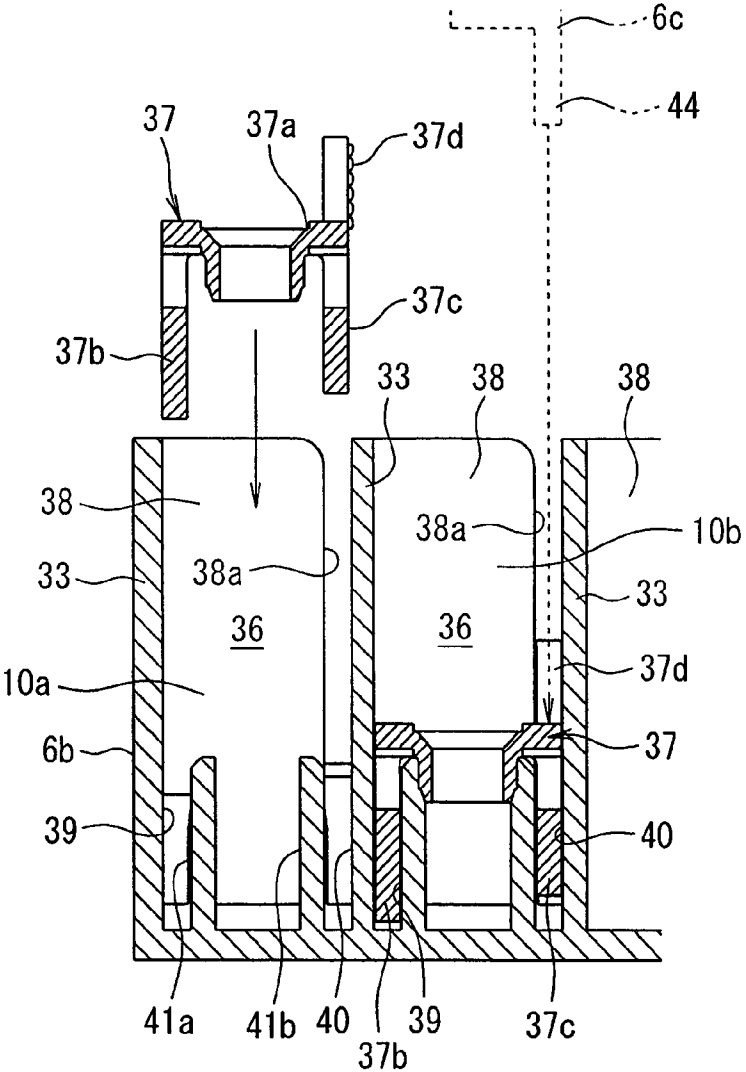
FIG. 34 shows a state in which a fixed contactor is mounted in a terminal chamber provided on an upper case.

As shown in FIG. 34, fixed terminals 37 of the two terminal portions 10*a*, 10*b* are mounted in terminal chambers 36 formed in a row in the upper portion of the upper case 6*b*.

Each of the terminal chambers 36 is formed by a plurality of partition walls 33 arranged in parallel and separated in the upper case 6*b*, and a partitioning wall 38 which partitions an arc-extinguishing chamber S in which is arranged the movable contact point support 7*a* arranged between the partition walls 33, 33.

Within a terminal chamber 36 are formed a press-fit space 39 and a fixed contact point insertion space 40.

Figure 35:
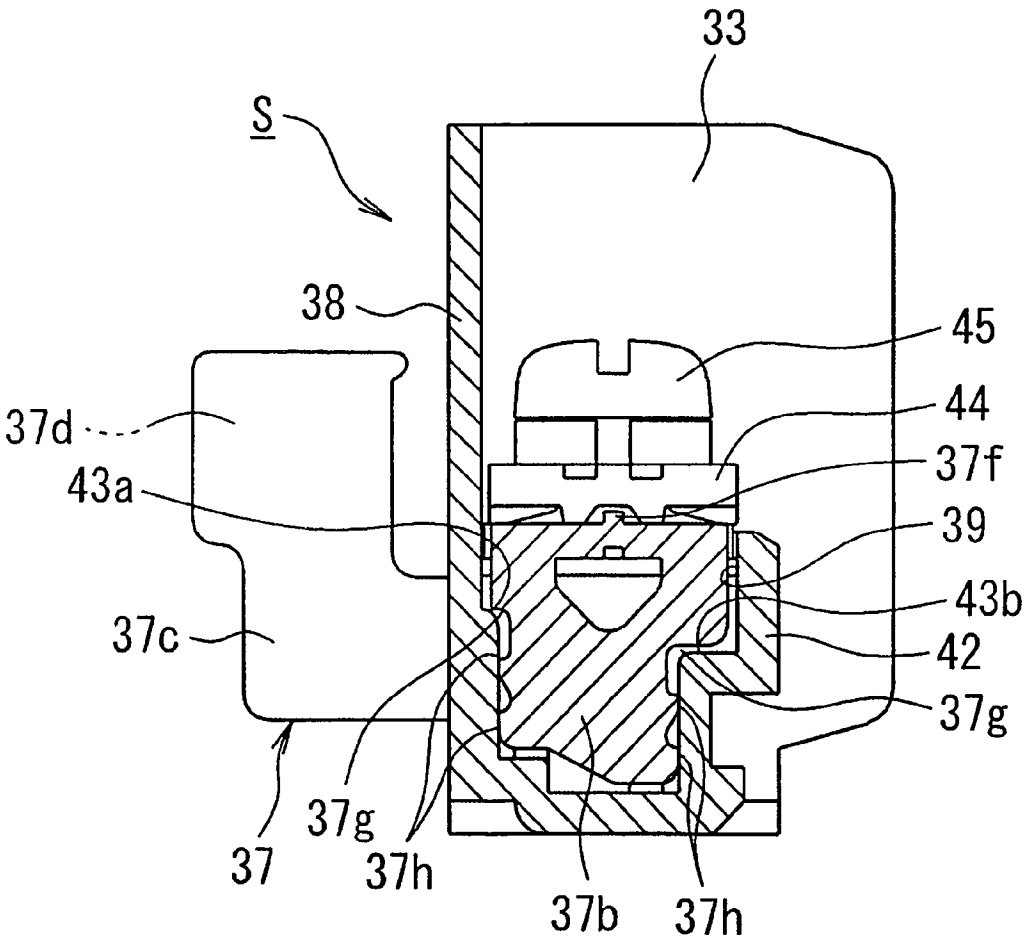
FIG. 35 shows principal portions of a terminal chamber in which a fixed contactor is mounted.

As shown in FIG. 34 and FIG. 35, the press-fit space 39 is a bursiform space enclosed by the partition wall 33, press-fit partition wall 41*a* rising up from the bottom face forming the terminal chamber 36, partitioning wall 38, and front wall (wall opposing the partitioning wall 38) 42, and open at the top. The partition wall 33 and front wall 42 forming this press-fit space 39 are set so that the interval between partitions is narrow at the bottom and the interval between partitions broadens at the top, and as shown in FIG. 35, step faces 43*a*, 43*b* at places with different intervals between partitions are formed.

Further, the fixed contact point insertion space 40 is a space enclosed by the partition wall 33, press-fit partition wall 41*b* rising up from the bottom face forming the terminal chamber 20*a*, partitioning wall 38, and front wall 42, and communicates with the arc-extinguishing chamber S via a slit 38*a* formed in the partitioning wall 38. Further, the other terminal portions 10*c*, 10*d* also have the same structure.

Figure 36:
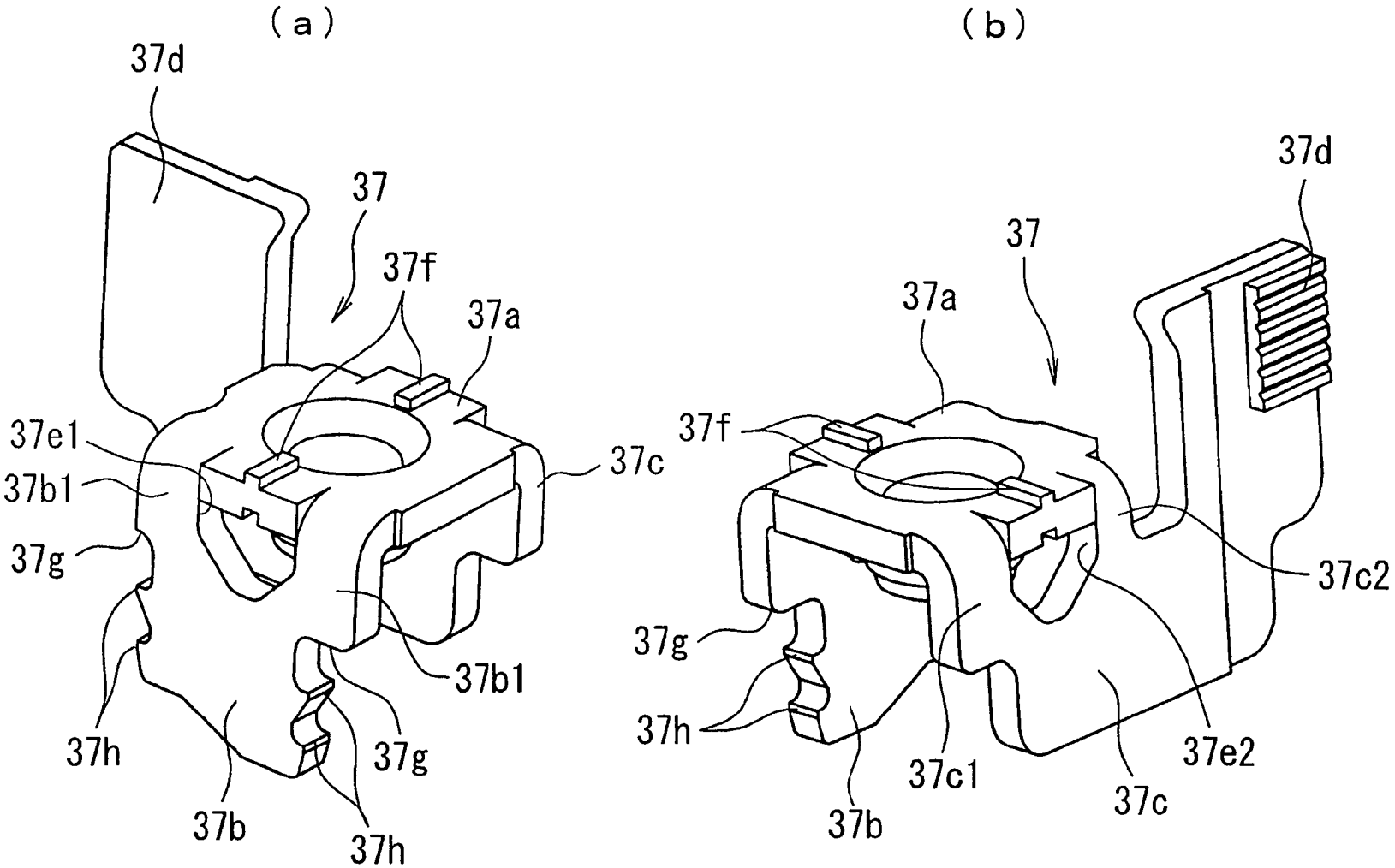
FIG. 36 shows the structure of the fixed contactor of the first embodiment.

As shown in FIG. 36, the fixed contactor 37 mounted in the terminal chamber 36 has a terminal screw 37*a* with a square shape in plan view, in which is formed a female screw hole; a press-fitted piece 37*b*, formed by bending from one side of the terminal screw 37*a*; a bent piece 37*c*, formed by bending from another side of the terminal screw 37*a* in the same direction as the press-fitted piece 37*b*; and a fixed contact point 37*d*, formed at one end of the bent piece 37*c*.

The press-fitted piece 37*b* and bent piece 37*c* are made continuous with the terminal screw 37*a* via a pair of connecting rods 37*b*1, 37*b*2 and a pair of connecting rods 37*c*1, 37*c*2 by forming cutout openings 37*e*1, 37*e*2.

On the upper face of the terminal screw 37*a* is formed a wiring escape-stopping ridge 37*f* protruding in the radial direction.

Further, in the press-fitted piece 37*b* is provided a narrow portion 37*g*, the plate width dimension of which decreases suddenly from the pair of connecting rods 37*b*1, 37*b*2, and sawtooth-shape engaging teeth 37*h* are formed in the edge portion in the plate width direction, from this narrow portion 37*g* toward the end.

Figure 37:
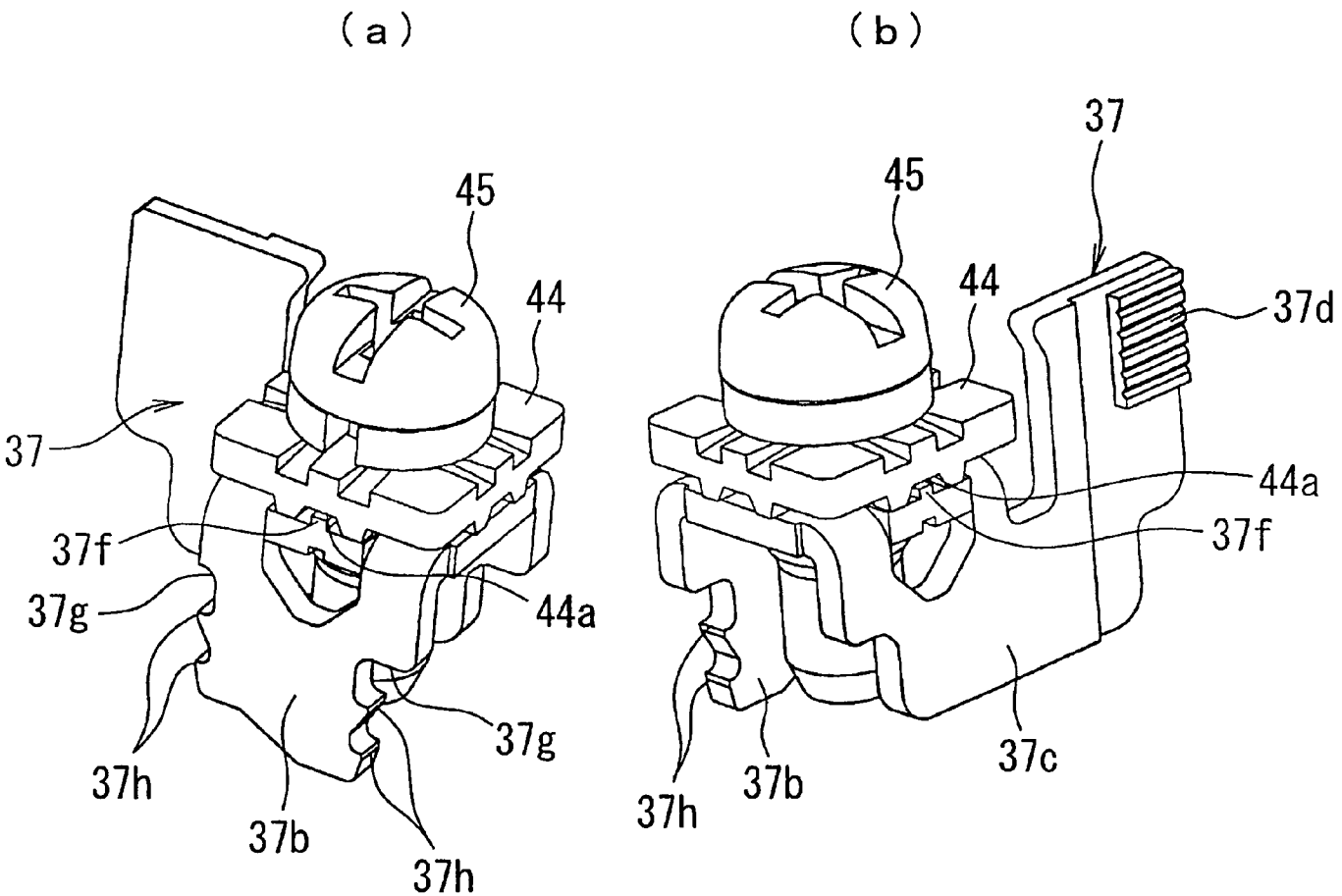
FIG. 37 shows a state in which a screw with washer is screwed into the fixed contactor of the first embodiment.

And, as shown in FIG. 37, a screw 45 with a washer 44 is screwed into the terminal screw 37*a* of this fixed contactor 31. Here, a groove 44*a* into which the wiring escape-stopping ridge 37*f* of the terminal screw 37*a* can enter is formed in the washer 44.

The press-fitted piece 37*b* and bent piece 37*c* of fixed contactors 37 with the above configuration are inserted into the press-fit spaces 39 and fixed contact point insertion spaces 40 of the terminal chambers 36.

The sawtooth-shaped engaging teeth 37*h* of the press-fitted pieces 37*b* are engaged while press-fitting with the inner faces of the partition wall 33 and front wall 42, as shown in FIG. 35. At this time, the narrow portions 37*g* of the press-fitted pieces 37*b* oppose the step faces 43*a*, 43*b* formed in the press-fit space 39.

Further, when the bent piece 37*c* is inserted into the fixed contact point insertion space 40, one side of the bent piece 37*c* mates with the slit 38*a*, and the fixed contact point 37*d* formed on one end of the bent piece 37*c* is positioned in the arc-extinguishing chamber S, and is arranged opposing the direction of motion of the plurality of movable contact points 7*c* of the contact point portion 7.

Also, as shown in FIG. 34, when the arc-extinguishing cover 6*c* is mounted on the upper case 6*b*, the fixed contactor pressing portions 46 provided on the arc-extinguishing cover 6*c* abut from the upper face the terminal screws 37*a* of the fixed contactors 37 mounted in the terminal chambers 36.

By means of this embodiment, press-fitted pieces 37*b* of fixed contactors 37 are mounted by press-fitting into press-fit spaces 39 formed in the upper case 6*b*, but the engaging teeth 37*h* of the press-fitted piece 37*b* are engaged by press-fitting into the inner faces of the second partition wall 33 and front wall 42 forming the press-fit space 39. Hence escape of the fixed contactor 37 is stopped simply by press-fitting the fixed contactor 37 into the press-fit space 39, and mounting in the upper case 6*b* can be reliably performed.

Further, when the arc-extinguishing cover 6*c* is mounted on the upper case 6*b*, the fixed contactor pressing portions 46 provided on the arc-extinguishing cover 6*c* abut from the upper face the terminal screws 37*a* of the fixed contactors 37, so that escape of the fixed contactors 37 can be stopped even more reliably.

Here, when press-fitting the press-fitted piece 37*b* of a fixed contactor 37 into a press-fit space 39, shavings occur due to press-fitting into the inner faces of the partition wall 33 and front wall 42, but the narrow portion 37*g* of the press-fitted piece 37*b* opposes the step faces 43*a*, 43*b* formed in the press-fit space 39, and the shavings which occur are sealed within the press-fit space 39. Hence shavings do not intrude into contact point portions 7 or similar, and removal by air cleaning or similar is rendered unnecessary, so that tasks of installation of fixed contactors 37 can easily be performed, and the reliability of contact of the movable contact points 7*c* of the contact portion 7 and the fixed contact points 37*d* can be improved.

Further, in the fixed contactors 37 according to this embodiment, the press-fitted pieces 37*b*, the bent piece 37*c* and the terminal screw 37*a* are continuous via cutout openings 37*e*1, 37*e*2, so that bending of the press-fitted pieces 37*b* and bent pieces 37*c* is easy, and a flat plate-shape terminal screw 37*a* can be formed.

Also, wiring escape-stopping ridges 37*f* are formed on the terminal screws 37*a* of the fixed contactors 37, so that when screwing screws 45 into terminal screws 37*a* and connecting external wiring, wiring can be performed reliably by clamping external wiring using washers 44, and external wiring connection tasks can easily be performed.

Figure 38:
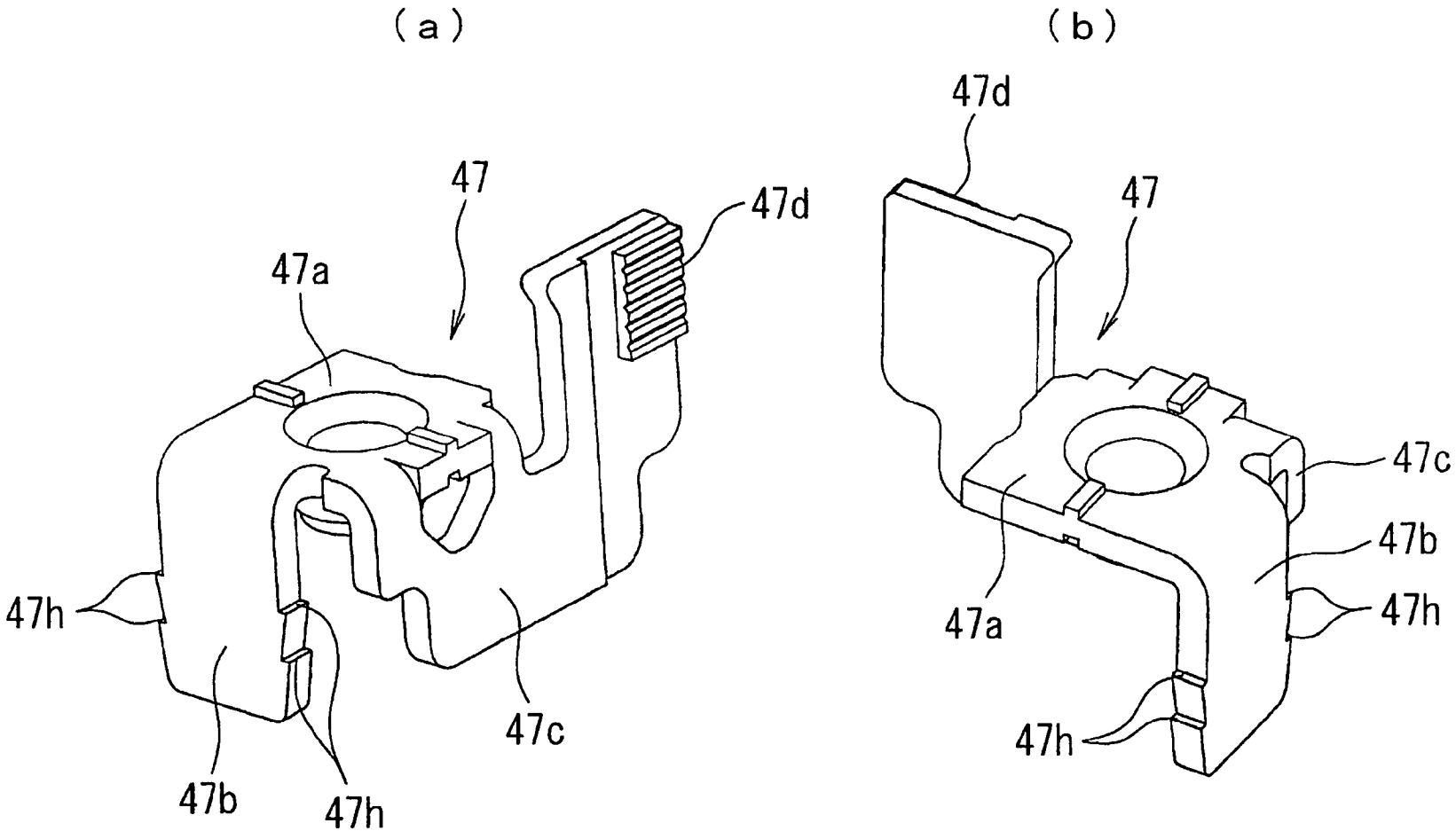
FIG. 38 shows the structure of the fixed contactor of the second embodiment.

Next, FIG. 38 shows the structure of terminal portions in another embodiment.

The fixed contactor 47 of this embodiment has a terminal screw 47*a* with a square shape in plan view; a press-fitted piece 47*b* formed by bending from one side of the terminal screw 47*a*; a bent piece 47*c* formed by bending from another side of the terminal screw 47*a*, shifted 90° from the position of formation of the press-fitted piece 47*b*, in the same direction as the press-fitted piece 47*b*; and a fixed contact point 47*d* formed at one end of the bent piece 47*c*. Saw tooth-shaped engaging teeth 47*h* are formed on an edge in the plate thickness direction of the press-fitted piece 47*b*.

Figure 39:
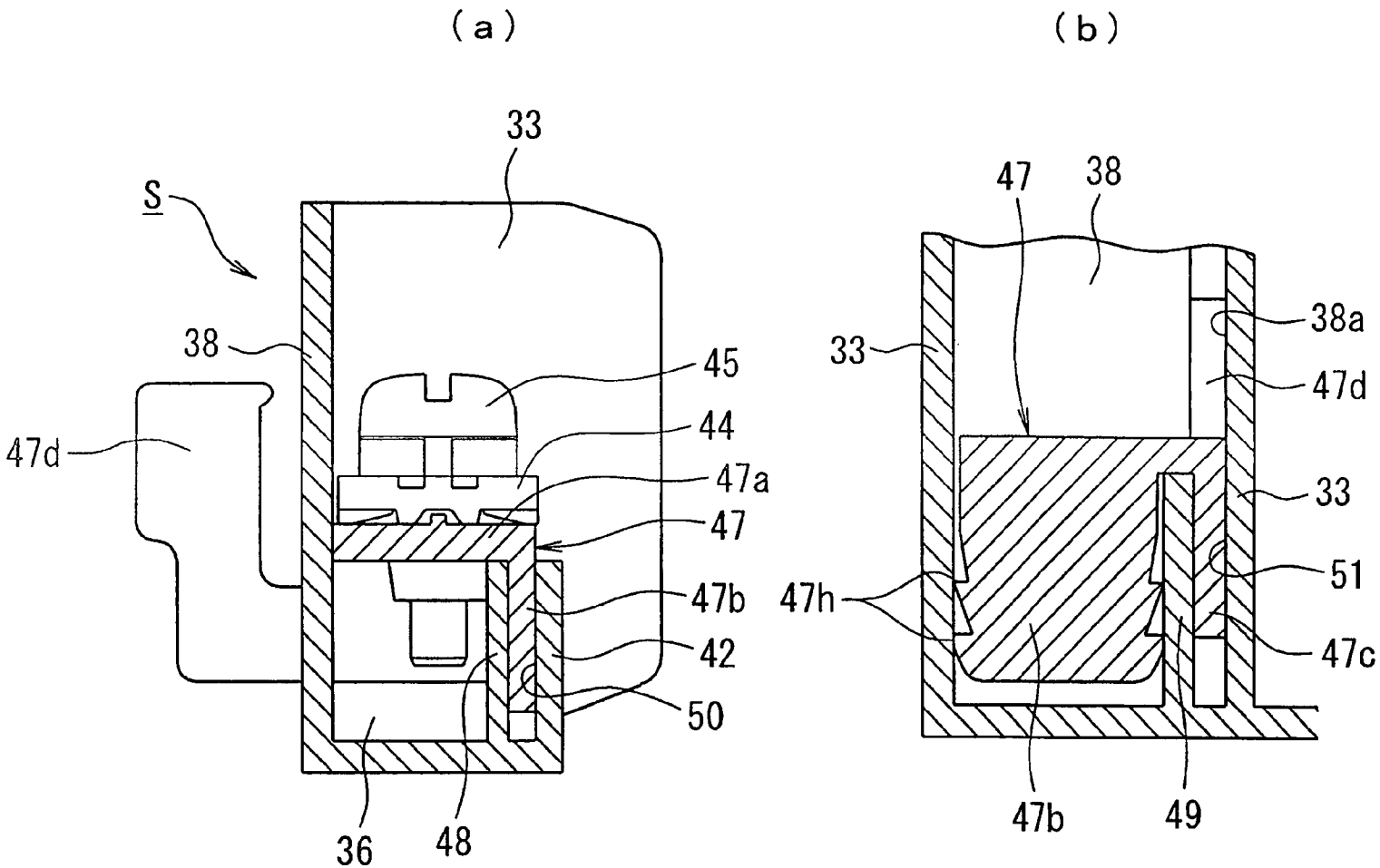
FIG. 39 shows a state in which the fixed contactor of the second embodiment is mounted in the terminal chamber of the upper case.

Further, as shown in FIG. 39, in the terminal chamber 36 of this embodiment, a bursiform press-fit space 50 opening at the top, and a fixed contact point insertion space 51 along the partition wall 33, are formed by the partition wall 33, front wall (wall opposing the partitioning wall 38) 42, first press-fit partition wall 48 in proximity to this front wall 42, and second press-fit partition wall 49 along the partition wall 33.

In the fixed contactor 47 of this embodiment, the press-fitted piece 47*b* and bent piece 47*c* are inserted into a press-fit space 50 and fixed contact point insertion space 51 of a terminal chamber 36.

As shown in FIG. 39(*b*), the saw tooth-shaped engaging teeth 47*h* of the press-fitted piece 47*b* are engaged while press-fitting into the inner faces of the partition wall 33 and second press-fit partition wall 49.

Further, when the bent piece 47*c* is inserted into the fixed contact point insertion space 51, one end of the bent piece 47*c* mates with the slit 38*a*, and the fixed contact point 47*d* formed on one end of the bent piece 47*c* is positioned in the arc-extinguishing chamber S, and is arranged opposing the direction of motion of the plurality of movable contact points 7*c* of the contact point portion 7.

By means of this embodiment, the press-fitted piece 47*b* of a fixed contactor 47 is press-fit into the press-fit space 50 of a terminal chamber 36 and mounted, but the engaging teeth 47*h* of the press-fitted piece 47*b* are press-fit into the inner faces of the partition wall 33 and third press-fit partition wall 49 forming the press-fit space 50 while being engaged. Hence simply by press-fitting the fixed contactor 47 into the press-fit space 50, escape of the fixed contactor 47 is stopped, and reliable mounting on the upper case 6*b* can be performed.

(Structure of the Arc-Extinguishing Cover of the Electromagnetic Contact Device)

Next, the specific structure of the arc-extinguishing cover 6*c* mounted on the upper case 6*b* of the electromagnetic contact device 1*a* shown in FIG. 12 is explained, referring to FIG. 40 to FIG. 50. The arc-extinguishing cover 6*c* of the electromagnetic contact device 1*b* has the same configuration so an explanation is omitted.

Figure 40:
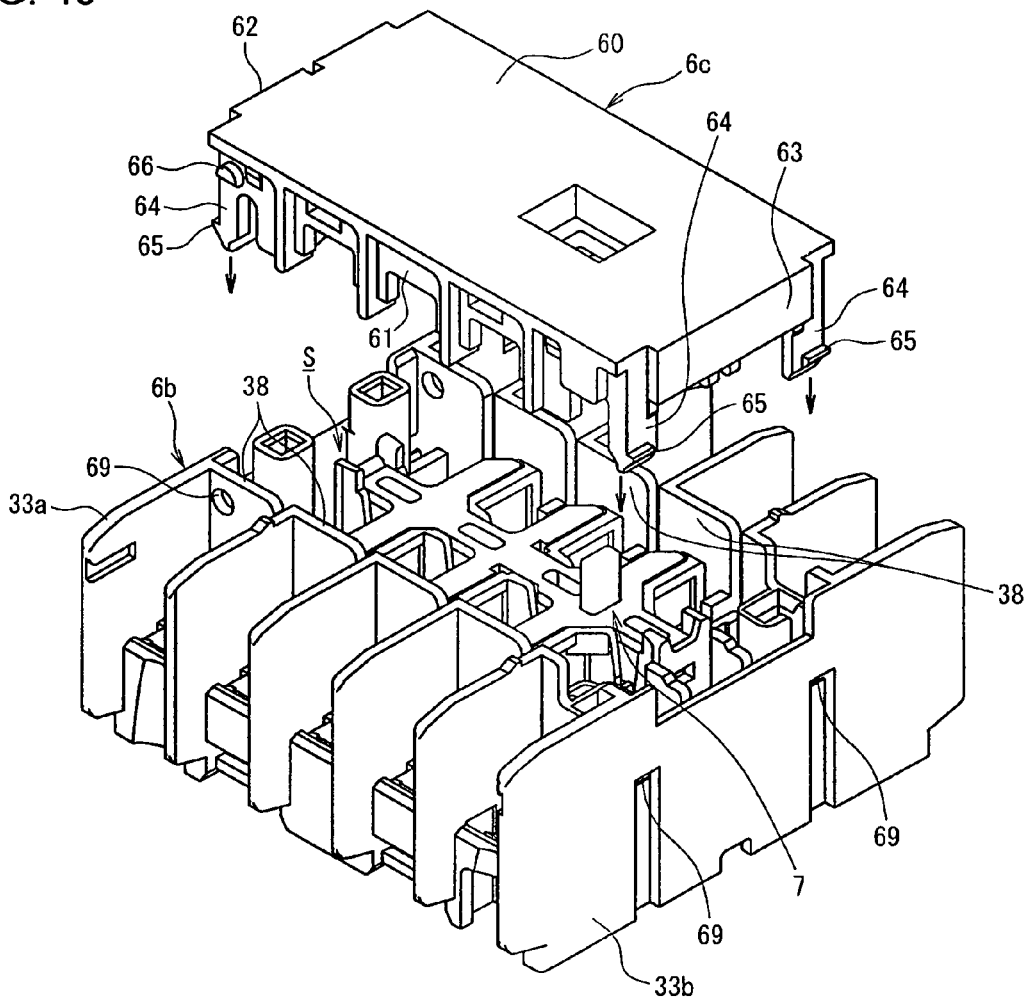
FIG. 40 is an exploded perspective view showing the upper case and arc-extinguishing cover structure of the first embodiment configured of an electromagnetic contact device of the invention.
Figure 41:
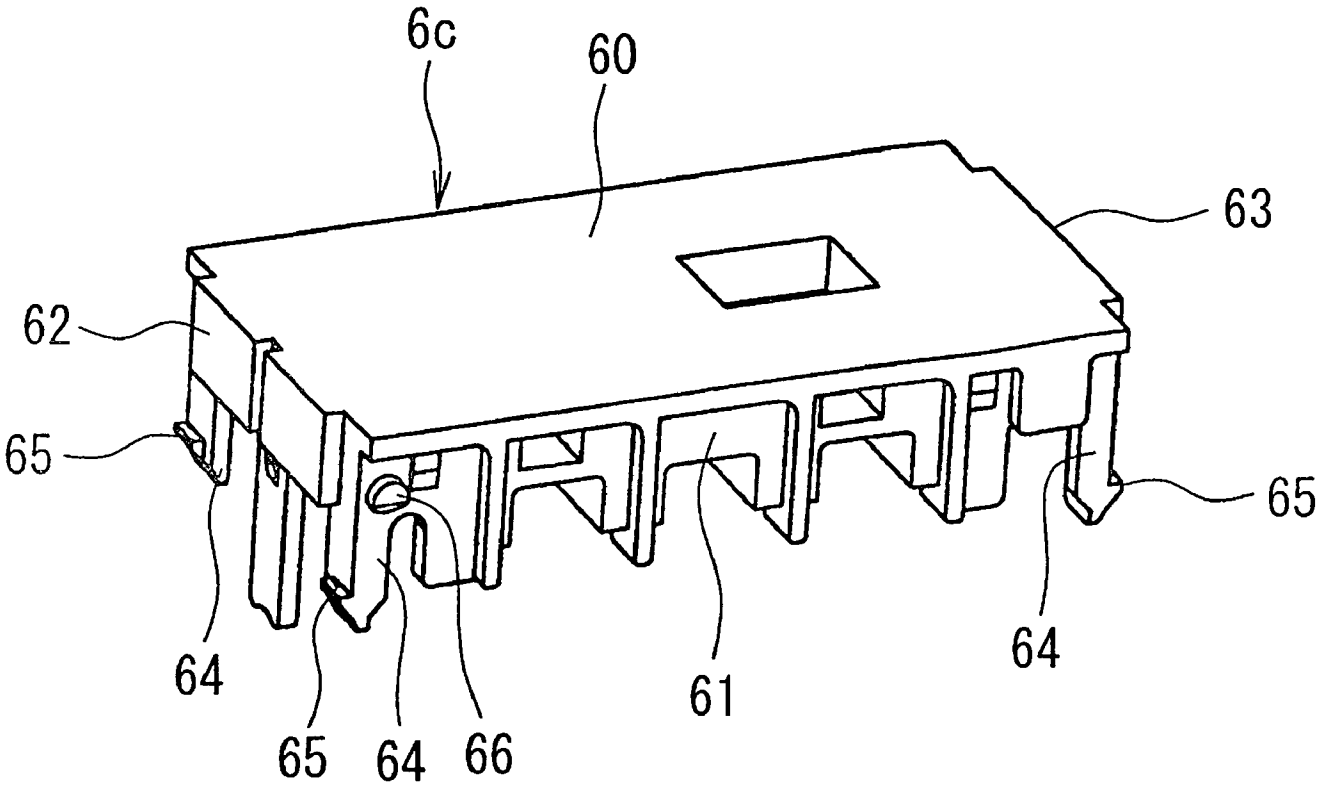
FIG. 41 is a perspective view showing the structure of the arc-extinguishing cover of the first embodiment.

As shown in FIG. 40 and FIG. 41, the arc-extinguishing cover 6*c* has a rectangular-shape cover body 60, which is on the front side in the orientation for installation on the electromagnetic contact device 1*a*; a pair of long-edge wall portions 61 formed in mutual opposition from the long-edge side rims of the cover body 60; a pair of short-edge wall portions 62, 63 formed in mutual opposition from the short-edge side rims of the cover body 60; pairs of engaging leg portions 64 formed at both ends of the short-edge wall portions 62, 63 in proximity to the long-edge wall portions 61; hook portions 65 formed at the tips of the engaging leg portions 64; and a pair of bosses 66 formed protruding from positions on each of the long-edge wall portions 61 in proximity to one of the short-edge wall portions 62.

Further, in the partitioning wall 38 in proximity to one of the case outer walls 33*a* of the upper case 6*b* are formed a pair of boss holes 68 which respectively mate with the pair of bosses 66 of the arc-extinguishing cover 6*c*.

Figure 43:
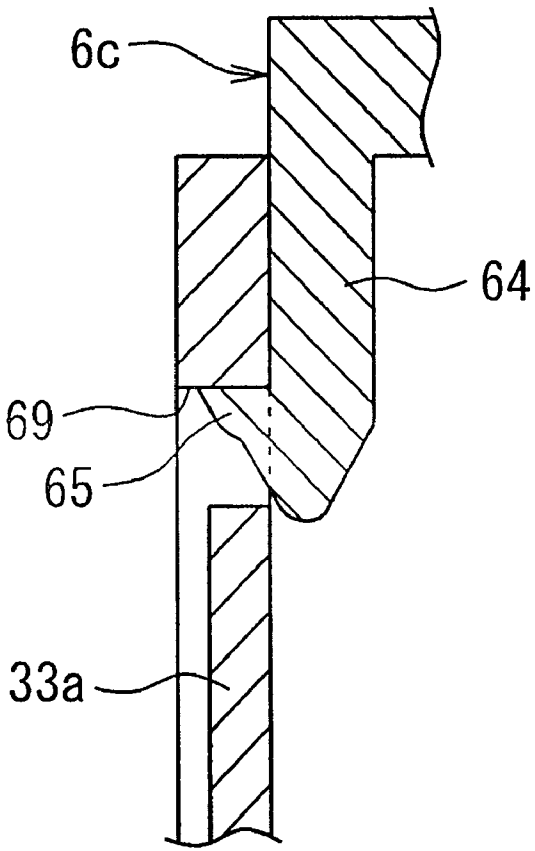
FIG. 43 is view A-A in FIG. 42.
Figure 44:
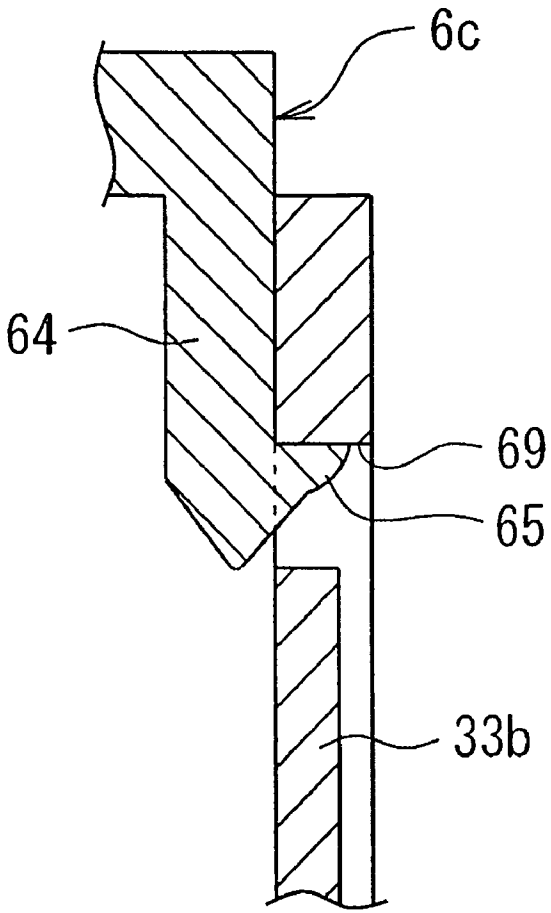
FIG. 44 is view B-B in FIG. 42.

Further, as shown in FIG. 43 and FIG. 44, in the pair of case outer walls 33*a*, 33*b* of the upper case 6*b* are formed engaging holes 69, which engage with the hook portions 65 of the pair of engaging leg portions 64, formed in pairs on each of the sides of the pair of short-edge wall portions 62, 63 of the arc-extinguishing cover 6*c*.

Figure 42:
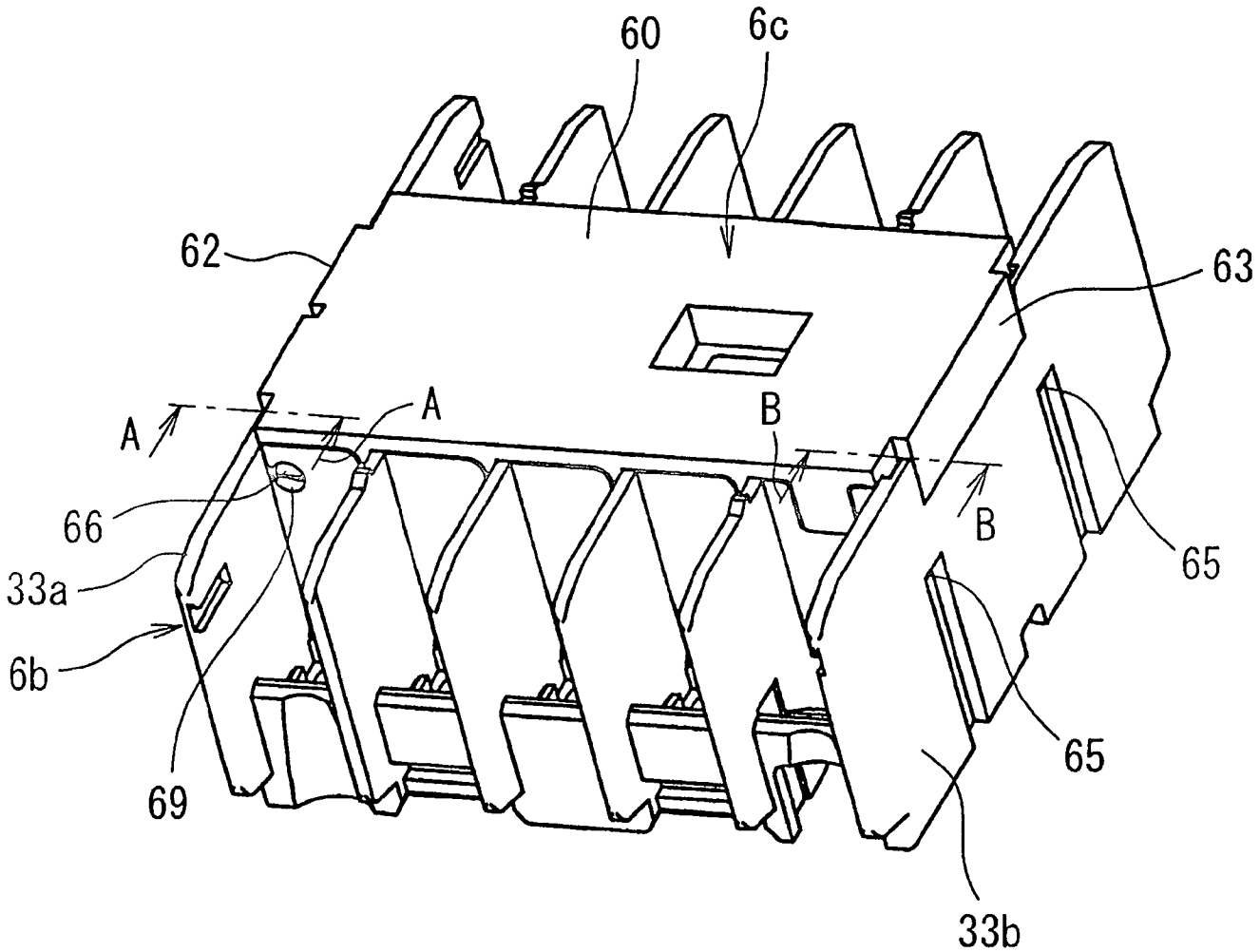
FIG. 42 shows a state in which an arc-extinguishing cover is mounted on the upper case in the first embodiment.

And, the arc-extinguishing cover 6*c* is mated in the direction of the arrow of FIG. 40 toward the arc-extinguishing chamber S accommodating the contact point portion 7 of the upper case 6*b*. At this time, the pair of long-edge wall portions 61 slides against the partitioning wall 38 of the upper case 6*b* and enters into the arc-extinguishing chamber S, and the engaging leg portions 64, while undergoing elastic deformation, slides against the inner faces of the pair of case outer walls 33*a*, 33*b* of the upper case 6*b*, and the hook portions 65 on the tips engage with the respective engaging holes 26, while the pair of bosses 66 formed on the sides of the short-end wall portions 62 mates with the pair of boss holes 69 formed in the partitioning wall 38, to assume a state in which the lower-end faces of the pair of short-edge wall portions 62, 63 abut the upper-end faces of the pair of case outer walls 33*a*, 33*b* of the upper case 6*b*. By this means, as shown in FIG. 42, the arc-extinguishing cover 6*c* is mounted on the upper case 6*b* in a state in which the arc-extinguishing chamber S is sealed.

Suppose that, in the electromagnetic contact device 1*a* comprising the upper case 6*b* and arc-extinguishing cover 6*c* with the above configuration, an anomalous large current flowed in the contact point portion 7 due to a short-circuit accident or similar, and the generated arc gas caused an excessive rise in the internal pressure in the arc-extinguishing chamber S, so that the arc-extinguishing cover 6*c* attempts to dissociate and rise up from the upper case 6*b*.

Here, in the arc-extinguishing cover 6*c* of this embodiment, at one of the short-edge wall portions 62, the hook portions 65 of the pair of engaging leg portions 64 engage with the engaging holes 69 of one of the case outer walls 33*a*, and moreover the pair of bosses 66 mates with the pair of boss holes 69 formed in the partitioning wall 38, while at the other short-edge wall portion 63 only the hook portions 65 of the pair of engaging leg portions 64 and the engaging holes 69 of the other case outer wall 33*b* engage, in a structure in which the latching force with respect to the upper case 6*b* on the side of the other short-edge wall portion 63 is weaker than the latching force with respect to the upper case 6*b* on the side of the one short-edge wall portion 62.

Figure 45:
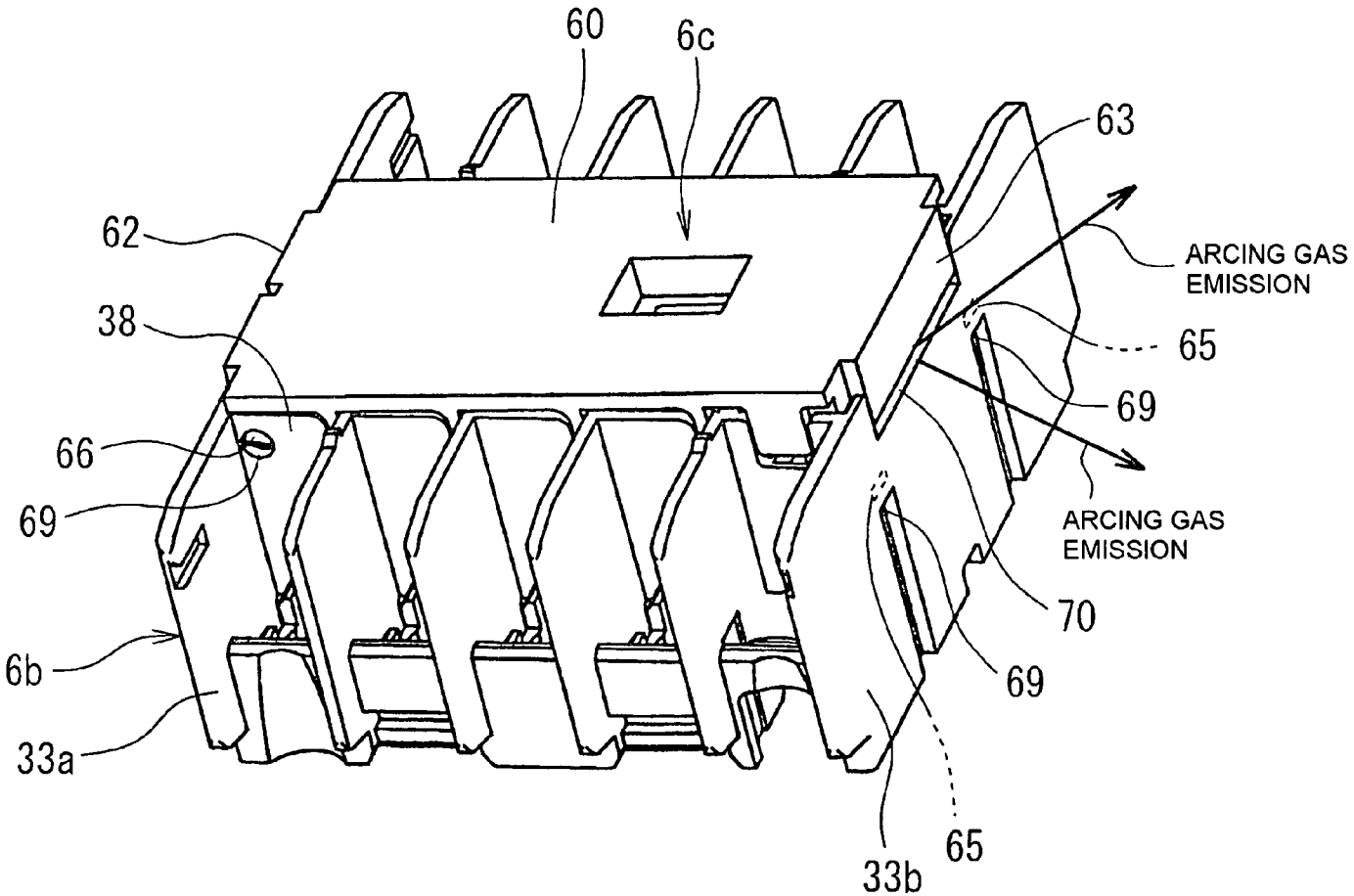
FIG. 45 shows a state in which the internal pressure in the arc-extinguishing chamber is raised in the first embodiment.

Hence as shown in FIG. 45, when there is an excessive increase in the internal pressure of the arc-extinguishing chamber S, the engaged state of the hook portions 65 and engaging holes 26 on the side of the other short-edge wall portion 63 is disengaged before the side of the one short-edge wall portion 62, and by rotating about the bosses 66 mated with the boss holes 69, the arc-extinguishing cover 6*c* rises up on the side of the other short-edge wall portion 63.

Hence when the side of the other short-edge wall portion 63 rises up, a gap 70 is formed between the lower-end face of the other short-edge wall portion 63 and the upper-end face of the other case outer wall 33*b*, and this gap 70 serves as a gas escape hole so that arc gas within the arc-extinguishing chamber S is released to the outside, the internal pressure of the arc-extinguishing chamber S is reduced, and flying-off of the arc-extinguishing cover 6*c* is prevented.

In this way, in the electromagnetic contact device 1*a* of this embodiment comprising the upper case 6*b* and arc-extinguishing cover 6*c*, a gas escape hole communicating between the arc-extinguishing chamber S and the outside is not provided, so that in the case of normal operation slight amounts of dust cannot intrude into the arc-extinguishing chamber S which is a sealed space, and erroneous operation of contact points of the contact point portion 7 can be reliably prevented, so that the reliability of contact of the contact point portion 7 can be enhanced.

Further, in this embodiment the arc-extinguishing cover 6*c* is mounted on the upper case 6*b* with sites of strong latching force and weak latching force with the upper case 6*b* provided, so that when arc gas causes the internal pressure of the arc-extinguishing chamber S to rise excessively, the engaged state of the sites with weak latching force are disengaged first, and a gap 70 serving as a gas escape hole is formed, so that by reducing the internal pressure of the arc-extinguishing chamber S, flying-off of the arc-extinguishing cover 6*c* can be reliably prevented.

The arc-extinguishing cover 6*c* of this embodiment has a structure such that, by rotation about the bosses 66, the other short-edge wall portion 63 rises up slightly, to an extent sufficient to provide a gas escape gap 70, and the arc-extinguishing cover 6*c* is not damaged, so that component costs can be reduced.

On the other hand, FIG. 46 to FIG. 50 show the structure of the arc-extinguishing cover 6*c* mounted on the upper case 6*b* in another embodiment.

Figure 46:
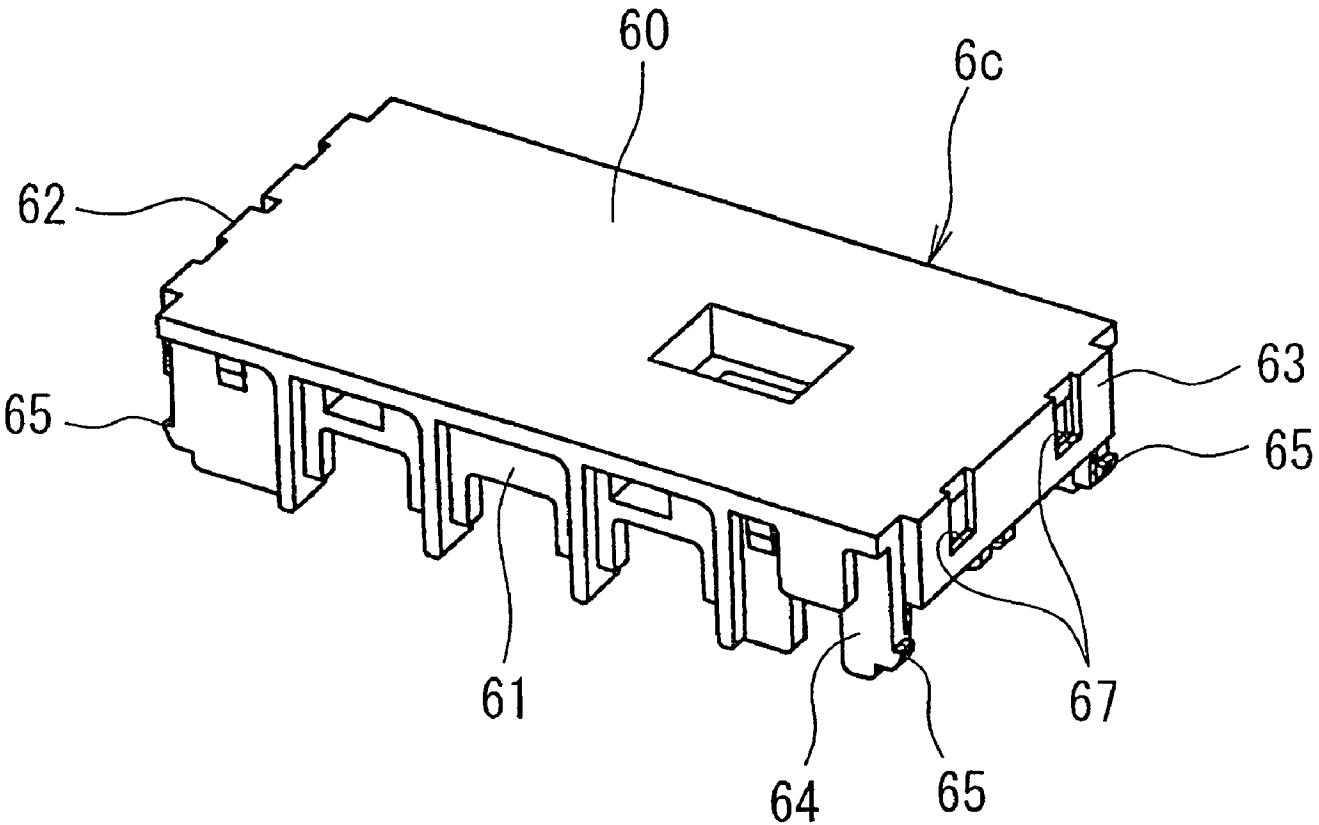
FIG. 46 is a perspective view showing the structure of the arc-extinguishing cover in the second embodiment of the invention.
Figure 47:
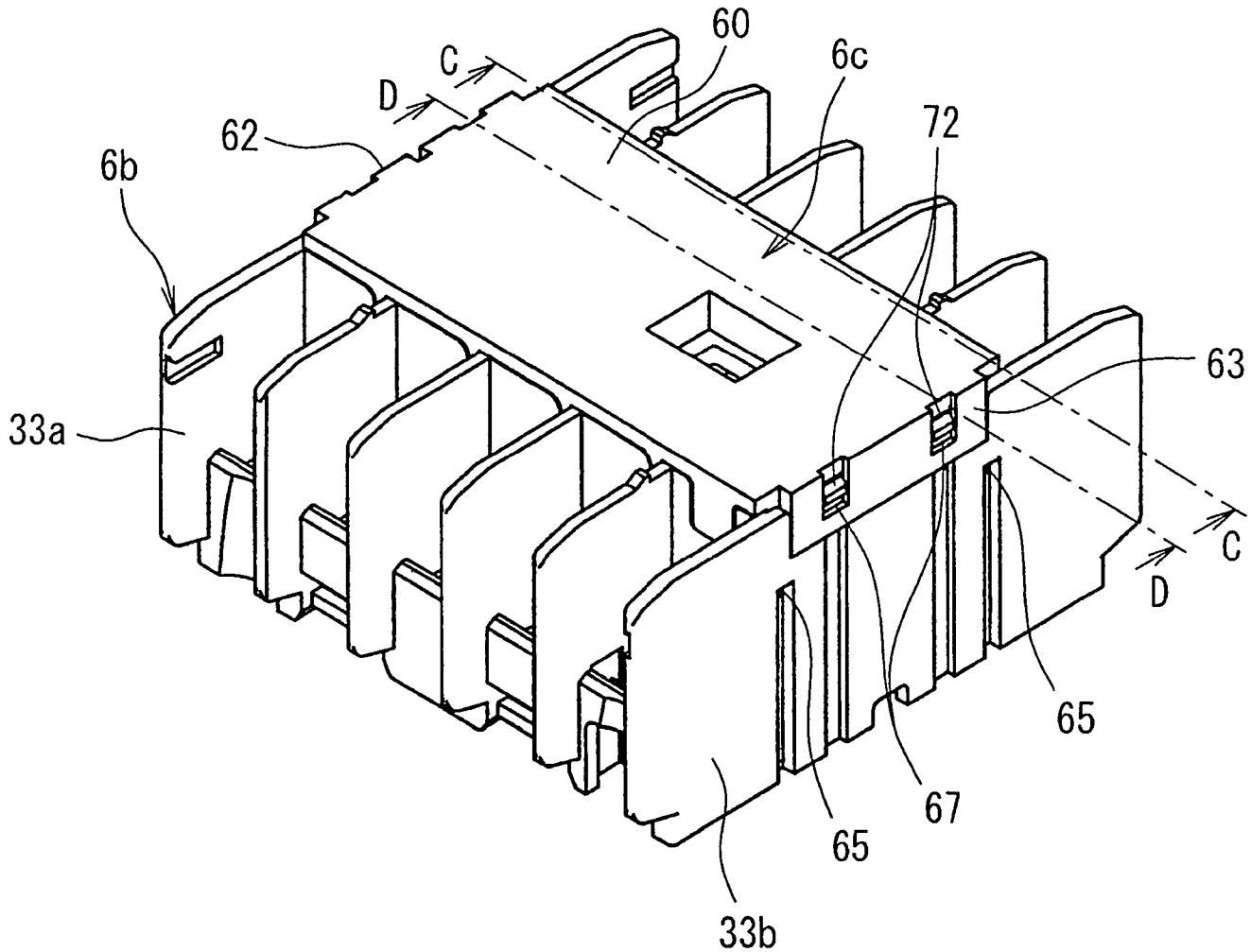
FIG. 47 shows a state in which the arc-extinguishing cover is mounted on the upper case in the second embodiment.
Figure 48:
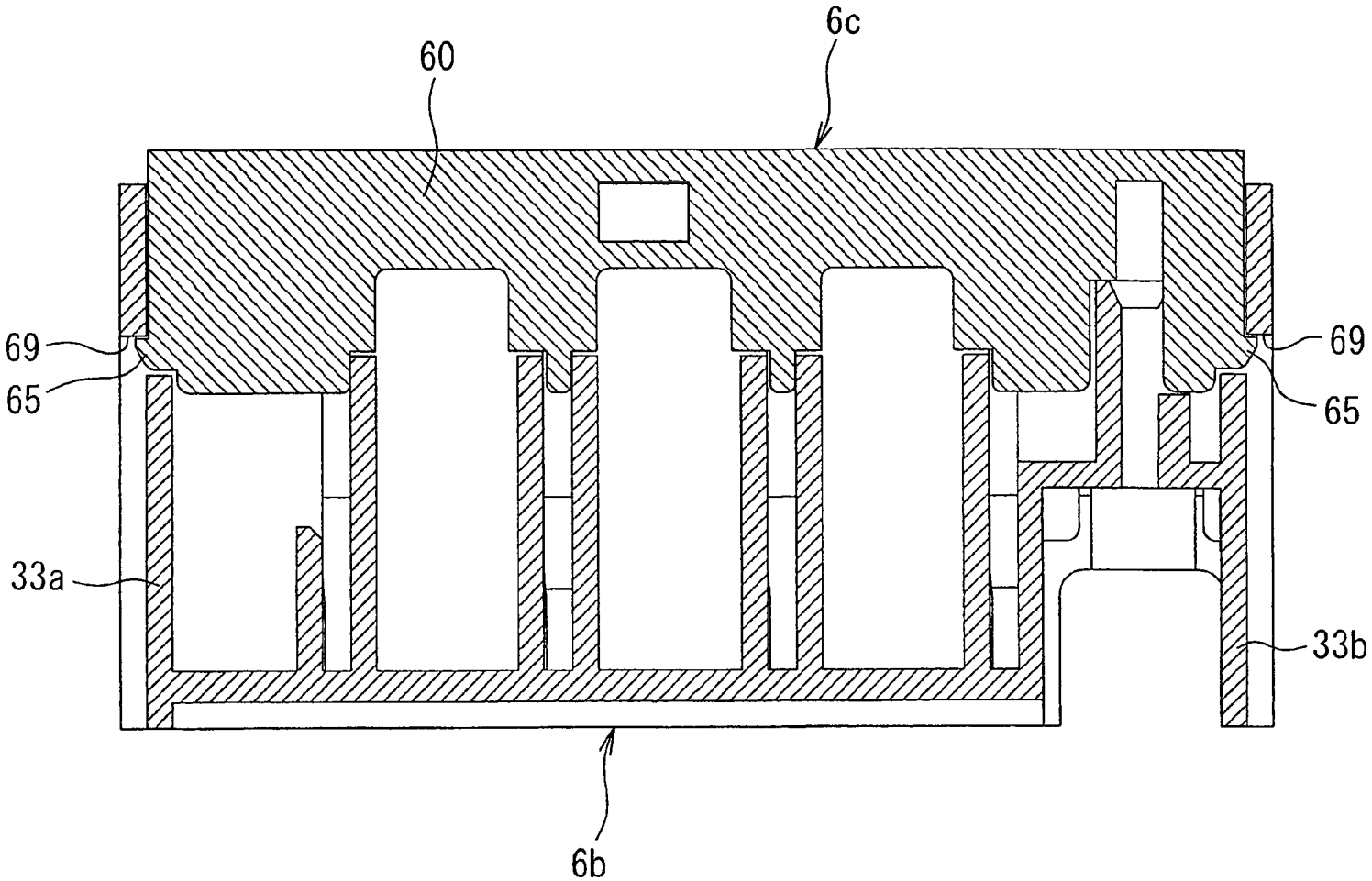
FIG. 48 is view C-C in FIG. 47.
Figure 49:
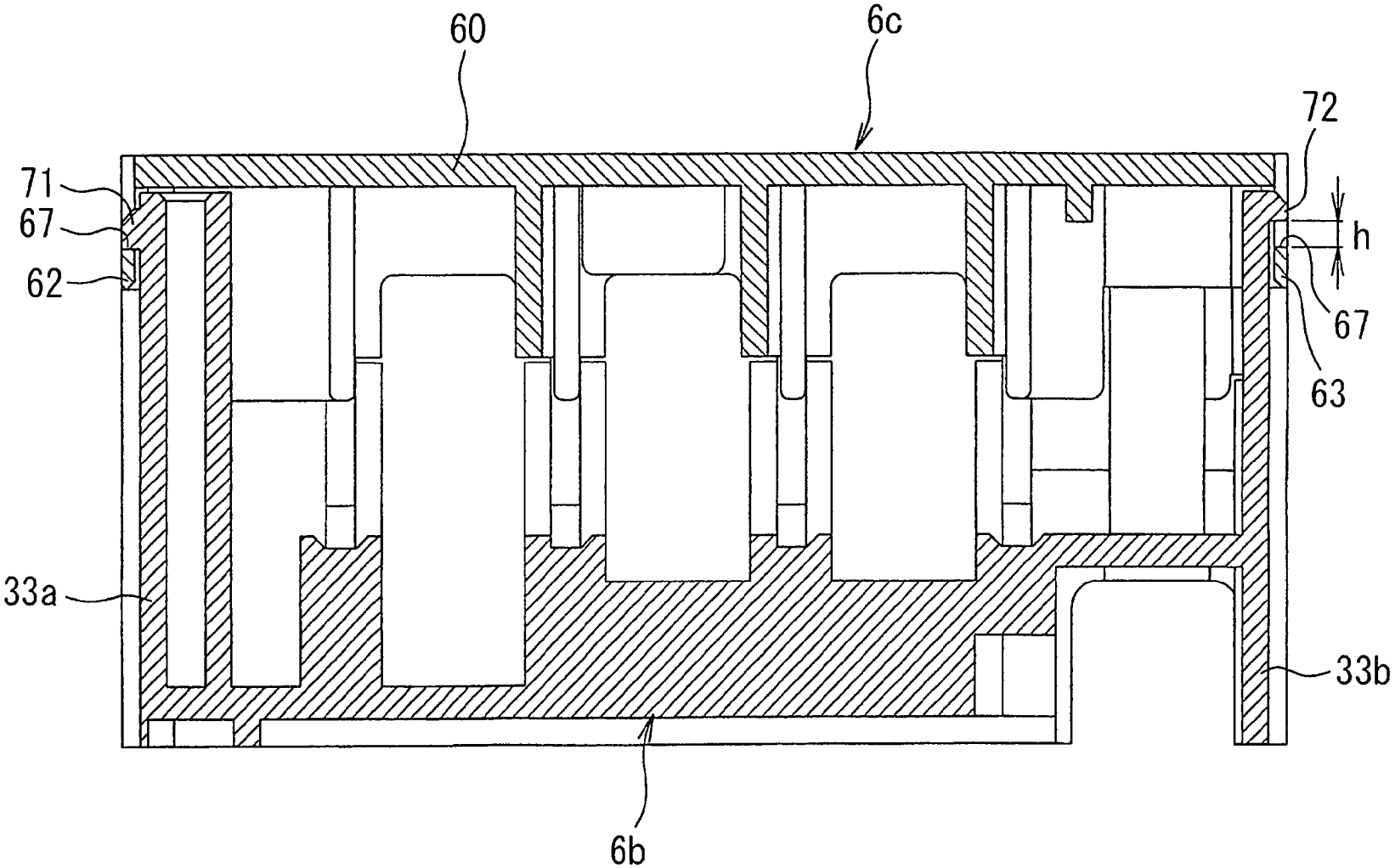
FIG. 49 is view D-D in FIG. 47.

As shown in FIG. 46 and FIG. 48, a pair of hook portions 65 is formed at both ends of each of the pair of short-edge wall portions 62, 63 forming the arc-extinguishing cover 6*c* of this embodiment, in proximity to the long-edge wall portions 61, and as shown in FIG. 47 and FIG. 49, a pair of engaging holes 67 is formed between the pair of hook portions 65.

Further, as shown in FIG. 48, a pair of engaging holes 69 which engage with the pair of hook portions 65 of the arc-extinguishing cover 6*c* is formed on the pair of case outer walls 33*a*, 33*b*. Further, as shown in FIG. 49, a pair of first case-side hook portions 71, which engages with the pair of engaging holes 67 in one short-edge wall portion 62, is formed on the upper-end portion of one case outer wall 33*a*, positioned between the pair of engaging holes 69. And, as shown in FIG. 47 and FIG. 49, a pair of second case-side hook portions 72, which enters into the pair of engaging holes 67 in the other short-edge wall portion 63, is formed on the upper-end portion of the other case outer wall 33*b*, positioned between the pair of engaging holes 69.

And, the arc-extinguishing cover 6*c* of this embodiment is directed toward the arc-extinguishing chamber S of the upper case 6*b* and mated. At this time, the pair of long-edge wall portions 61 slides against the partitioning wall 38 of the upper case 6*b* and enter into the arc-extinguishing chamber S, and the hook portions 65 formed on the pair of short-edge wall portions 62, 63 are engaged with all the engaging holes 69 in the pair of case outer walls 33*a*, 33*b*. And, the pair of first case-side hook portions 71 formed in one case outer wall 33*a* of the upper case 6*b* is engaged with one pair of engaging holes 67 of the one short-side wall portion 62. Here, as shown in FIG. 49, the pair of second case-side hook portions 72 formed on the other case outer wall 33*b* of the upper case 6*b* is arranged in a state with a gap of prescribed height "h" provided with the lower face of the pair of engaging holes 67 of the other short-edge wall portion 63. By this means, as shown in FIG. 47, the arc-extinguishing cover 6*c* is mounted on the upper case 6*b* in a state in which the arc-extinguishing chamber S is sealed.

Suppose that, in the electromagnetic contact device 1*a* comprising the upper case 6*b* and arc-extinguishing cover 6*c* with the above configuration also, an anomalous large current flowed in the contact point portion 7 due to a short-circuit accident or similar, and the generated arc gas caused an excessive rise in the internal pressure in the arc-extinguishing chamber S, so that the arc-extinguishing cover 6*c* attempts to dissociate and rise up from the upper case 6*b*.

In the arc-extinguishing cover 6*c* of this embodiment, hook portions 65 engage with the engaging holes 69 in one of the case outer walls 33*a* on the side of one short-edge wall portion 62, and moreover, engaging holes 67 and first case-side hook portions 71 on one of the case outer walls 33*a* are engaged; and hook portions 65 and engaging holes 69 in the other case outer wall 33*b* are engaged on the side of the other short-edge wall portion 63, but the second case-side hook portions 72 are arranged to provide a gap with the engaging holes 67, in a structure such that the latching force with the upper case 4 on the side of the other short-edge wall portion 63 is weaker than the latching force with the upper case 4 on the side of the one short-edge wall portion 62.

Figure 50:
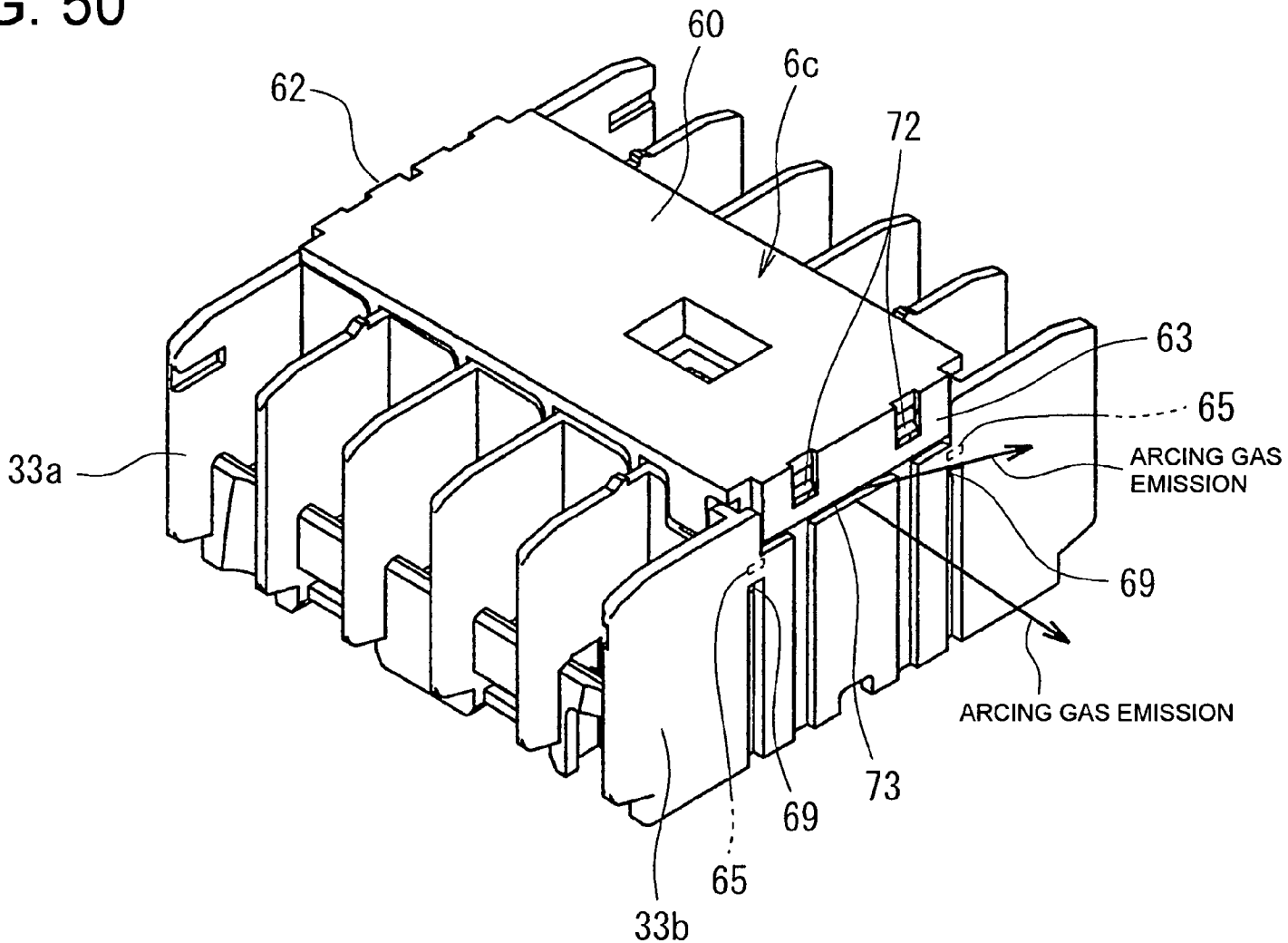
FIG. 50 shows a state in which the internal pressure in the arc-extinguishing chamber is raised in the second embodiment.

For this reason, as shown in FIG. 50, when the internal pressure of the arc-extinguishing chamber S rises excessively, the engaged state between the hook portions 65 on the side of the other short-edge wall portion 63 of the arc-extinguishing cover 6*c* and the engaging holes 6 the arc-extinguishing cover 6*c* is disengaged before the side of the one short-edge wall portion 62, and the side of the other short-edge wall portion 63 rises up.

When the other short-edge wall portion 63 rises up, the engaging holes 67 which had provided a gap with the second case-side hook portions 72 of the other case outer wall 33*b* are engaged with the second case-side hook portions 72, and so a gap 73 is formed between the lower-end face of the other short-edge wall portion 63 and the upper-end face of the case outer wall 33*b*, and this gap 73 serves as a gas escape hole so that arc gas within the arc-extinguishing chamber S is released to the outside, the internal pressure of the arc-extinguishing chamber S is reduced, and flying-off of the arc-extinguishing cover 6*c* is prevented.

In this way, in the electromagnetic contact device 1*a* of this embodiment comprising the upper case 6*b* and arc-extinguishing cover 6*c*, a gas escape hole communicating between the arc-extinguishing chamber S and the outside is not provided, so that in the case of normal operation slight amounts of dust cannot intrude into the arc-extinguishing chamber S which is a sealed space, and erroneous operation of contact points of the contact point portion 7 can be reliably prevented, so that the reliability of contact of the contact point portion 7 can be enhanced.

Further, in this embodiment the arc-extinguishing cover 6*c* is mounted on the upper case 6*b* with sites of strong latching force and weak latching force with the upper case 6*b* provided, so that when arc gas causes the internal pressure of the arc-extinguishing chamber S to rise excessively, the engaged state of the sites with weak latching force are disengaged first, and a gap 73 serving as a gas escape hole is formed, so that by reducing the internal pressure of the arc-extinguishing chamber S, flying-off of the arc-extinguishing cover 6*c* can be reliably prevented.

Also, the arc-extinguishing cover 6*c* of this embodiment has a structure in which, by engagement of the second case-side hook portions 72 of the other case outer wall 33*b* and the engaging holes 67 in the other short-side wall portion 63, the side of the other short-edge wall portion 63 rises up slightly to the extent that a gap 73 serving as a gas escape hole is provided, and the arc-extinguishing cover 6*c* is not damaged, so that component costs can be reduced.

(Structure of the Main Circuit Terminal Portion of the Electromagnet Constructing the Electromagnetic Contact Device)

In the above-described embodiment, electromagnetic contact devices 1*a*, 1*b* accommodating AC-operation type electromagnets 8, as for example shown in FIG. 12, were explained; but the electromagnetic contact devices 1*a*, 1*b* may also accommodate DC-operation type electromagnets with permanent magnets 80, as shown in FIG. 51 to FIG. 66.

Figure 51:
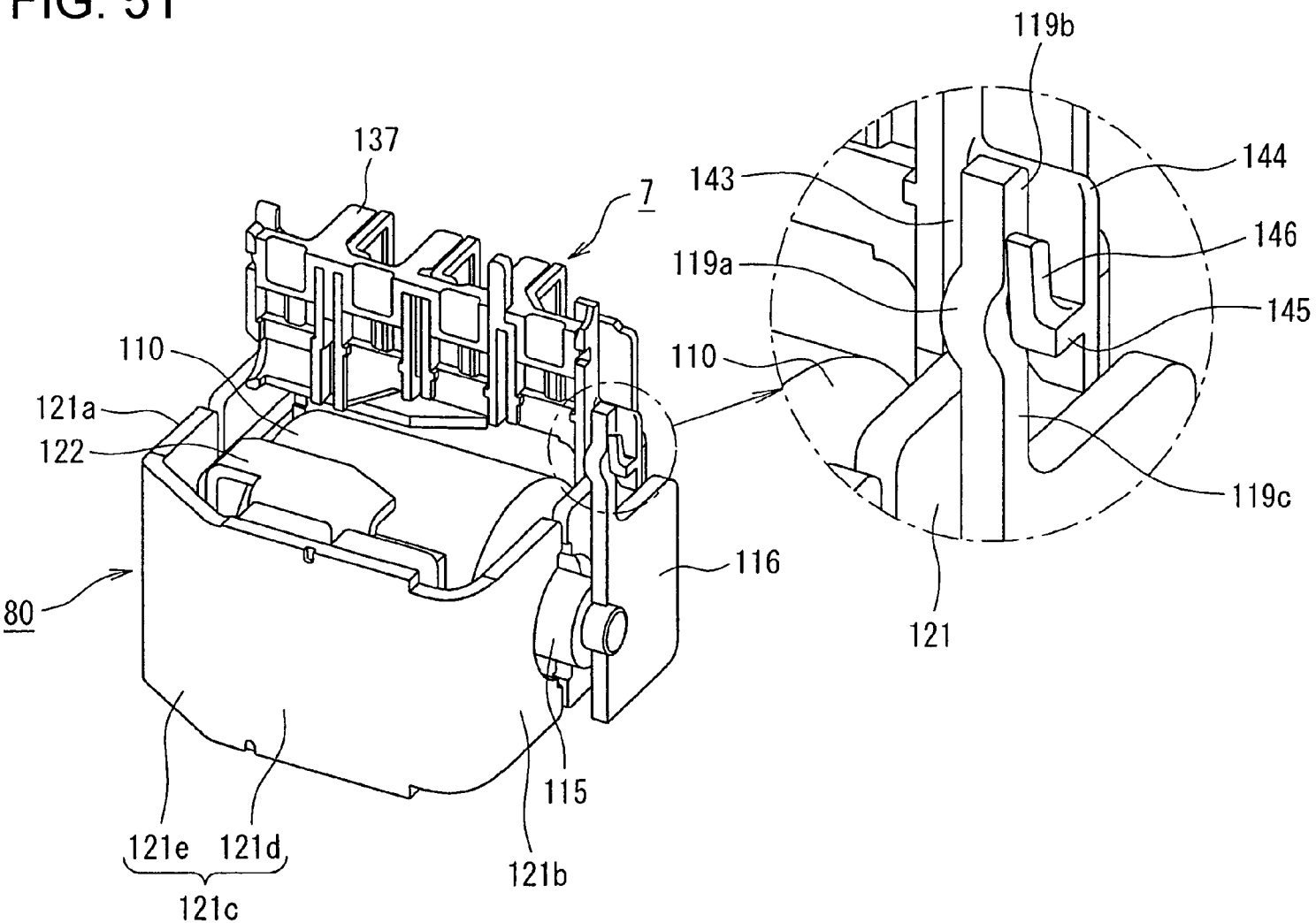
FIG. 51 is a perspective view showing an electromagnet with a permanent magnet as the electromagnet of another embodiment incorporated in an electromagnetic contact device of the invention.
Figure 53:
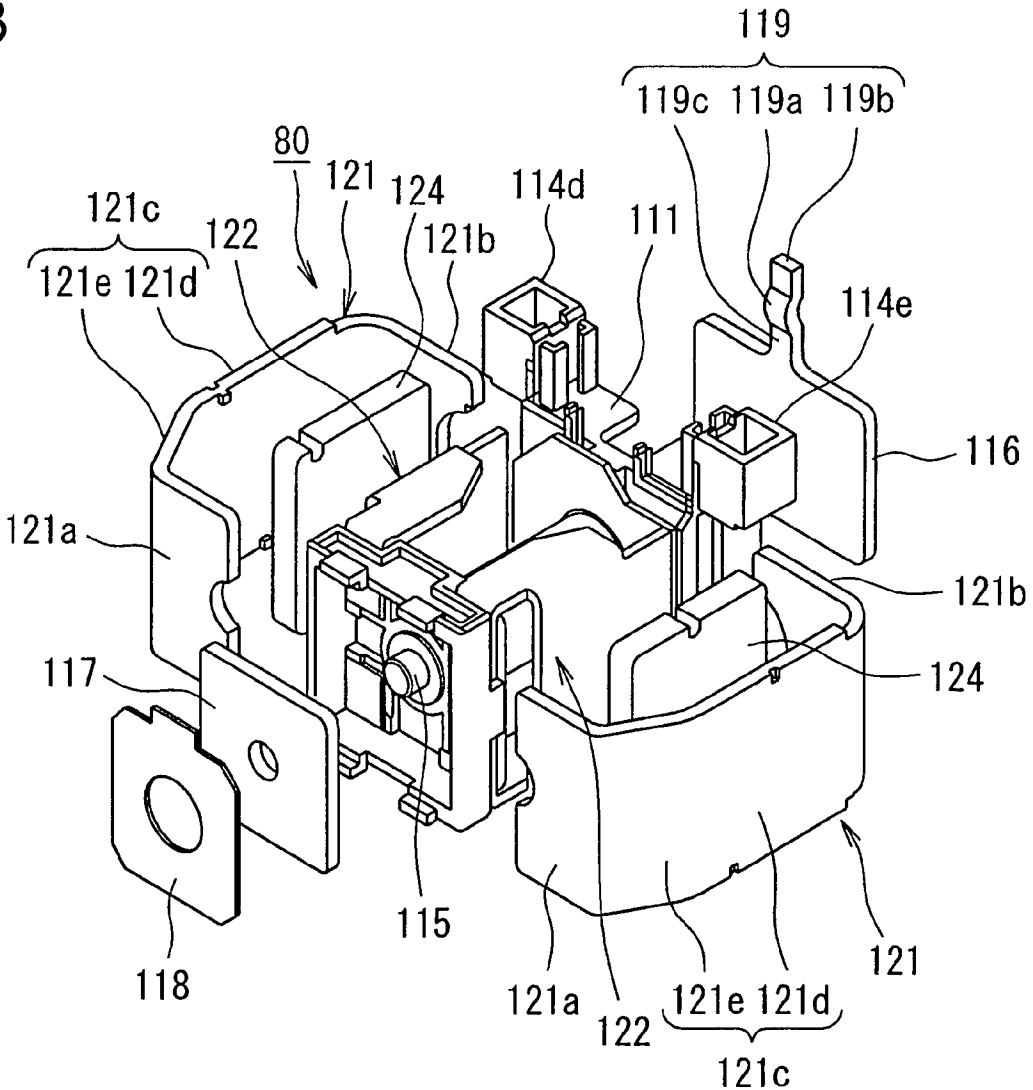
FIG. 53 is an exploded perspective view of an electromagnet with a permanent magnet.
Figure 54:
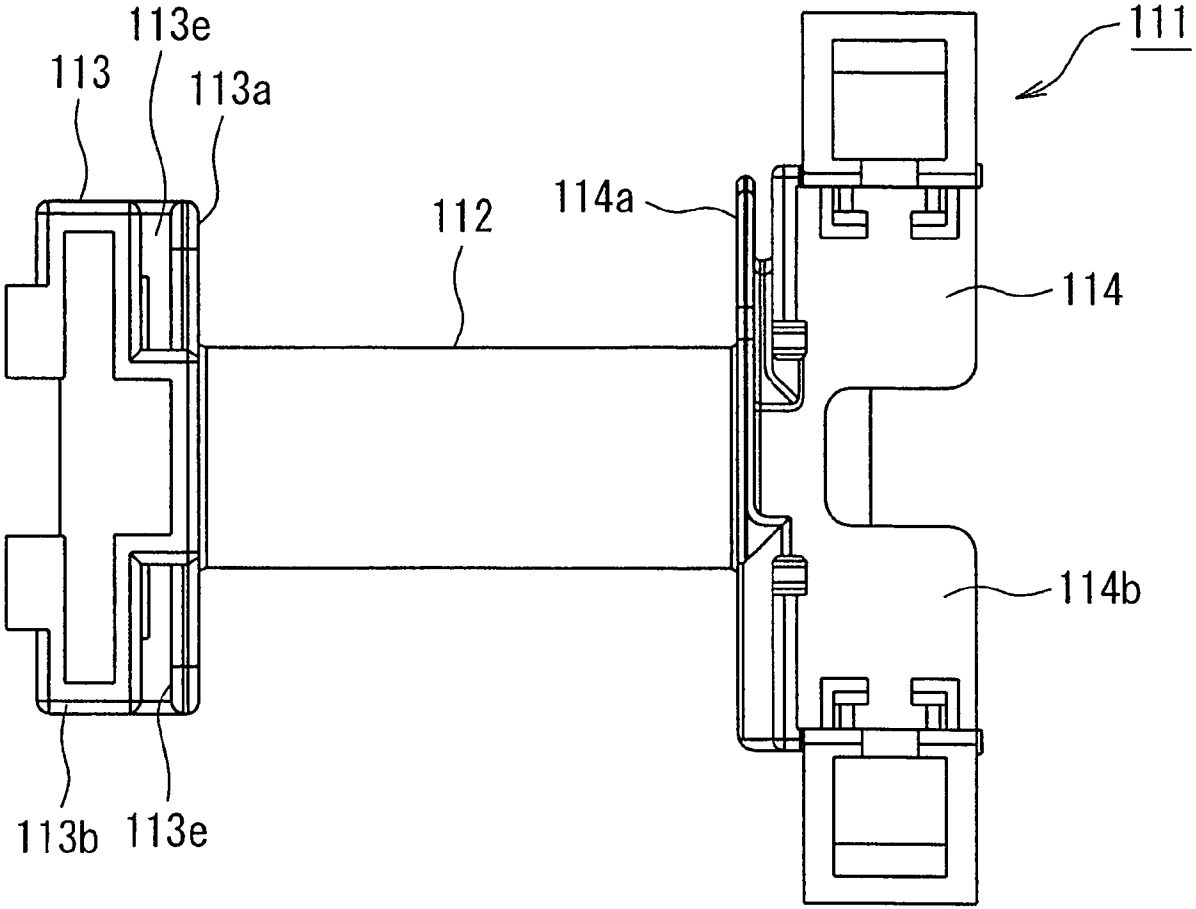
FIG. 54 is a plan view showing a spool configuring an electromagnet with a permanent magnet.
Figure 55:
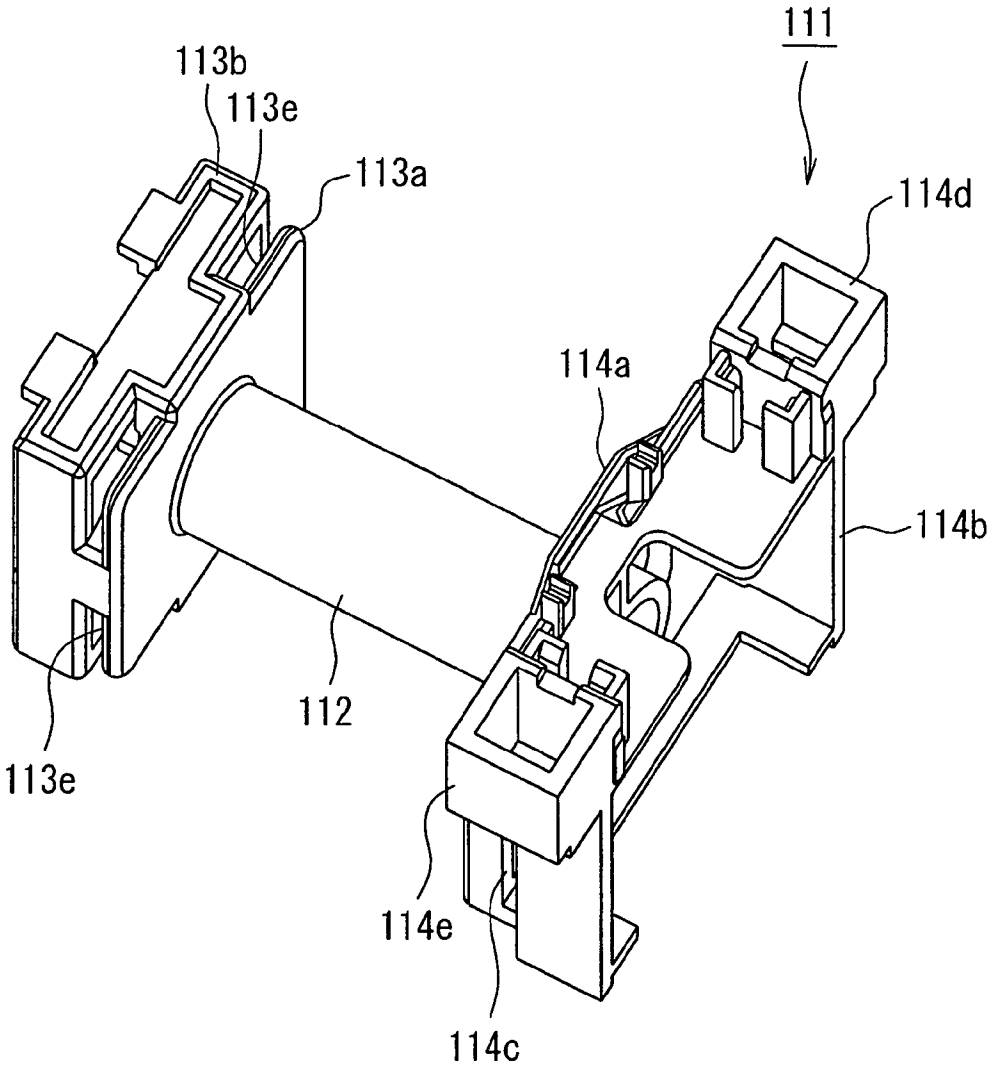
FIG. 55 is a perspective view of a spool seen from the upper-right direction.
Figure 56:
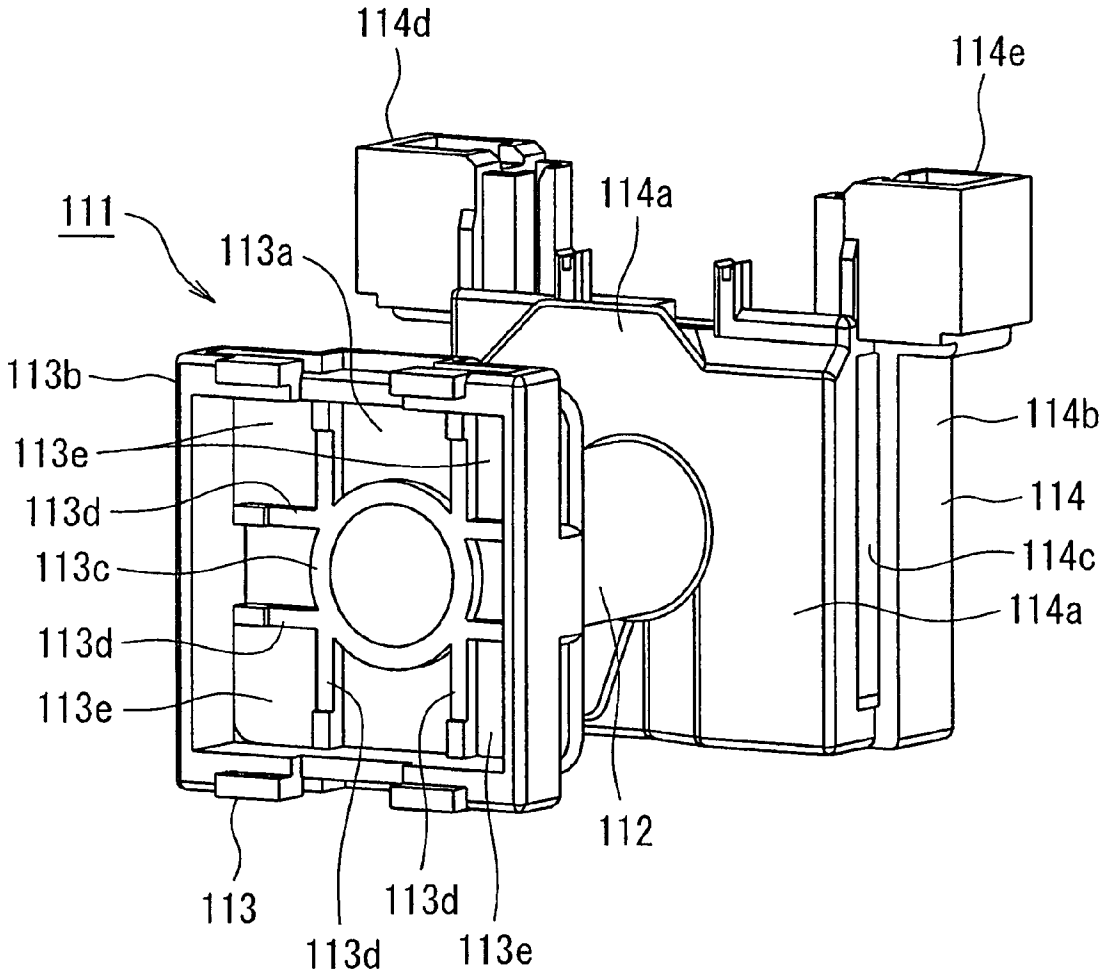
FIG. 56 is a perspective view of a spool seen from a left-lateral direction.
Figure 57:
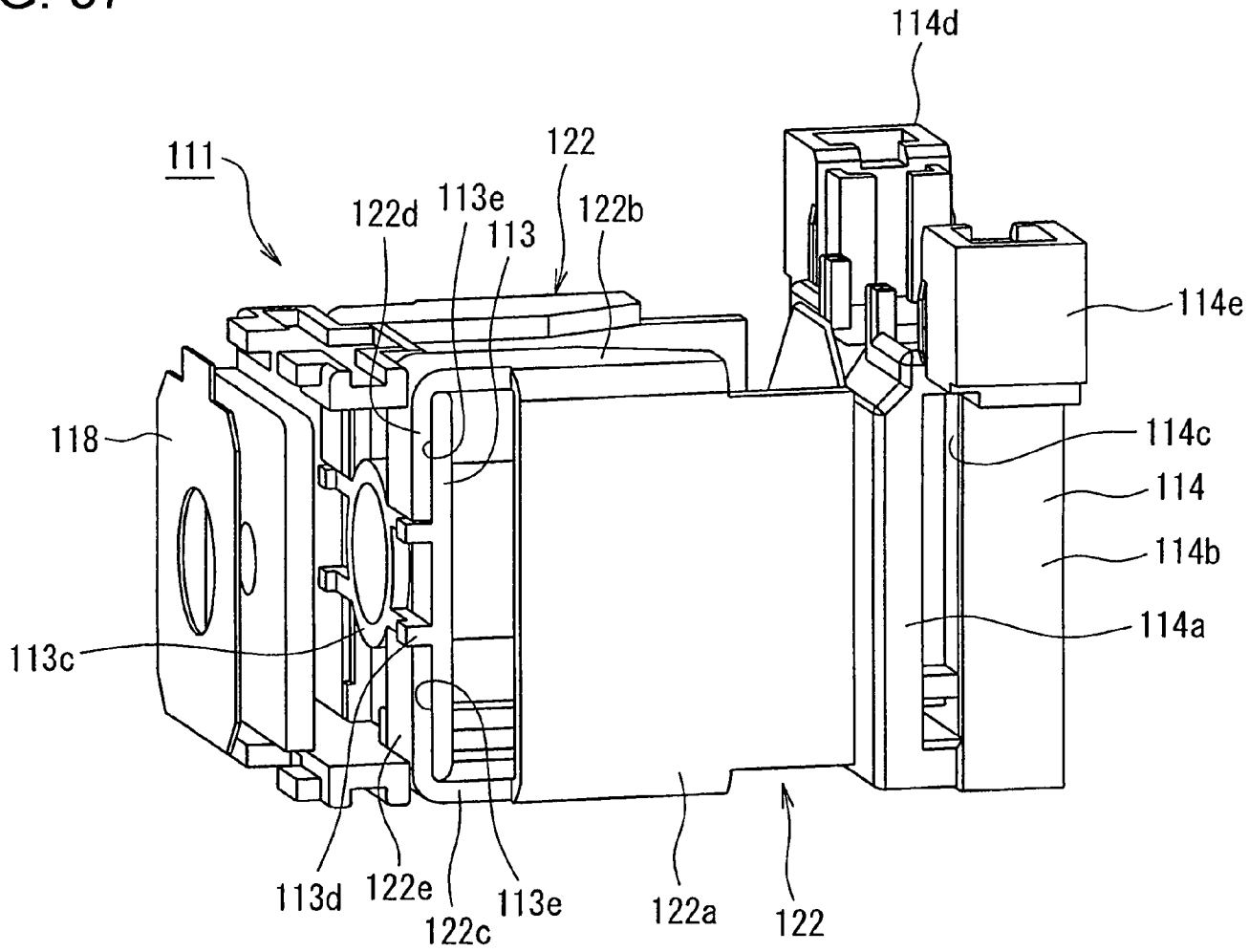
FIG. 57 is a perspective view showing the left-end side of an electromagnet with a permanent magnet.
Figure 58:
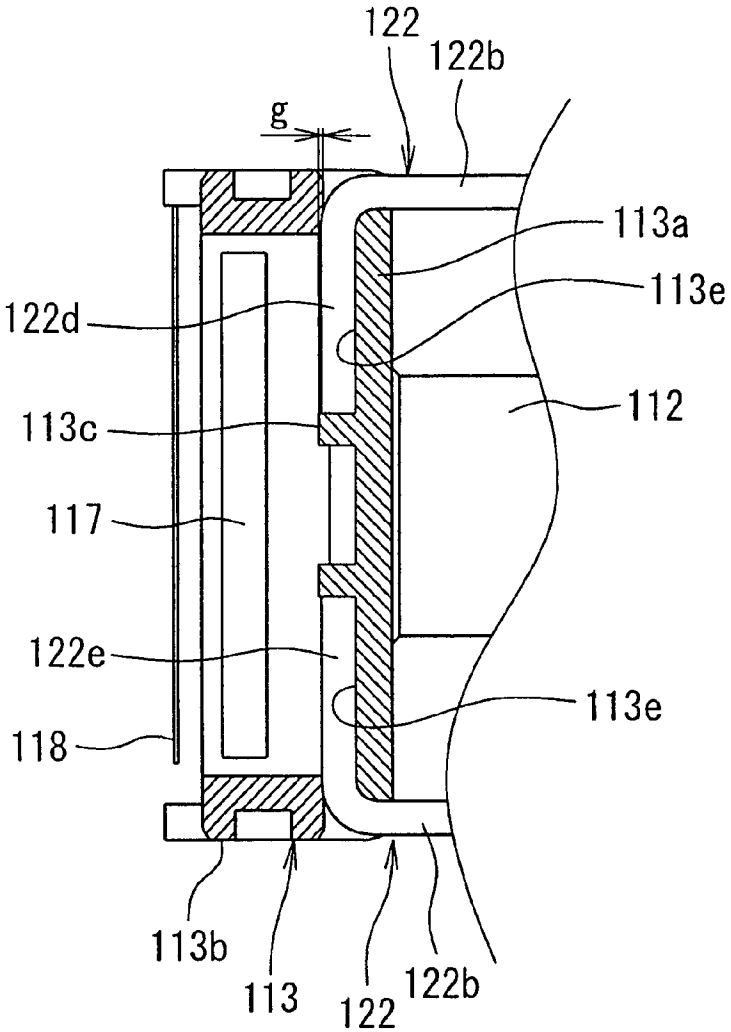
FIG. 58 is an enlarged cross-sectional view showing a state in which an inside yoke is mounted on a spool.

As shown in FIG. 51 and FIG. 53, an electromagnet with permanent magnets 80 has a spool 111 around which is wound an excitation coil 110 constructing the electromagnet. As shown in FIG. 54 to FIG. 57, this spool 111 has a cylinder portion 112, and left and right flanges 113 and 114 on both ends of this cylinder portion 112 and formed integrally. The left flange 113 has a rectangular coil-pressing plate portion 113*a* which restricts the end of the excitation coil 110, and a square-frame shape armature accommodation portion 113*b*, linked to the outside of this coil-pressing plate portion 113*a* at the center positions of each edge. On the outside face of this coil-pressing plate portion 113*a* are formed in protrusion, as shown in FIG. 56, a ring-shape protrusion 113*c* as a protrusion for positioning corresponding to the cylinder portion 112, and a mesh-shape protrusion 113*d* extending outward from this ring-shape protrusion 113*c*. Here, a yoke holding portion 113*e*, which is pushed through and holds second opposing plate portions 122*d* and 122*e* of an inside yoke 122, described below, is formed in four corners demarcated by the mesh-shape protrusion 113*d*.

The right flange 114 has a rectangular coil-pressing plate portion 114*a* which restricts the end of the excitation coil 110, and a rectangular-frame shape armature accommodation portion 114*b*, linked to the outside of this coil-pressing plate portion 114*a* on the outer-periphery side. In the armature accommodation portion 114*b* are formed a yoke holding portion 114*c*, which is pushed through and holds an end plate portion 121*b* of an outside yoke 121, described below, and coil terminal portions 114*d* and 114*e*, which bind the ends of the winding beginning and winding ending of the excitation coil 110, are formed.

Figure 52:
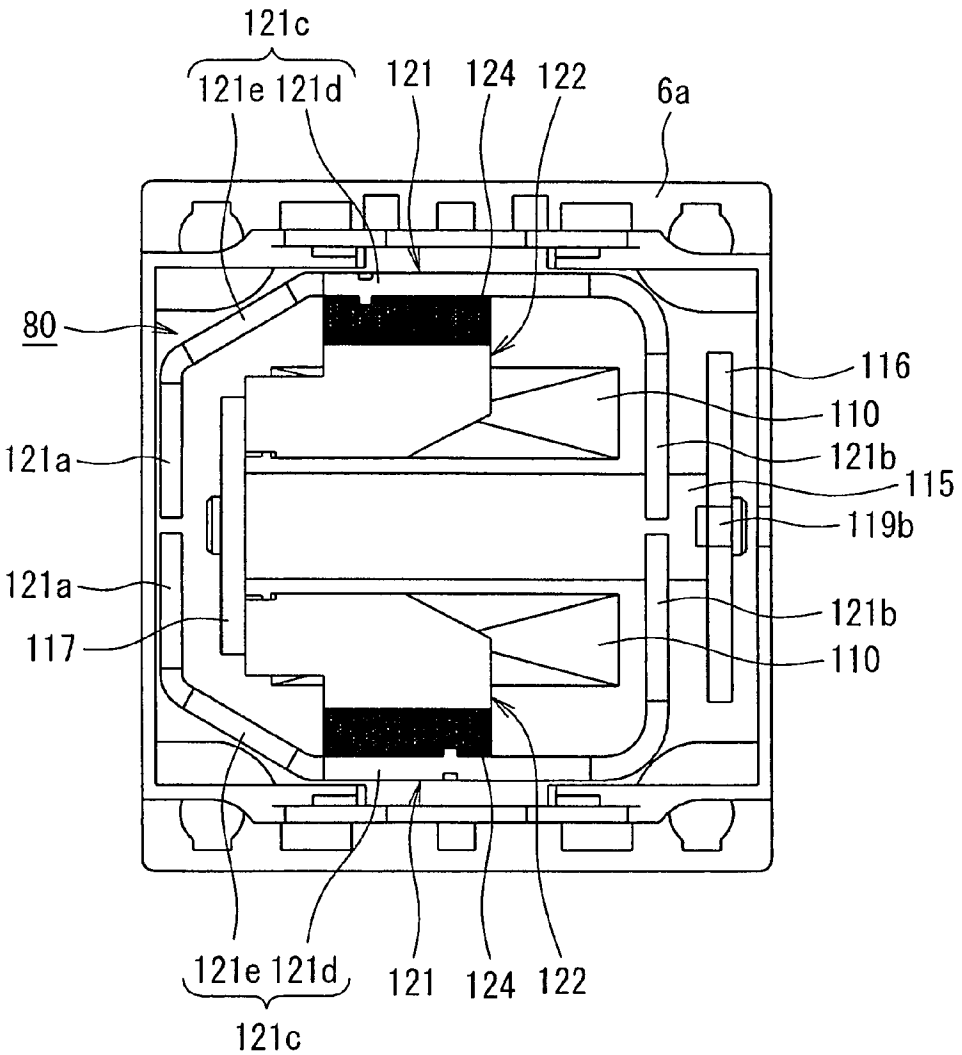
FIG. 52 is a schematic plan view of a lower case in which is accommodated an electromagnet with a permanent magnet.
Figure 60:
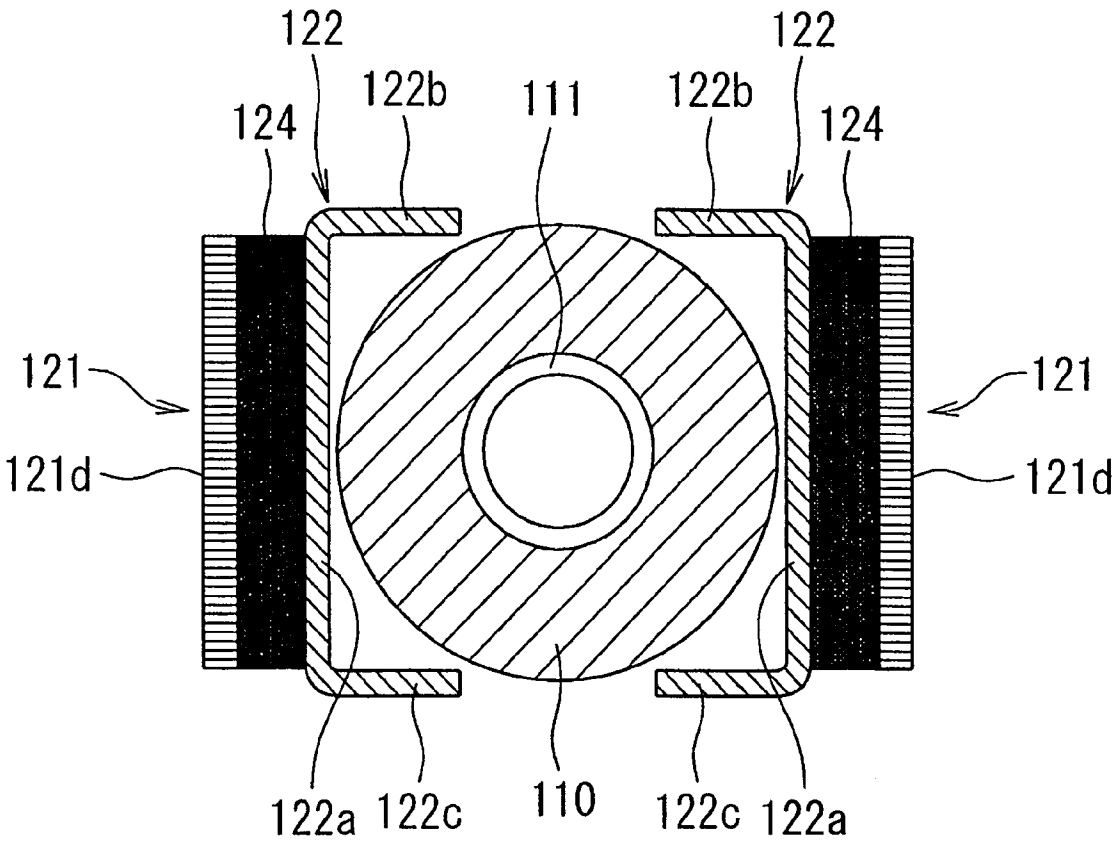
FIG. 60 is a cross-sectional view of an electromagnet with a permanent magnet in a direction perpendicular to the axial direction.

And, as shown in FIG. 52 and FIG. 60, the excitation coil 110 is wound between the cylinder portion 112 and the coil-pressing plate portions 113*a*, 114*a* of the left and right flanges 113, 114 of the spool 111.

Further, a plunger 115 within the cylinder portion 112 of the spool 111 penetrates and is held rotatably. A first armature 116 is fixed to the end corresponding to the inside of the armature accommodation portion 114*b* formed in the right flange 114 of the spool 111 on the right end of this plunger 115. Further, a second armature 117 is fixed at a position corresponding to the inside of the armature accommodation portion 113*b* formed in the left flange 113 of the spool on the left end of this plunger 115, and a nonmagnetic plate 118 is positioned on the outside of this second armature 117. And, on the upper face of the first armature 116 is positioned a driving lever 119 which drives the movable contact point support 137 of the contact point portion 7 in the right-left direction. As shown in enlargement in FIG. 51, this driving lever 119 has a square rod shape, and is formed integrally on the upper face of the first armature 116. Substantially in the center position of this driving lever 119 in the vertical direction, lower by a prescribed distance than the tip at the free end, is formed a curved bulging portion 119*a* which bulges to the left; enclosing this curved bulging portion 119*a* are formed upper and lower vertical rod portions 119*b* and 119*c*.

On the right flange 114 of the spool 111 is positioned, a pair of front and rear outside yokes 121 with axial symmetry, guided within the lower case 6*a* and fixed, and enclosing the spool 111. Further, on the left flange 113 of the spool 111 is positioned, a pair of front and rear inside yokes 122 with axial symmetry, enclosing the spool 111 which maintains a prescribed distance from the outer yokes 121.

Figure 59:
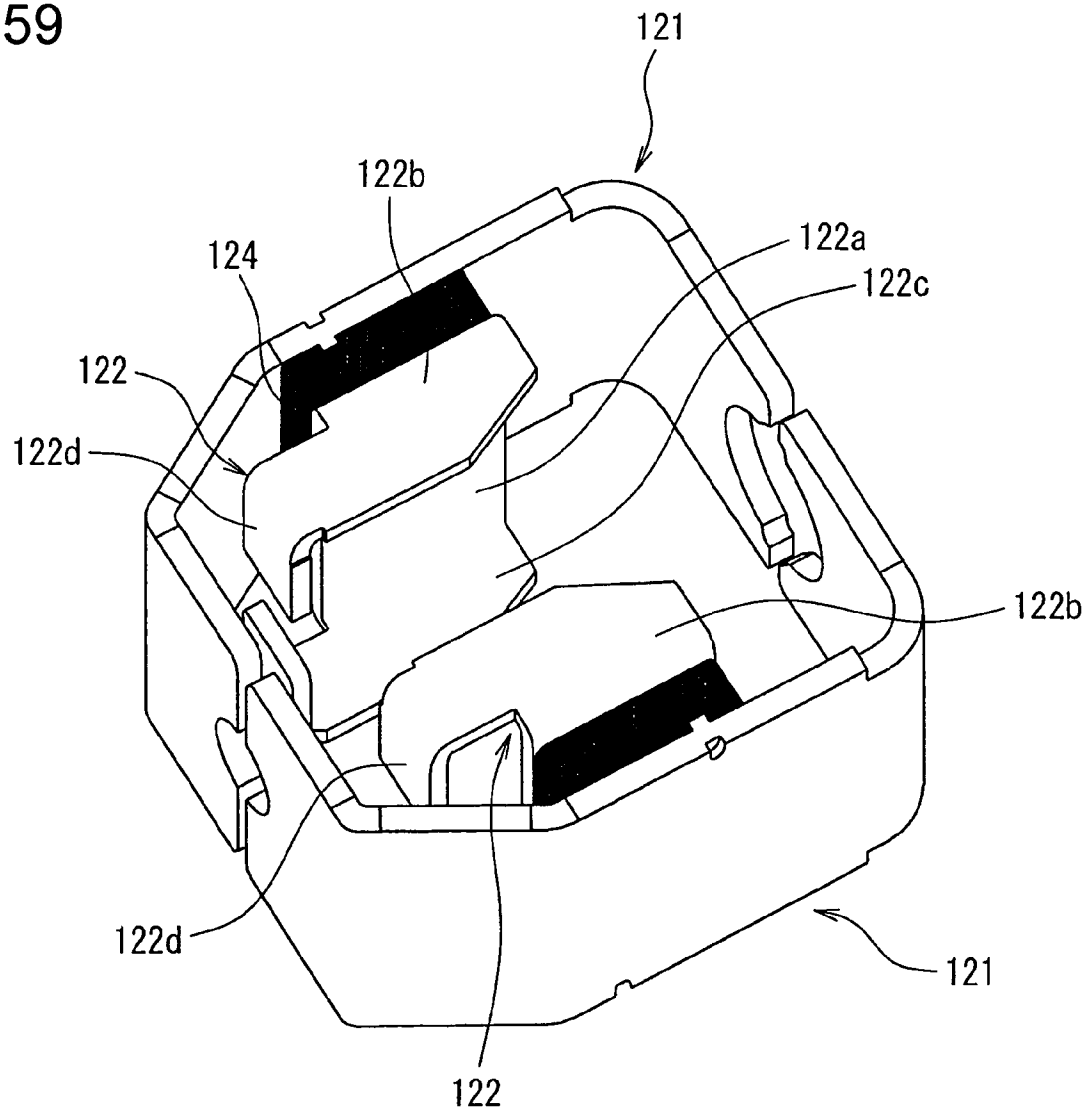
FIG. 59 is a perspective view showing an electromagnet with a permanent magnet in a state with the spool removed.

As is clear from FIG. 52, FIG. 53, and FIG. 59 in particular, the outside yokes 121 are formed in substantially a C-channel shape seen in plan view by a left-end plate portion 121*a*, opposing the left flange 113 of the spool 111 and separated therefrom by a prescribed interval; a right-end plate portion 121*b* pushed through the right flange 114 of the spool 111; and a linking plate portion 121*c*, which links the left and right-end plate portions 121*a* and 121*b*. The linking plate portion 121*c* is formed from a flat plate portion 121*d*, extending in a direction tangential to the excitation coil wound onto the spool 111 linked to the right-end plate portion 121*b*, and an inclined plate portion 121*e* formed on the side of this flat plate portion 121*d* opposite the right-end plate portion 121*b* and inclined inward on moving to the left end; the left-end plate portion 121*a* is linked to the left end of this inclined plate portion 121*e*.

Figure 61:
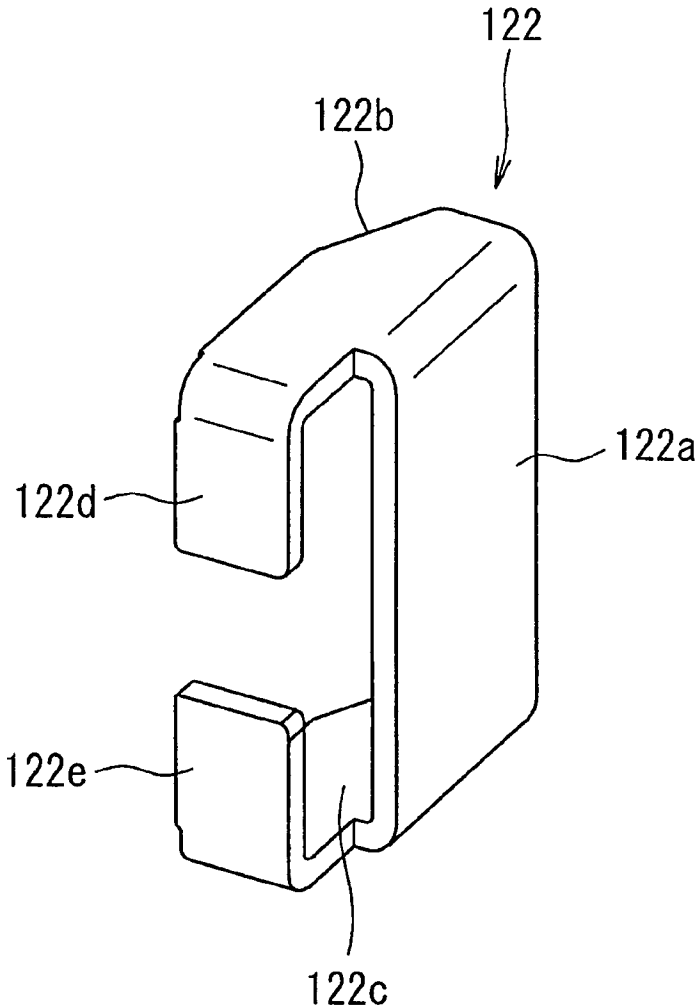
FIG. 61 is a perspective view showing an inside yoke.

On the other hand, as is clear from FIG. 60 and FIG. 61 in particular, the inside yokes 122 have a first opposing plate portion 122*a* opposing the flat-plate portions 121*d* of the outside yokes 121, and bent portions 122*b* and 122*c* extending inwardly and continuous with the upper- and lower-end portions of the first opposing plate portions 122*a* in the tangential direction of the excitation coil 110 wound around the spool 111. And, second opposing plate portions 122*d* and 122*e* are formed to bend inside at the tips of the bent portions 122*b* and 122*c* and protrude from the first opposing plate portions 122*a*. The second opposing plate portions 122*d* and 122*e* of the inside yokes 122 are pushed through and held by the yoke holding portion 113*e* of the left flange 113 of the spool 111, and are opposed by the left-end plate portions 121*a* of the outside yokes 121.

Further, the first armature 116 is arranged on the outside of the right-end plate portion 121*b* of the outside yoke 121, and the second armature 117 is arranged between the left-end plate portion 121*a* of the outside yoke 121 and the second opposing plate portions 22*d* and 22*e* of the inside yoke 122.

Also, permanent magnets 124 are positioned between the flat plate portion 121*d* of the outside yoke 121 and the first opposing plate portion 122*a* of the inside yoke 122.

Figure 62:
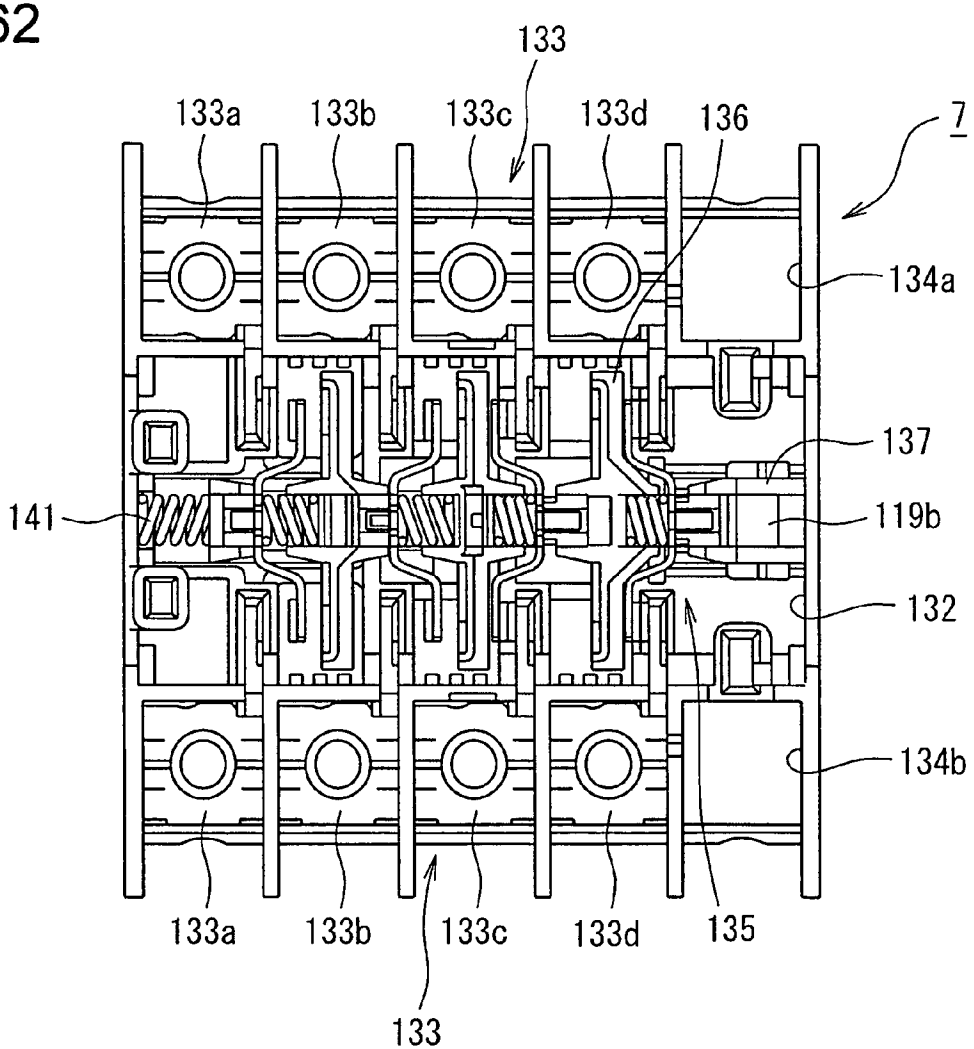
FIG. 62 is a plan view showing a contact point portion.
Figure 63:
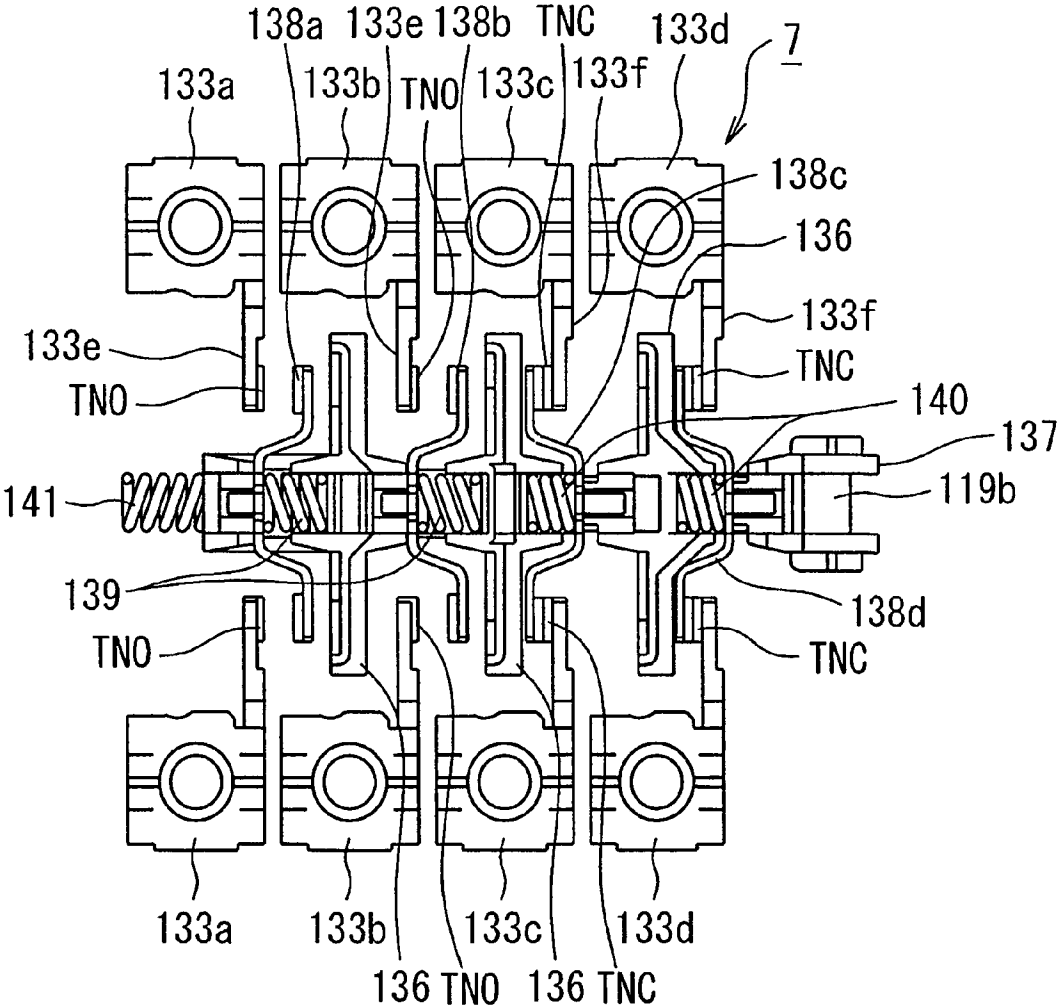
FIG. 63 is a plan view showing a movable contact point portion of a contact point portion.

As shown in FIG. 62 and FIG. 63, the contact point portion 7 has a movable contact point accommodation portion 132 formed in the center of the upper case 6*b* in the front-rear direction and extending in the left-right direction; a main circuit terminal portion 133 positioned enclosing this movable contact point accommodation portion 132 with front-rear symmetry; and terminal push-through portions 134*a* and 134*b* through which the coil terminal portions 114*d* and 114*e* of the electromagnet with permanent magnets 80 are to be pushed.

As shown in FIG. 63, each of the main circuit terminal portions 133 has main circuit terminals 133*a* to 133*d*; the main circuit terminals 133*a* and 133*b* each have a contact point piece 133*e* protruding from the inside right-end side inward into the movable contact point accommodation portion 132, and a fixed contact point TNO is formed on the right-side face of the tip of these contact point pieces 133*e*. Further, the main circuit terminals 133*c* and 133*d* each have a contact point piece 133*f* protruding from the inside right end inward into the movable contact point accommodation portion 132, and a fixed contact point TNC is formed on the left-side face of the tip of these contact point pieces 133*f*.

And, the movable contact point portion 135 is positioned within the movable contact point accommodation portion 132 and slidable in the left-right direction. This movable contact point portion 135 has a movable contact point support 137 in which are formed partition walls 136 of a synthetic resin maintaining a prescribed interval, and movable contact points 138*a* to 138*d* supported between the partition walls 136 of this movable contact point support 137. Here, the movable contact points 138*a* and 138*b* are opposed to the respective fixed contact points TNO of the main circuit terminals 133*a* and 133*b*, and are urged by contact point springs 139 in the left-right direction receding from the partition walls 136. Further, the movable contact points 138*c* and 138*d* are opposed to the respective fixed contact points TNC of the main circuit terminals 133*c* and 133*d*, and are urged by contact point springs 140 in the left-right direction receding from the partition walls 136.

And, the movable contact point support 137 is urged left-right by the return spring 141. One end of this return spring 141 penetrates a left-end plate portion 137*a* and abuts the partition wall 136, and the other end is positioned so as to abut the side wall inner face of the upper case 6*b*, and set such that the free length is in proximity to the open position resulting in the state in which the movable contact points 138*c* and 138*d* formed on the movable contact point support 137 are in contact with the fixed contact points TNC and are pressed with a prescribed pressure by the contact point springs 140.

Figure 64:
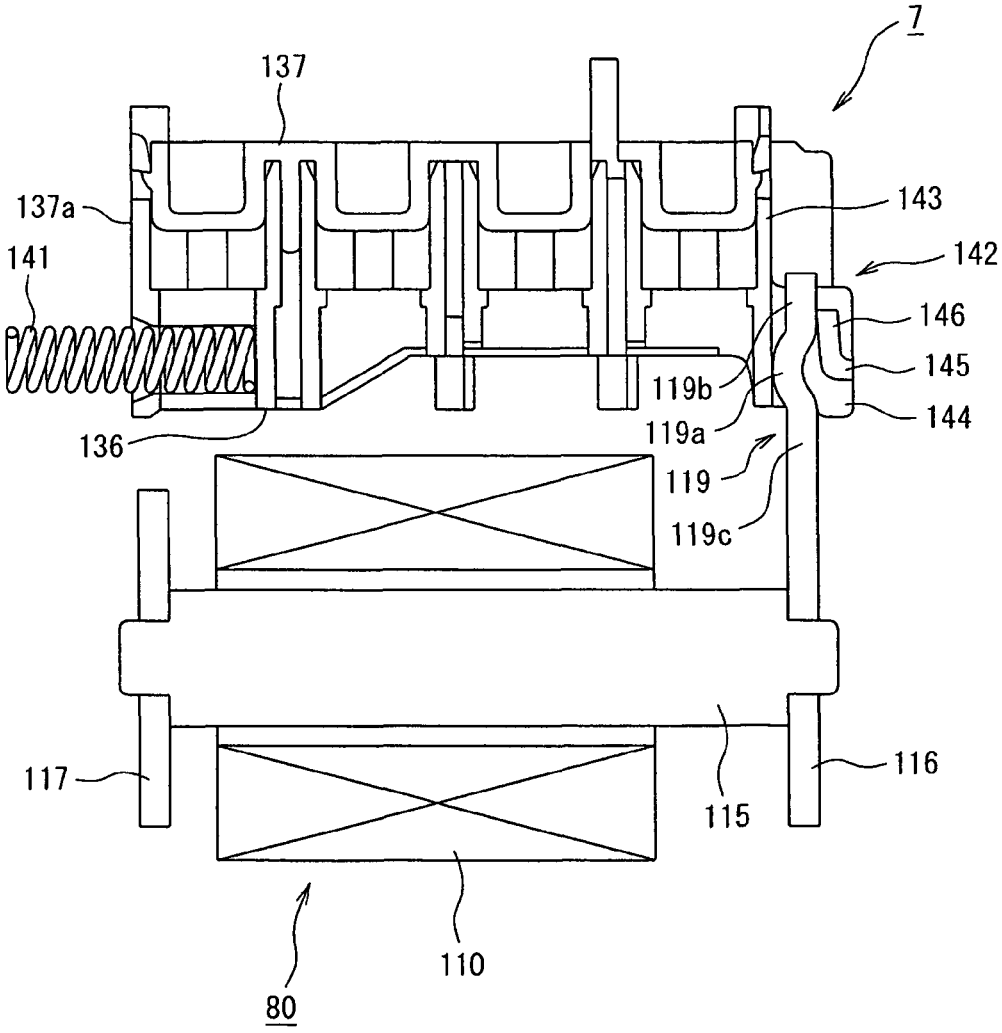
FIG. 64 is a schematic diagram showing the linking relation between an electromagnet with a permanent magnet and a contact point portion.

Further, on the right end of the movable contact point support 137 is formed a linking portion 142 linked to a driving lever 119 formed on the first armature 116 of the electromagnet with permanent magnets 80. As shown in enlargement in FIG. 52, and as shown in FIG. 64, this linking portion 142 has a pair of support plate portions 144 formed on the right-end plate portion 143 of the movable contact point support 137 and formed protruding rightward maintaining a prescribed interval in the front-rear direction; a linking plate 145 which links the right ends of these support plate portions 144; and a lever pressing portion 146 extending inclined to the upper-left from this linking plate portion 145 and having flexibility. The distance between the tip of the lever pressing portion 146 and the right-end face of the right-end plate portion 143 is set to be slightly smaller than the distance between the right-end face of the driving lever 119 and the apex of the curved bulging portion 119*a*.

Hence when the upper case 6*b* holding the contact point portion 7 is mounted on the lower case 6*a* holding the electromagnet with permanent magnets 80, the driving lever 119 and the movable contact point support 137 are linked. Linking of this driving lever 119 is performed by pushing the driving lever 119 from below into the lever accommodation space surrounded by the right-end face of the right-end plate portion 143 of the movable contact point support 137, the pair of support plate portions 144, and the lever pressing portion 146. When the driving lever 119 is pushed through from below into the lever accommodation space, the apex of the curved bulging portion 119*a* of the driving lever 119 contacts with the right-end face of the right-end plate portion 143, the lever pressing portion 146 presses in contact with the right-end face of the upper-end vertical rod portion 119*b*, and the driving lever 119 is press-fit and held in the left-right direction, that is, in both directions of movement of the movable contact point support 137 without the occurrence of a gap.

Figure 65:
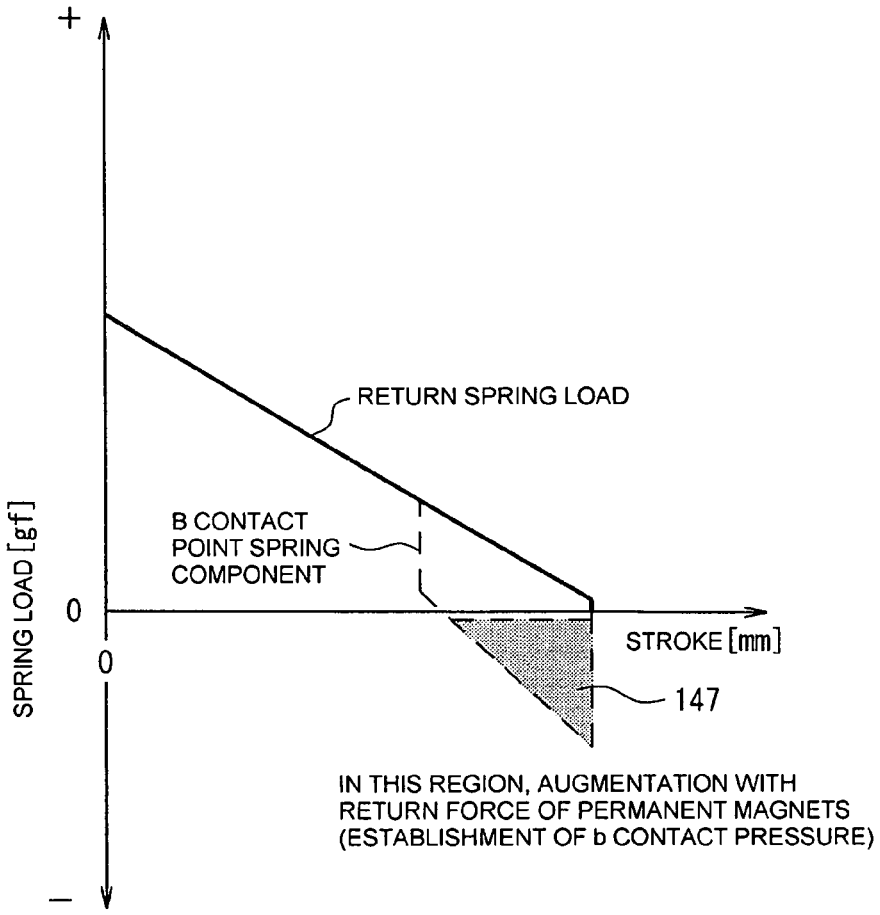
FIG. 65 is a characteristic diagram showing the relation between stroke in the proximity of the open position of an electromagnetic contact device comprising an electromagnet with a permanent magnet and spring load.

Next, operation of the above embodiment is explained. In a state in which current is not passed to the coil terminal portions 114*d* and 114*e*, the excitation coil 110 is in the non-excited state, and a driving force to drive the plunger 115 is not generated. However, in the contact point portion 7, the movable contact point support 137 is urged rightward by the return spring 141, and so the movable contact points 138*c* and 138*d* of the movable contact point support 137 contact with the fixed contact points TNC, and moreover the contact point springs 140 are compressed. At this time, the return spring 141 is set such that when the movable contact point support 137 moves rightward, the contact point springs 140 are compressed, and the movable contact points 138*c* and 138*d* are in a state of contact with the fixed contact points TNC at a prescribed pressure, in proximity to the open position, the return spring 141 is at the natural length. Hence until the movable contact point support 137 moves to the right due to the return spring 141, and the movable contact points 138*c* and 138*d* contact with the fixed contact points TNC and the two contact point springs 140 are compressed, the movable contact point support 137 is moved smoothly to the right under the spring load of the return spring 141. However, as shown in FIG. 65, immediately before reaching the open position, the spring load of the return spring 141 coincides with the spring load, indicated by the dashed line, of the two contact point springs 140, and further compression of the contact point springs 140 is no longer possible.

On the other hand, in the electromagnet with permanent magnets 80, by transmitting the magnetic force of the permanent magnets 124 via the inside yoke 122 to the second opposing plate portions 122*d* and 122*e*, these second opposing plate portions 122*d* and 122*e* cause the second armature 117 to be attracted from immediately before the contact point springs 140 can no longer be compressed by the return spring 141 before reaching the open position, or from before this. As a result, the return force in the region 147, rendered in gray in FIG. 65, is augmented by the permanent magnets 124. Hence the contact point springs 140 are compressed by the attractive force due to the permanent magnets 124, and the movable contact points 138*c* and 138*d* are reliably returned to the open position in contact with the fixed contact points TNC with a prescribed pressure. At this time, as explained above, the tip of the driving lever 119 formed integrally with the first armature 116 is press-fit to and held by the linking portion 142 formed in the movable contact point support 137 of the contact point portion 7. Hence an attractive force on the second armature 117 generated by the permanent magnets 124 is transmitted without loss to the movable contact point support 137 via the plunger 115, first armature 116, and driving lever 119. By this means, the movable contact point support 37 reliably returns to the open position. In this open position, the movable contact points 138*a* and 138*b* are separated from the fixed contact points TNO of the main circuit terminals 133*a* and 133*b*.

From the state in which the movable contact point portion 135 of this contact point portion 7 is in the open position, by passing current between the coil terminal portions 114*d* and 114*e*, the excitation coil 110 is excited with polarity opposite that of the permanent magnets 124. By this means, an attractive force acts between the right and left armatures 117 and 116 and the right- and left-end plate portions 121*a* and 121*b* of the outer yoke 121. Simultaneously with this, a repelling force acts between the left-side armature 117 and the second opposing plate portions 122*d* and 122*e* of the inside yoke 122. Hence, the plunger 115 moves left in resistance to the spring force of the return spring 141, and the armatures 117 and 116 are attracted to and contact with the left- and right-end plate portions 121*a* and 121*b* of the outside yoke 121. Hence via the driving lever 119 of the first armature 116, the movable contact point support 137 of the movable contact point portion 135 moves left in resistance to the return spring 141, and the movable contact points 138*a* and 138*b* enter the closed position and contact with the fixed contact points TNO of the main circuit terminals 133*a* and 133*b* at a prescribed pressing force of the contact point springs 139. Through leftward movement of this movable contact point support 137, the movable contact points 138*c* and 138*d* are separated from the fixed contact points TNC of the main circuit terminals 133*c* and 133*d*.

Further, in the state in which the contact point portion 7 is at the closed position, when current to the coil terminal portions 114*d* and 114*e* is cancelled, the excitation coil 110 returns to the non-excited state, and due to the pressing force of the return spring 141 and with the second armature 117 attracted by the attractive force of the second opposing plate portions 122*d* and 122*e* of the inside yoke 122 due to the permanent magnets 124, the movable contact point support 137 of the movable contact point portion 135 returns to the above-described open position.

At this time in the electromagnet with permanent magnets 80, if for example magnetic flux from the permanent magnets 124 is such that the polarity is N at the inside yoke 122 and S at the outside yoke 121, then a magnetic flux path is formed in which magnetic flux leaving the N pole passes from the first opposing plate portion 122*a* of the inside yoke 122, through the bent portions 122*b* and 122*c*, to reach the second opposing plate portions 122*d* and 122*e*, and from these second opposing plate portions 122*d* and 122*e* passes through the left-end plate portion 121*a*, inclined plate portion 121*e* and flat plate portion 121*d* of the outside yoke 121, to reach the S poles of the permanent magnets 124.

At this time, as shown in FIG. 52, there are almost no places at which the outside yoke 121 and inside yoke 122 are in mutual proximity and opposed, and the left-end plate portion 121*a* of the outside yoke 121 and the second opposing plate portions 122*d* and 122*e* of the inside yoke 122, which require an attractive force, are in proximity and opposed. Hence there is no formation of a magnetic flux leakage portion due to the proximity between the outside yoke 121 and inside yoke 122, leakage magnetic flux can be reduced, and the attractive force at the second opposing plate portions 122*d* and 122*e* of the inside yoke 122 can be increased.

The second opposing plate portions 122*d* and 122*e* of the inside yoke 122 are linked to the first opposing plate portion 122*a* in contact with the permanent magnets 124 via the bent portions 122*b* and 122*c*, so that as shown in FIG. 60, these bent portions 122*b* and 122*c* can be arranged using the dead space in the four corners on the outer periphery of the cylinder-shape excitation coil 110, and so the external shape of the inside yoke 122 can be kept unchanged from examples of the prior art, and increases in size of the overall configuration can be avoided.

Figure 66:
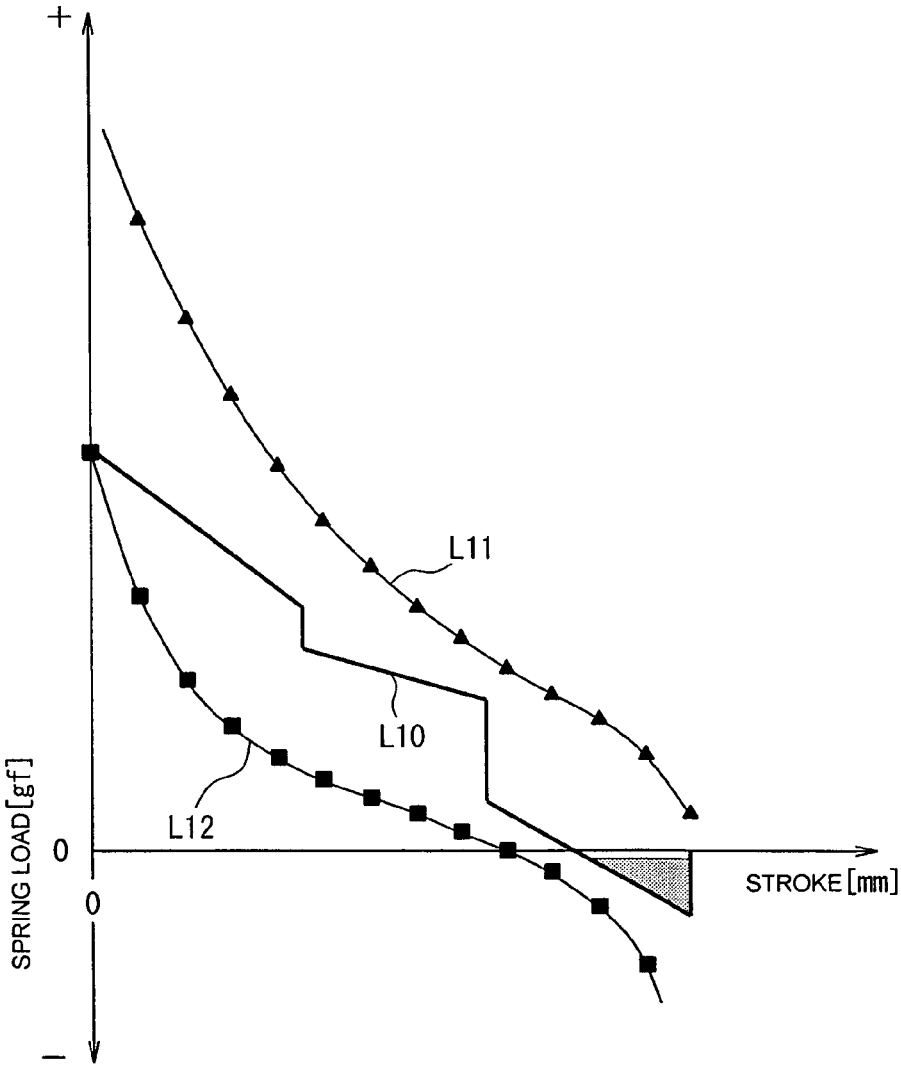
FIG. 66 is a characteristic diagram showing the relation between stroke and spring load of an electromagnetic contact device comprising an electromagnet with a permanent magnet.

As explained above, in this embodiment the spring load of the return spring 141 in proximity to the open position is held to a small value, and the force compressing the contact point springs 140 is augmented by the attractive force due to the permanent magnets 124, so that when for example subsidiary contact points having the four "b" contacts in the above configuration are connected so that contact points are 2*a*2*b*+4*b*, the relation between the stroke of the movable contact point support 137 and the spring load is the characteristic L10 represented by the polygonal line in FIG. 66.

In this FIG. 66, the input-attraction characteristic curve L11 when a DC voltage is applied to the excitation coil 110 (when the input voltage is Von), and the release-attraction characteristic curve L12 when a release voltage Voff, are shown; the contactor load represented by the polygonal-line characteristic L10 is within the range between the attractive force of the input-attraction characteristic curve L11 and the attractive force of the release-attraction characteristic curve L12, and it was verified that even if the initial spring load of the return spring 141 is lowered, an appropriate operation characteristic can be obtained.

Figure 67:
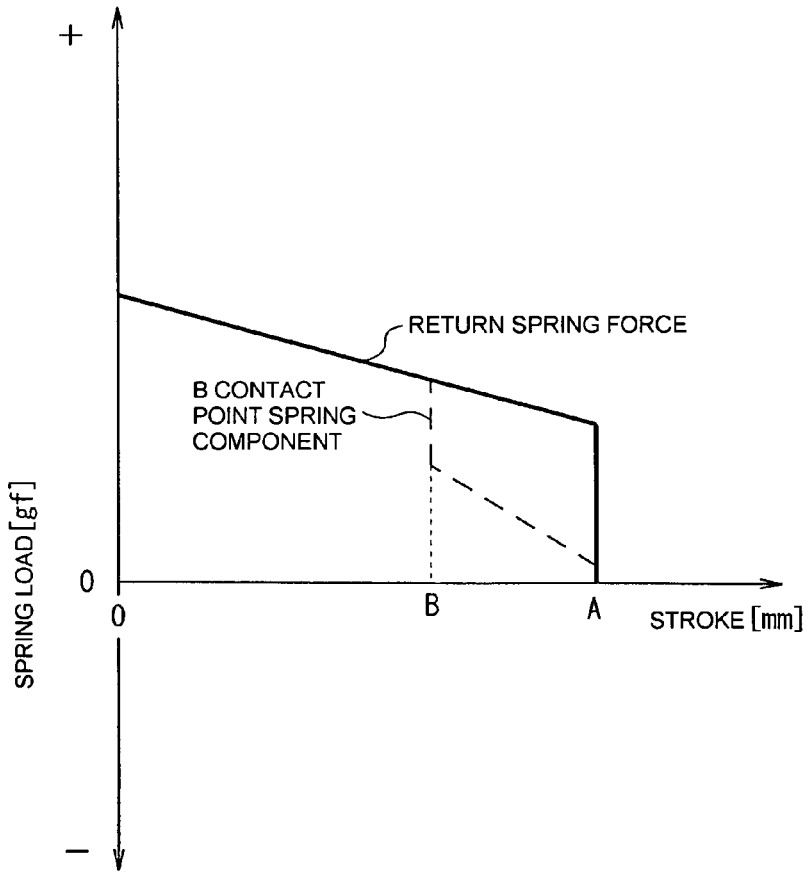
FIG. 67 is a characteristic diagram showing the relation between stroke and spring load in the proximity of the open position, in an example of the prior art.

By comparison, in a configuration of the prior art in which the linking plate portion 145 and lever pressing portion 146 in the linking portion 142 of the movable contact point support 137 are omitted and the attractive force due to the permanent magnets 124 is not used, and return to the open position of the movable contact point support 137 is augmented only by the return spring 141, it is necessary to set the spring load of the return spring 141 at stroke points A and B to a value exceeding the spring load of the contact point springs for "b" contact points as shown in FIG. 67.

Figure 68:
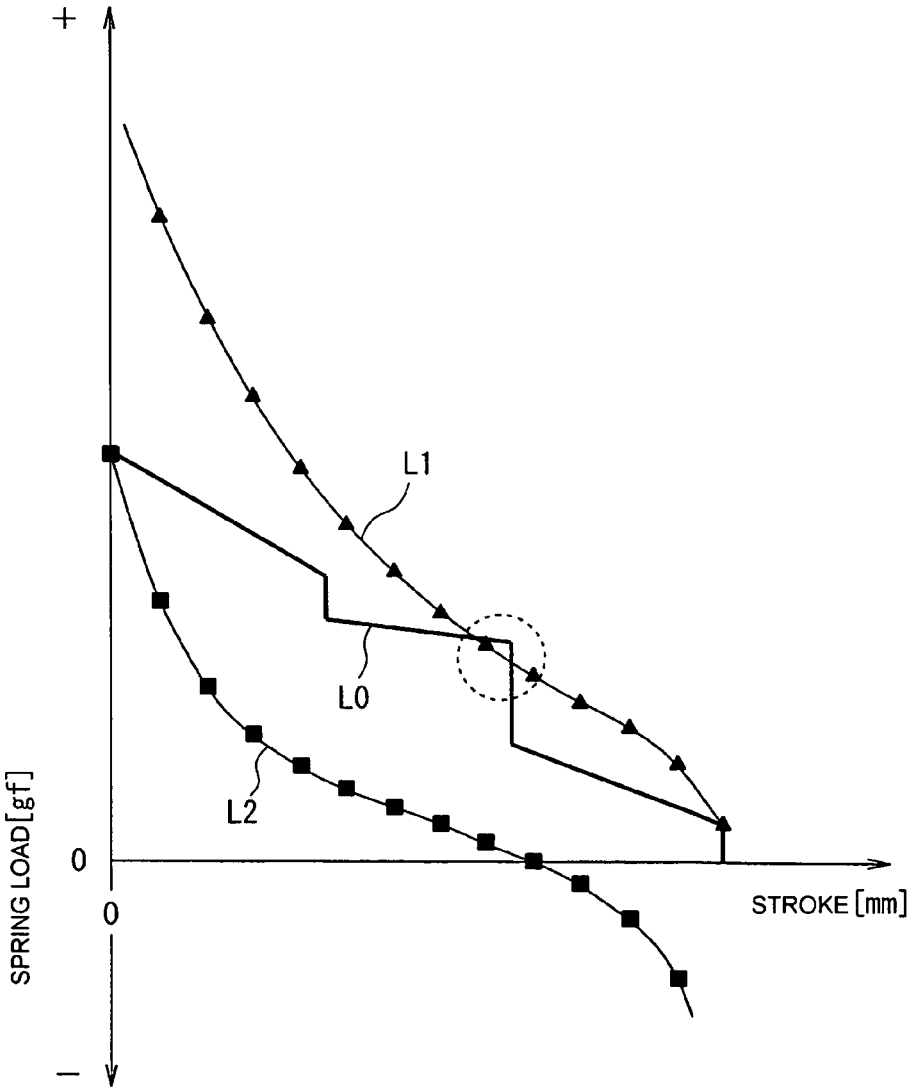
FIG. 68 is a characteristic diagram showing the relation between stroke and spring load in an example of the prior art.

Hence when the contact point configuration is made 2*a*2*b*+4*b*, the relation between stroke and spring load is as indicated by the polygonal-line characteristic L0 in FIG. 68. As it is clear from this FIG. 68, the spring load indicated by the characteristic L0 when the movable contact points 138*c* and 138*d* begin contact with the fixed contact points TNC exceeds the attractive force of the input-attraction characteristic L1 as indicated by the dashed-line circle; therefore, the pulling force generated by the electromagnet must be intensified, and to this end the number of turns of the excitation coil 110 must be increased, so that there is the problem that the overall configuration increases in size.

On the other hand, as explained above, in this embodiment the attractive force of the permanent magnets 124 is used to lower the spring force of the return spring 141, so that as shown in FIG. 66, the spring load indicated by the characteristic L10 does not exceed the attractive force indicated by the input-attraction characteristic curve L11, and the spring load can be held sufficiently lower than the attractive force of the input-attraction characteristic curve L11, so that the overall configuration can be made compact.

In the above embodiment, a case was explained in which, in the outside yoke 121 constructing the electromagnet with permanent magnets 80, the linking plate portion 121*c* linking the left- and right-end plate portions 121*a* and 121*b* has a flat plate portion 121*d* and an inclined plate portion 121*e*; but other configurations are possible, and an outside yoke of arbitrary configuration can be used, and in addition an electromagnet with permanent magnets of arbitrary configuration can be used as the electromagnet with permanent magnets itself as well.

Further, in the above embodiment a case was explained in which the driving lever 119 is press-fit into and held by the linking portion 142 of the movable contact point support 137; but other configurations are possible, and the lever pressing portion 146 of the linking portion 142 may be omitted, and an engaging portion formed in the right-end face of the driving lever 119 such that at least the attractive force of the permanent magnets 124 is transmitted to the movable contact point support 137 through the linking portion 142 and driving lever 119, and the driving lever 119 contacts with and held by the linking portion 142 without a gap.

Further, in the above embodiment a case was explained in which the movable contact point portion 135 has two open contact points and two closed contact points; but other configurations are possible, and a three-phase, four-wire, R phase, S phase, T phase, and N phase contact point configuration, or another arbitrary contact point configuration, can be used.

(Structure of Installation of an Electromagnetic Contact Device on a Rail)

A structure in which the electromagnetic contact device 1*a* adopted in this invention is installed on a rail installed within a wiring board or other board is explained referring to FIG. 69 to FIG. 73. The same configuration is used when installing the electromagnetic contact device 1*b* on a rail, and so an explanation is omitted.

Figure 69:
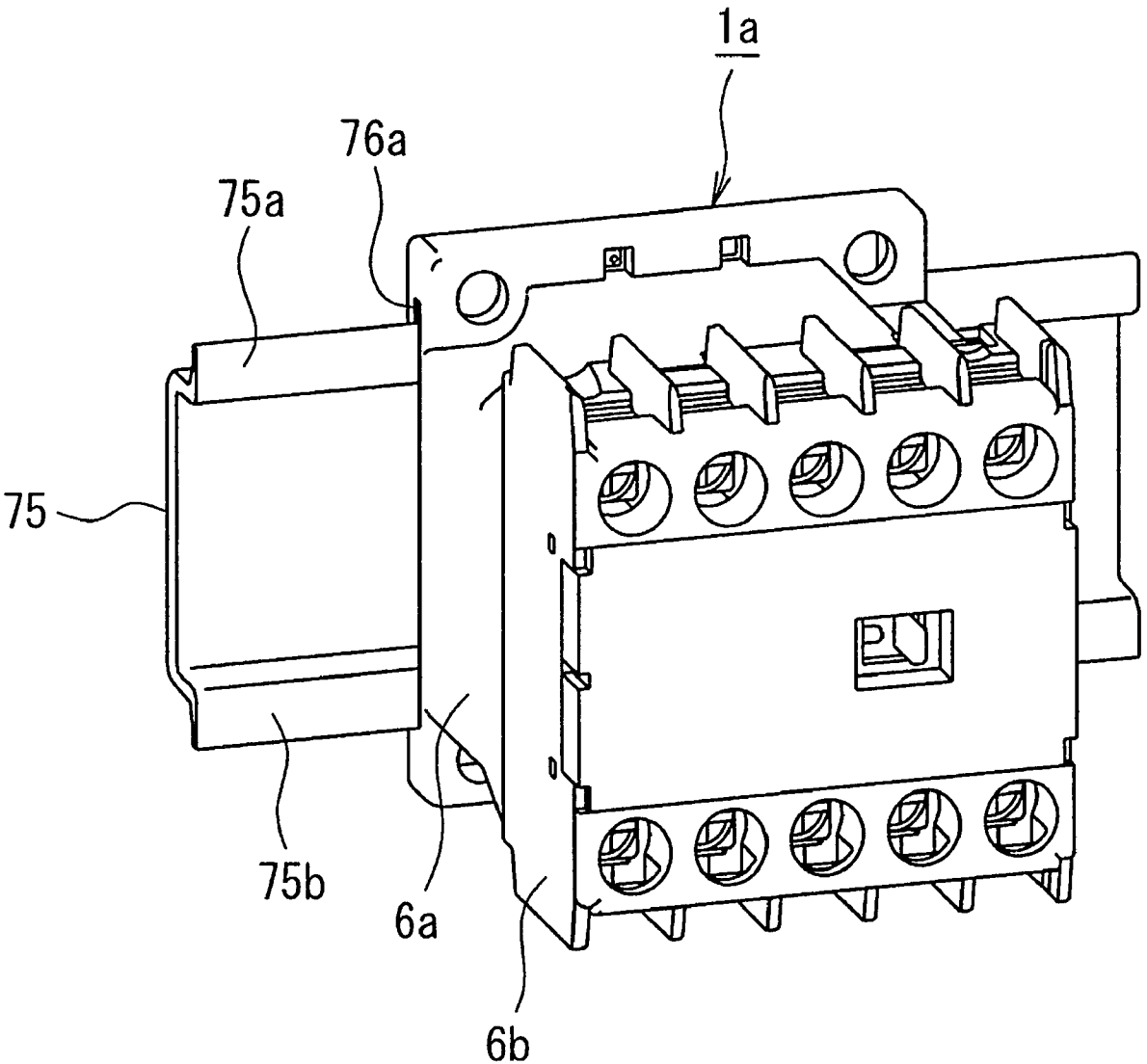
FIG. 69 is a perspective view showing a state in which an electromagnetic contact device of the invention is installed on a rail.

In FIG. 69, the symbol 75 is a rail installed in a wiring board or other board, a pair of upper and lower engaging rims 75*a*, 75*b*, which engage the electromagnetic contact device 1*a*, extends in parallel.

Figure 70:
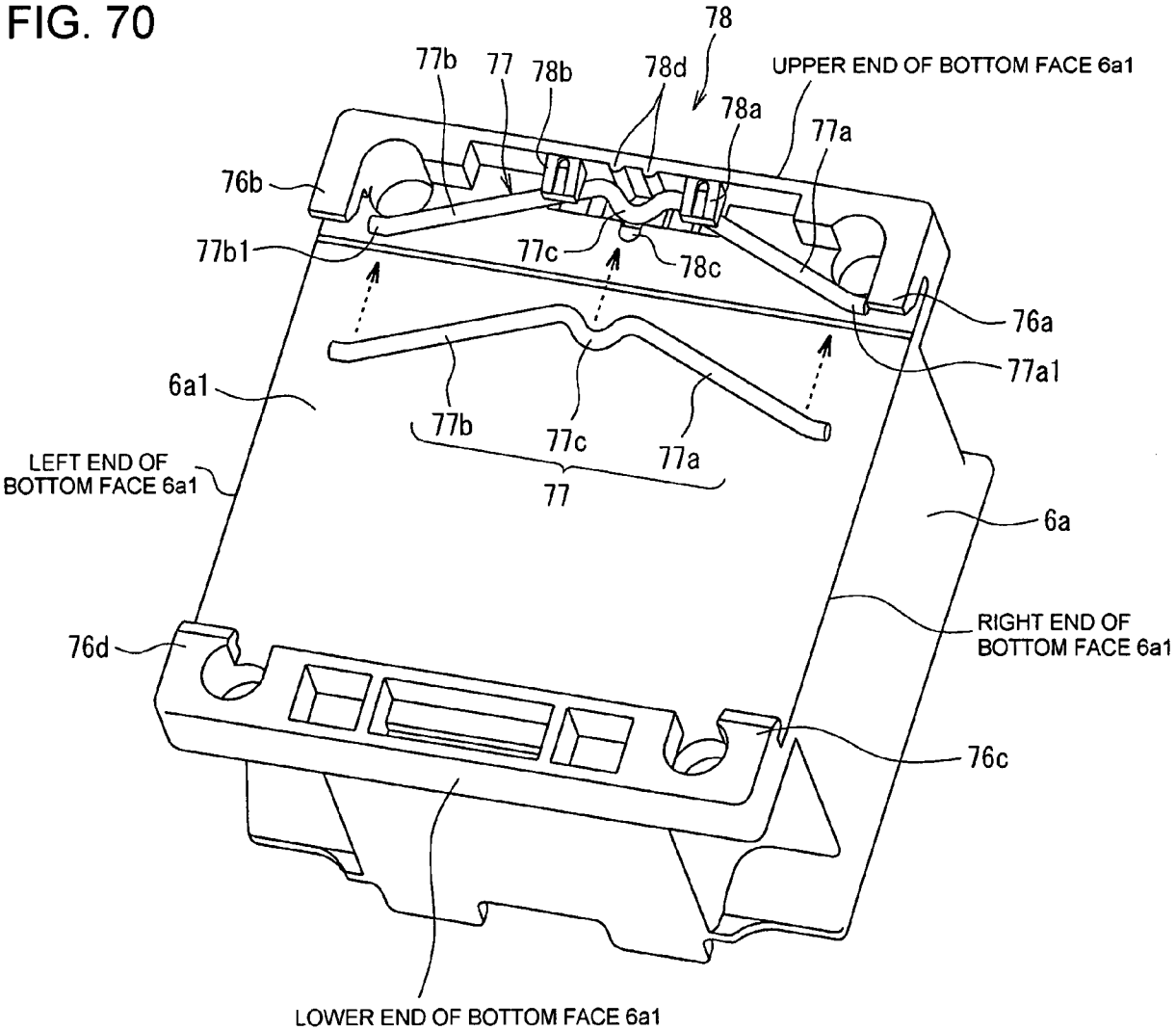
FIG. 70 shows a wire spring installed on the bottom face of an electromagnetic contact device.

As shown in FIG. 70, first engaging portions 76*a*, 76*b*, second engaging portions 76*c*, 76*d*, a wire spring 77, and a spring holding portion 78 are provided on the bottom face 6*a*1 of the lower case 6*a* of the electromagnetic contact device 1*a*.

That is, first engaging portions 76*a*, 76*b* are formed at both right and left ends in the upper portion of the bottom face 6*a*1, and second engaging portions 76*c*, 76*d* are formed at both right and left ends in the lower portion of the bottom face 6*a*1. The first engaging portions 76*a*, 76*b* are provided with gaps to mate with the upper engaging rim 75*a* of the rail 75, and hook shapes are formed, directed toward the lower end of the bottom face 6*a*1. The second engaging portions 76*c*, 76*d* are provided with gaps to mate with the lower engaging rim 75*b* of the rail 75, and hook shapes are formed, directed toward the upper end of the bottom face 6*a*1.

The wire spring 77 is obtained by bending an elastic wire material, of wire diameter 0.5 to 1.5 mm, into a mountain shape. As shown in FIG. 70, this wire spring 77 has a pair of pressing spring portions 77*a*, 77*b* extending linearly to the center portion in the length direction while inclined upward at the same angle, and a latched portion 77*c*, which links this pair of pressing spring portions 77*a*, 77*b* at the center in the length direction, and is bent into a semicircular arc shape. Further, both ends of this wire spring 77, that is, the end portions 77*a*1, 77*b*1 of the pair of pressing spring portions 77*a*, 77*b*, are positioned to the inside of the first engaging portions 76*a*, 76*b*, and even when the pair of pressing spring portions 77*a*, 77*b* is elastically deformed so that the rising inclination is made more gradual, the end portions 77*a*1, 77*b*1 do not contact with the first engaging portions 76*a*, 76*b*.

The spring holding portion 78 has a pair of wire spring clamping portions 78*a*, 78*b*, a wire spring holding boss 78*c*, and a wire spring lateral-shift prevention portion 78*d*.

The pair of wire spring clamping portions 78*a*, 78*b* is formed protruding in an eaves shape from the upper-end wall portion between the first engaging portions 76*a*, 76*b* toward the lower end of the bottom face 6*a*1; the pair of pressing spring portions 77*a*, 77*b* in proximity to the latched portion 77*c* of the wire spring 77 is clamped and held in the gaps of this pair of wire spring clamping portions 78*a*, 78*b*.

Further, the wire spring holding boss 78*c* is formed protruding from the bottom face 6*a*1 at a position between the pair of wire spring clamping portions 78*a*, 78*b*, and engages the latched portion 77*c* of the wire spring 77 from the outside.

The wire spring lateral-shift prevention portion 78*d* is a member which protrudes in ridges from the upper-end wall portion between the pair of wire spring clamping portion 78*a*, 78*b* in a direction perpendicular to the bottom face 6*a*1, and abuts the inside of the latched portion 77*c* of the wire spring 77 clamped by the pair of wire spring clamping portions 78*a*, 78*b*.

The wire spring 77 in this embodiment is installed in the spring holding portion 78 as follows.

As shown in FIG. 70, when the wire spring 77 is slid in the direction of the arrow toward the spring holding portion 78, the latched portion 77*c* rides up over the wire spring holding boss 78*c*, and the pair of wire spring clamping portions 78*a*, 78*b* clamp and hold the pair of pressing spring portions 77*a*, 77*b* in proximity to the latched portion 77*c*. And, the pair of pressing spring portions 77*a*, 77*b*, in a somewhat bowed state, is arranged along the bottom face 6*a*1 between the first engaging portions 76*a*, 76*b*, and the task of installing the wire spring 77 is completed.

Here, the wire spring holding boss 78*c* engages from the outside with the latched portion 77*c* of the wire spring 77, so that drop-out of the wire spring 77 from the pair of wire spring holding portions 78*a*, 78*b* is reliably prevented.

Further, even when an external force acts on the wire spring 77 in the length direction, the wire spring lateral-shift prevention portion 78*d* abuts the inside of the latched portion 77*c* of the wire spring 77, so that movement in the length direction of the wire spring 77 is arrested.

Figure 71:
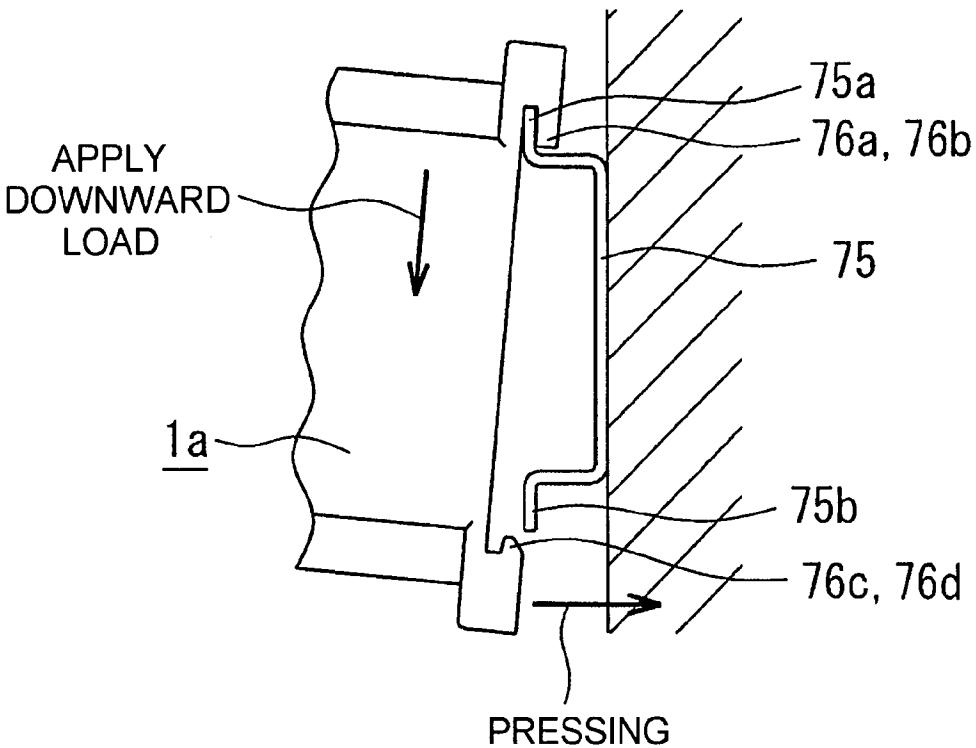
FIG. 71 shows initial operation to install an electromagnetic contact device on a rail.
Figure 72:
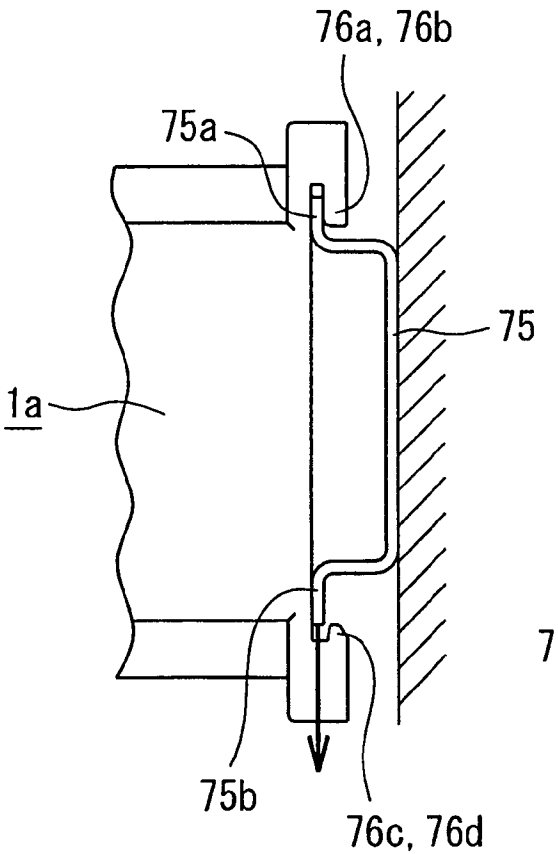
FIG. 72 shows intermediate operation to install an electromagnetic contact device on a rail.
Figure 72:
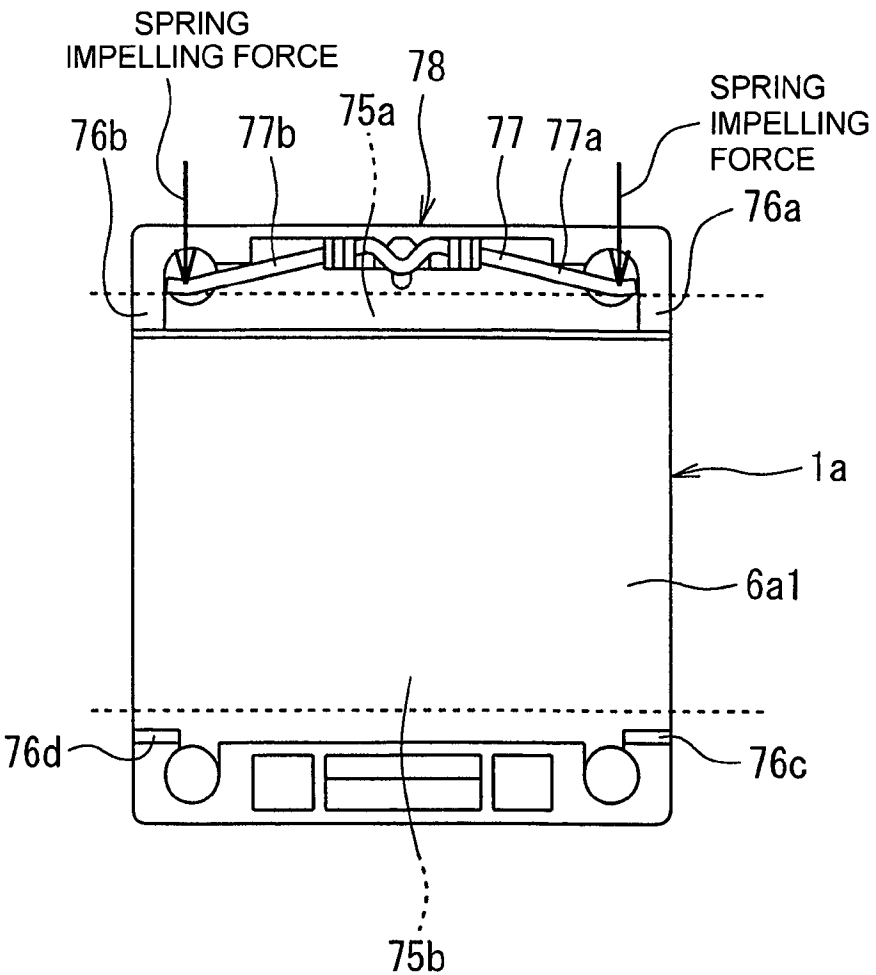
Figure 73:
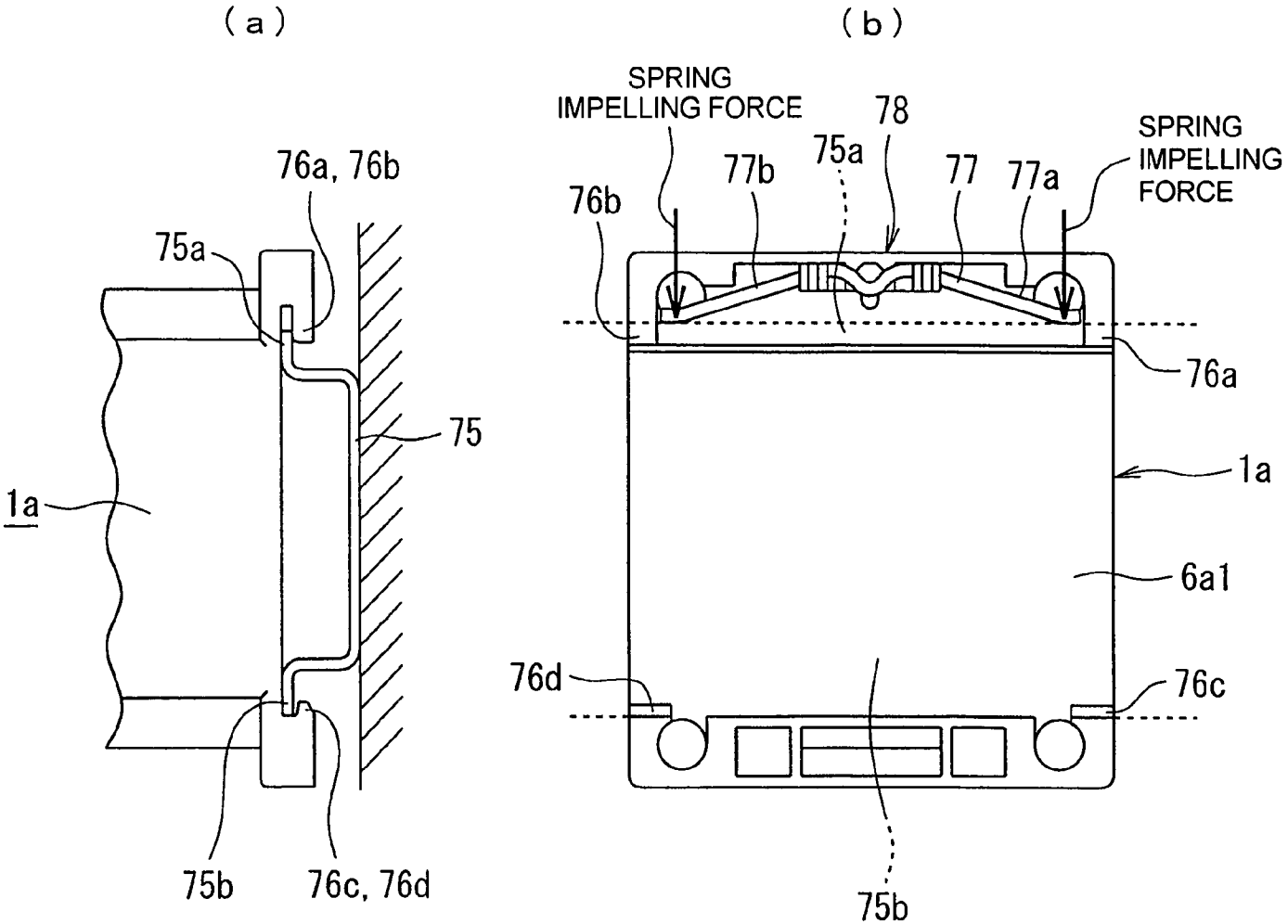
FIG. 73 shows a state in which installation of an electromagnetic contact device on a rail is completed.

Next, a procedure for mounting the electromagnetic contact device 1*a* of this embodiment on the rail 2 is explained, referring to FIG. 71 to FIG. 73.

First, as shown in FIG. 71, the first engaging portions 76, 76*b* are hung on the upper engaging rim 75*a* of the rail 75, and by applying a downward load to the electromagnetic contact device 1*a*, the upward inclination (mountain-shape inclination angle) of the pair of pressing spring portions 77*a*, 77*b* abutting the upper engaging rim 75*a* assumes a gradual shape, and the wire spring 77 is elastically deformed. Then, the third engaging protrusions 76*c*, 76*d* are pressed onto the lower engaging rim 75*b* of the rail 75.

Next, application of the downward load on the electromagnetic contact device 1*a* is released. By this means, as shown in FIG. 72, the pair of pressing spring portions 77*a*, 77*b* begins to act with a spring urging force on the upper engaging rim 75*a* of the rail 75, and through the gradual upward movement of the electromagnetic contact device 1*a*, the lower engaging rim 75*b* of the rail 75 enters the second engaging portions 76*c*, 76*d*, as indicated by the arrow.

And, as shown in FIG. 73, the first engaging portions 76*a*, 76*b* of the electromagnetic contact device 1*a* mate with the upper engaging rim 75*a* of the rail 75, the second engaging portions 76*c*, 76*d* mate with the lower engaging rim 75*b* of the rail 75, the pair of pressing spring portions 77*a*, 77*b* of the wire spring 77 acts with a spring urging force on the upper engaging rim 75*a* of the rail 75, and in a state in which the second engaging portions 76*c*, 76*d* are pressing the end face of the lower engaging rim 75*b* of the rail 75, the electromagnetic contact device 1*a* is mounted on the rail 75.

Further, when uninstalling the electromagnetic contact device 1*a* from the rail 75, no tools are necessary, and after applying a downward load to the electromagnetic contact device 1*a*, causing elastic deformation of the pair of pressing spring portions 77*a*, 77*b* of the wire spring 77 so that the upward inclination becomes gradual, and moving the electromagnetic contact device 1*a* downward by releasing engagement of the lower engaging rim 75*b* of the rail 75 with the second engaging portions 76*c*, 76*d*, and then releasing engagement of the upper engaging rim 75*a* of the rail 75 with the first engaging portions 76*a*, 76*b*, the electromagnetic contact device 1*a* can be uninstalled from the rail 75.

By means of this embodiment, a wire spring 77 bent into a mountain shape is arranged on the bottom face 6*a*1 of the lower case 6*a*, and simply by elastically deforming the wire spring 77 to engage and release with the first engaging portions 76*a*, 76*b* and second engaging portions 76*c*, 76*d*, the electromagnetic contact device 1*a* can be installed onto and uninstalled from the rail 75. Hence the electromagnetic contact device 1*a* can be installed using a small number of components and a small number of assembly processes, and can be uninstalled from the rail 75 without the need for tools.

Further, the pair of pressing spring portions 77*a*, 77*b* in proximity to the latched portion 77*c* is clamped by the pair of wire spring clamping portions 78*a*, 78*b*, so that the wire spring 77 can easily be elastically deformed into a shape in which the rising inclination (mountain shape inclination angle) of the pair of pressing spring portions 77*a*, 77*b* becomes gradual.

Further, even when an external force acts in the length direction of the wire spring 77, the wire spring lateral-shift prevention portion 78*d* abuts the inside of the latched portion 77*c* of the wire spring 77, so that movement in the length direction of the wire spring 77 can be reliably arrested.

And, both ends (end portions 77*a*1, 77*b*1) of the wire spring 77 are positioned on the inside of the first engaging portions 76*a*, 76*b*, and even when the pair of pressing spring portions 77*a*, 77*b* are elastically deformed such that the upward inclination becomes gradual, the end portions 77*a*1, 77*b*1 do not contact with the first engaging portions 76*a*, 76*b*, so that adequate space is secured when the wire spring 77 is deformed.

INDUSTRIAL APPLICABILITY

As explained above, an electromagnetic contact device of this invention is useful for enabling selection of a plurality of types of ancillary units in accordance with various user demands, and for selecting and mounting by simple means one or more of these types of ancillary units.

EXPLANATION OF REFERENCE NUMERALS

1*a*, 1*b* Electromagnetic contact device
2 Reversible unit
2*a* Unit body
2*b* First abutting face
2*c* First hook portion
2*d* Second hook portion
2*e* Third hook portion
2*f* Fourth hook portion
2*g*, 2*h* Reversible post
2*g*1, 2*h*1 Indicator piece engaging portion
2*g*2, 2*h*2 Reversible unit operation indicator piece
2*i* Unit window
2*j* Second abutting face
2*k* Unit window
2*m* Neck portion
2*n*, 2*o*, 2*p*, 2*q*, 2*r*, 2*s* Sixth to eleventh linking hole
3*a*, 3*b* Surge absorption unit
3*a*1, 3*b*1 Unit body
3*a*2, 3*a*3, 3*b*2, 3*b*3 Surge terminal
3*a*4, 3*a*5, 3*b*4, 3*b*5 Hook portion
3*a*6, 3*b*6 Recess portion
4*a*, 4*b* Auxiliary contact point unit
6 Body case
6*a* Lower case
6*b* Upper case
6*c* Arc-extinguishing cover
6*c*1 Lever support portion
6*c*2 Indicator window
7 Contact point portion
7*a* Movable contact point support
7*a*1 Operation indicator piece
7*b* Return spring
7*c* Movable contact point
7*d* Contact point spring
7*c* Movable contact point
8 Electromagnet
8*a* Coil
8*b* Coil frame
8*c* Fixed core
8*d* Movable core
9 Driving lever
9*c* Movable contact point support linking portion
10 Terminal portion
11 Coil terminal portion
12 First linking hole
13 Second linking hole
14 Third linking hole
15 Fourth communicating hole
16 Fifth linking hole
17 Surge terminal insertion path
17*a*, 17*b* Side wall
18 Surge terminal
19 Body case
19*a*, 19*b* Unit window
20*a*, 20*b*, 20*c* Hook portion
21 Hook-moving lever
22 Movable contact point support
22*a* Indicator piece engaging portion
22*b* Auxiliary contact point unit operation indicator piece
25 Auxiliary circuit terminal

What is claimed is:

1. A combination comprising an electromagnetic contact device and one or more different ancillary units, wherein the electromagnetic contact device comprises:

a body case having a case-side mounting portion to which the one or more different ancillary units are mounted, and an indicator window provided on a side on which the ancillary unit is mounted, a movable contact point support, an electromagnet having a coil, said coil, when being excited, moving the movable contact point support, and an operation indicator piece formed integrally with the movable contact point support and exposed to an outside from the indicator window, wherein the ancillary unit comprises:

a surge absorption unit absorbing surge voltages generated by the electromagnet and having a unit-side mounting portion, or an auxiliary contact point unit, the surge absorption unit or the auxiliary contact point unit being detachably mounted on the case-side mounting portion of the electromagnetic contact device, and wherein the auxiliary contact point unit includes a case, an indicator window formed in the case, an auxiliary circuit terminal, and an auxiliary contact point unit operation indicator piece exposed to an outside from the indicator window, said auxiliary contact point unit being arranged in the case linkable with the operation indicator piece of the electromagnetic contact device.

2. The combination according to claim 1, wherein the auxiliary contact point unit includes an indicator piece engaging portion, hooks to be connected to the body case, and a hook moving lever moving one of the hooks for removal of the auxiliary contact point unit.

3. The combination according to claim 2, wherein the surge absorption unit and the auxiliary contact point unit are attached to the body case of the electromagnetic contact device.

4. A combination comprising an electromagnetic contact device and one or more different ancillary units, wherein the electromagnetic contact device comprises:

a body case having a case-side mounting portion to which the one or more different ancillary units are mounted, and an indicator window provided on a side on which the ancillary unit is mounted, a movable contact point support, an electromagnet having a coil, said coil, when being excited, moving the movable contact point support, and an operation indicator piece formed integrally with the movable contact point support and exposed to an outside from the indicator window, wherein two electromagnetic contact devices are arranged adjacently, and wherein the ancillary unit comprises a reversible unit prohibiting simultaneous input of the two electromagnetic contact devices and having a unit-side mounting portion detachably mounted on the case-side mounting portions of the electromagnetic contact devices such that the two electromagnetic contact devices are linked.

5. The combination according to claim 4, wherein the ancillary unit further comprises one or two auxiliary contact point units having an auxiliary circuit terminal and a unit-side mounting portion detachably mounted on an inter-unit mounting portion provided in the reversible unit, and one or two surge absorption units absorbing surge voltages generated by the electromagnet and having a unit-side mounting portion detachably mounted on the case-side mounting portion of the electromagnetic contact device.

6. The combination according to claim 4, wherein the reversible unit is disposed in a case and is arranged to be linkable with the operation indicator piece of the electromagnetic contact device, and the reversible unit includes a reversible unit operation indicator piece exposed to an outside from an indicator window provided in the case.

7. The combination according to claim 6, wherein the auxiliary contact point unit is disposed in a case and is arranged to be linkable with the reversible unit operation indicator piece of the reversible unit, and the auxiliary contact point includes an auxiliary contact point unit operation indicator piece exposed to an outside from an indicator window provided in the case.

8. The combination according to claim 5, wherein the surge absorption unit is arranged to be detachably mounted on the electromagnetic contact device spanning the reversible unit.

* * * * *